US007855042B2

(12) United States Patent
Kobori et al.

(10) Patent No.: US 7,855,042 B2
(45) Date of Patent: Dec. 21, 2010

(54) DEVELOPER AND IMAGE FORMING METHOD

(75) Inventors: Takakuni Kobori, Toride (JP); Kenji Okado, Ushiku (JP); Masami Fujimoto, Sunto-gun (JP); Katsuhisa Yamazaki, Numazu (JP); Syuhei Moribe, Numazu (JP); Daisuke Yoshiba, Sunto-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 477 days.

(21) Appl. No.: 11/755,225

(22) Filed: May 30, 2007

(65) Prior Publication Data

US 2007/0224530 A1 Sep. 27, 2007

Related U.S. Application Data

(63) Continuation of application No. PCT/JP2007/050045, filed on Jan. 5, 2007.

(30) Foreign Application Priority Data

Jan. 6, 2006 (JP) ..... 2006/001783
Jun. 26, 2006 (JP) ..... 2006/174738
Nov. 22, 2006 (JP) ..... 2006/315476

(51) Int. Cl.
*G03G 9/08* (2006.01)

(52) U.S. Cl. ..... 430/108.6; 430/108.7

(58) Field of Classification Search ..... 430/108.6, 430/108.7
See application file for complete search history.

(56) References Cited

U.S. PATENT DOCUMENTS 5,547,796 A * 8/1996 Kohtaki et al. ..... 430/110.4
5,604,071 A * 2/1997 Okado et al. ..... 430/108.6
5,837,413 A * 11/1998 Yada et al. ..... 430/108.24
5,853,938 A * 12/1998 Nakazawa et al. ..... 430/108.6
5,858,597 A * 1/1999 Mizoh et al. ..... 430/108.6
6,060,202 A * 5/2000 Ogawa et al. ..... 430/108.3
6,187,497 B1 * 2/2001 Kushi et al. ..... 430/110.4
6,335,135 B1 * 1/2002 Arai et al. ..... 430/108.6
6,335,138 B1 * 1/2002 Kurose et al. ..... 430/110.2
6,663,851 B1 * 12/2003 Deller et al. ..... 424/59
7,115,349 B2 * 10/2006 Iida et al. ..... 430/108.24
2002/0072006 A1 * 6/2002 Mizoo et al. ..... 430/108.22

(Continued)

OTHER PUBLICATIONS

Patent Abstracts of Japan for JP2000-206730, Published Jul. 28, 2000.

(Continued)

*Primary Examiner*—Hoa V Le
(74) *Attorney, Agent, or Firm*—Fitzpatrick, Cella, Harper & Scinto

(57) ABSTRACT

To provide a developer and an image forming method with each of which a high-resolution, high-definition image can be stably obtained over a long time period irrespective of an environment. The present invention provides a developer including at least: toner particles each containing at least a binder resin; and a composite inorganic fine powder, the developer being characterized in that: the composite inorganic fine powder has a peak at a Bragg angle (2θ±0.20 deg) of each of 32.20 deg, 25.80 deg, and 27.50 deg in a CuKα characteristic X-ray diffraction pattern; and the half width of the X-ray diffraction peak at a Bragg angle (2θ±0.20 deg) of 32.20 deg is 0.20 to 0.30 deg.

6 Claims, 14 Drawing Sheets

U.S. PATENT DOCUMENTS

| | | | | |
|---|---|---|---|---|
| 2003/0152856 | A1* | 8/2003 | Mizoe et al. | 430/108.1 |
| 2004/0131856 | A1* | 7/2004 | Kajihara et al. | 428/407 |
| 2005/0058926 | A1* | 3/2005 | Kawakami et al. | 430/108.7 |
| 2005/0183634 | A1* | 8/2005 | Schumacher et al. | 106/446 |
| 2006/0204879 | A1* | 9/2006 | Anno et al. | 430/108.6 |
| 2007/0072104 | A1* | 3/2007 | Yabe et al. | 430/108.6 |

OTHER PUBLICATIONS

Patent Abstracts of Japan for JP2001-109181, published Apr. 20, 2001.

Patent Abstracts of Japan for JP2003-015349, published Jan. 17, 2003.

Patent Abstracts of JP2003-277054, published Oct. 2, 2003.

Patent Abstracts of JP2005-156988, published Jun. 16, 2005.

Patent Abstracts of JP2005-316226, published Nov. 10, 2005.

Patent Abstracts of JP2005-338750, published Dec. 8, 2005.

PCT Notification Concerning Transmittal of International Preliminary Report on Patentability (Chapter 1 or Chapter 2 of the Patent Cooperation Treaty) (Form PCT/IB/338); International Preliminary Report on Patentability (Chapter 1 of the Patent Cooperation Treaty) (Form PCT/IB/373); Written Opinion of the International Searching Authority (Form PCT/ISA/237), regarding Internation Application No. PCT/JP2007/050045.

* cited by examiner

DEVELOPER AND IMAGE FORMING METHOD

TECHNICAL FIELD

The present invention relates to a developer used for an electrophotographic method, an electrostatic recording method, and a magnetic recording method, and to an image forming method.

BACKGROUND ART

A large number of electrophotographic methods have been conventionally known. Known electrophotographic methods generally involve: utilizing a photoconductive substance first to form an electrostatic latent image on an image bearing member (photosensitive member) by various means; next, supplying the latent image with toner to provide a visible image; obtaining a toner image; transferring the toner image onto a transfer material such as paper as required; after which the toner image is fixed to the transfer material by using heat pressure to provide a copied article.

Of those development modes, a one-component development mode is preferably used because a developing unit to be used in the mode is of a simple structure, causes a small number of troubles, and can be easily maintained. The one-component development mode involves the use of a one-component developer (which may hereinafter be referred to as "toner"). The mode involves: applying charge to toner particles by means of friction between a layer thickness regulating member (which may hereinafter be referred to as "blade") and the developer and friction between a developer carrier (which may hereinafter be referred to as "developing roller") and the developer; applying a thin layer of the developer onto the developing roller; conveying the developer to a developing region where the developing roller and an electrostatic latent image bearing member are opposed to each other; and developing an electrostatic latent image on the electrostatic latent image bearing member to visualize the image as a toner image.

The method enables the toner to be sufficiently subjected to triboelectric charging by the formation of a thin layer of the toner, but needs the uniform application of the developer onto the developing roller before development in order that the electrostatic latent image may be faithfully reproduced, and the resolution and definition of an image may be improved. However, in association with a recent increase in print speed, a strong mechanical stress is apt to be applied to, for example, a portion where the developing roller and the blade are close to each other, and a regulating force exerted by the blade on the developer on the developing roller becomes uneven, with the result that it is difficult to form a uniform thin layer of the toner. In addition, a shear force to be applied to the developer in a developing unit increases, thereby causing the deterioration of the developer, reductions in image quality and density, and a fogging phenomenon. Further, when images each having a high printing ratio are continuously developed, a reduction in density occurs in a stripe fashion owing to the insufficient supply of the toner to the developing roller.

In particular, in the case of a magnetic one-component development mode in which magnetism generating means is incorporated into a developing roller and magnetic toner obtained by incorporating magnetic particles into toner particles is used for preventing toner scattering, it is difficult to apply a developer uniformly to the developing roller owing to a magnetic binding force on the developing roller and an increase in stress in association with an increase in specific gravity of each toner particle.

To alleviate those problems, a method involving adding a large amount of a fluidity imparting agent such as a silica fine particle to a developer and a method involving adding two kinds of materials, that is, silica and titanium oxide have been proposed (see Patent Document 1). However, none of those methods is sufficient to achieve compatibility between charging stability and resistance against a mechanical stress.

In addition, methods each involving adding a strontium titanate particle having a small particle diameter or a composite particle composed of strontium titanate and strontium carbonate to a toner particle have been proposed (see Patent Documents 2 and 3). Particles used in those methods each have an excellent abrasion effect because each of the particles has a fine particle diameter, and the content of coarse particles in the particles is small. The particles used in those methods are effective in preventing the filming or fusion of toner onto an electrostatic latent image bearing member. However, at the same time, the particles used in those methods impair the fluidity of the toner. Accordingly, in each of those methods, it has been difficult to form a uniform thin layer of a developer on a developing roller in a developing step.

As described above, in order that a high-resolution, high-definition image may be stably obtained over a long time period irrespective of an environment, toner having not only a stable charging ability but also strong resistance against a mechanical stress has been required.

Efforts have been conventionally made to cope with such problems on the basis of measures for toner. However, such efforts are still susceptible to improvement.

In addition, in recent years, a photosensitive member having a photoconductive layer containing amorphous silicon and a surface protective layer (which may hereinafter be referred to as "amorphous silicon photosensitive member") has been often used for the purposes of pursuing improvements in durability and image quality, and achieving a maintenance-free photosensitive member. In particular, an amorphous silicon photosensitive member drum is excellent in wear resistance because its surface layer is hard. Accordingly, the drum is suitably used in a use environment where images are continuously printed at a high speed over a long time period.

A digital mode involving the use of, for example, a laser light scan or an LED array as a light source has become the mainstream of latent image exposing means for a photosensitive member in order to correspond to the need for print-on-demand (POD). In this case, an appropriate one is chosen from two kinds of methods: a reversal development mode involving writing an image portion as a latent image with, for example, laser and causing toner to adhere to the portion and a regular development mode involving writing a non-image portion as a latent image and causing toner to adhere to a portion except the portion. The reversal development mode is suitably employed from the viewpoints of the emission intensity, response speed, and lifetime of a light source.

On the other hand, in a transferring step or a cleaning step, upon separation (stripping) of toner electrostatically adsorbed to the surface of a photosensitive member which moves at a high speed, a phenomenon in which charge opposite in polarity to the charged polarity of the toner is passed to the surface of the photosensitive member, that is, an electrostatic discharge phenomenon occurs. This is a peeling discharge phenomenon which occurs between the photosensitive member and the separated toner.

A discharge amount itself in association with the peeling discharge is extremely small. However, when the particle diameter of the toner is small (μm order), discharge converges on an extremely small area where the toner is in direct contact with the photosensitive member, and the resistance of the toner itself is high, the discharge amount may eventually become energy capable of breaking a charge blocking ability near the surface layer of the photosensitive member.

The voltage resistance of an amorphous silicon photosensitive member is typically high in the polarity direction of the charge of the photosensitive member, but is extremely low in the opposite polarity direction. Accordingly, when peeling discharge occurs on a side opposite in polarity to the charged polarity of the photosensitive member, and continues for a long time period, the charge retaining performance of the surface layer of the photosensitive member at the portion is apt to be finely broken. The reversal development mode is characterized in that toner and a photosensitive member are identical in polarity of charge to each other as follows: the charged polarity of the toner is positive and the charged polarity of the photosensitive member is positive, or the charged polarity of the toner is negative and the charged polarity of the photosensitive member is negative. Therefore, the polarity of peeling discharge occurring upon separation of toner from the surface of a photosensitive member is opposite to the charged polarity of the photosensitive member. Accordingly, particularly when an amorphous silicon photosensitive member is used, the charge retaining ability of the surface layer of the photosensitive member is apt to be finely broken. As a result, potential unevenness on the surface of the photosensitive member, and image density unevenness in association with the unevenness are apt to occur. Further, the local occurrence of a high electric field causes a leak phenomenon to break the photosensitive member itself. As a result, there arises a problem in that a black dot (hereinafter, this phenomenon is referred to as "black spot") occurs on an image to reduce the print quality of the image remarkably.

In addition, the frequency at which, or the extent to which, such peeling discharge occurs tends to increase with increasing speed at which toner is stripped from the surface of a photosensitive member (in other words, the circumferential speed of a photosensitive member drum=a process speed), increasing bearing amount of developed toner on the surface of the photosensitive member, or increasing charge amount of the toner. Accordingly, the peeling discharge has started to distinguish itself as a serious problem in a recent trend, that is, an increase in print speed.

Under such circumstances, for the purpose of avoiding a peeling discharge phenomenon on the surface of an amorphous silicon photosensitive member, a method of controlling the resistivity of the surface layer of the photosensitive member to a low value (see Patent Document 4), and a method of controlling a relationship between the thickness and resistivity of the surface protective layer of the amorphous silicon photosensitive member to fall within a specific range (see Patent Document 5) have been proposed. In addition, a method involving constituting the structure of the amorphous silicon photosensitive member in an arbitrary manner to avoid the dielectric breakdown of the photosensitive member resulting from peeling discharge (see Patent Document 6) has been proposed.

On the other hand, a method involving adding a specific compound to toner to avoid a peeling discharge phenomenon on the surface of a photosensitive member (see Patent Document 7) has been proposed.

The methods proposed in Patent Documents 4 to 7 are each an effective method in terms of the suppression of a peeling discharge phenomenon or leak phenomenon on the surface of a photosensitive member. At present, however, in consideration of product design with an additionally high degree of freedom, an additional increase in number of alternatives has been demanded of those means for achieving the avoidance of a discharge phenomenon.

In addition, cleaning involving the use of a cleaning member has been performed for removing transfer residual toner from an image-bearing member in many cases. A mode in which a blade-like elastic member is brought into press contact with an image bearing member to sweep transfer residual toner has been often employed because the elastic member is of a simple structure. However, such blade may cause the following phenomenon: the reversal (turn) or chatter of the blade occurs, or the tip of the blade chips owing to friction between the image bearing member and the blade in long-term use, so a developer evades.

In addition, an inconvenience is apt to occur at a portion where a member except an image bearing member and the image bearing member are in contact with each other even in a constitution free of any cleaning step. For example, when contact charging is employed, an image bearing member may be nonuniformly charged owing to the contamination of charging means. In addition, contact developing means is used, a developer may be insufficiently charged owing to the fusion of the developer to, for example, a developing roller. Further, when contact transfer is performed, a transfer void due to the generation of a flaw on transferring means occurs in some cases.

Patent Documents 8 to 10 each propose a reduction in frictional force by such roughening of the surface of an image bearing member that an area of contact between a member contacting with the image bearing member and the surface of the image bearing member reduces with a view to solving those detrimental effects occurring between the image bearing member and the member contacting with the image bearing member.

However, each of the proposals still involves problems such as the difficulty with which such roughened surface is produced and a large influence on image quality.

In addition, those surface-roughening treatments each involve the following problem: a larger amount of irregularities than necessary are present on the surface of a photosensitive member, a fine particulate liberated product of a developer or a material of which the developer is constituted, in particular, a fluidity imparting agent or the like accumulates particularly at a recessed portion in the surface, and the developer is apt to fuse with the surface of the photosensitive member owing to the accumulation to cause a detrimental effect on an image.

In recent years, the following proposal has been made: a surface layer having high hardness is provided on an image bearing member so that the amount in which the member is shaved is reduced, and the lifetime of the member is lengthened (see Patent Document 10). However, as a result of an increase in hardness of the surface layer of the image bearing member, friction between the image bearing member and a member contacting with the image bearing member tends to increase to accelerate the above-mentioned phenomenon.

Various proposals have been made also for a developer. For example, Patent Document 1 described above proposes a method involving adding two kinds of materials, that is, silica and titanium oxide. In the method, silica and titanium oxide fine particles are apt to accumulate at a recessed portion in a photosensitive member subjected to a surface-roughening treatment, so an image bearing member is apt to be flawed, and the fusion of a developer is apt to be caused.

In addition, Patent Documents 2 and 3 described above each propose a method involving adding a strontium titanate particle having a small particle diameter or a composite particle composed of strontium titanate and strontium carbonate to a toner particle. In an image bearing member the surface of which is subjected to shape adjustment and to roughening, it has been difficult to remove a product liberated from a developer accumulating at a recessed portion even by using each of those additives.

As described above, not only an improvement in each of an image bearing member and a developer but also an improvement in performance based on a combination of the image bearing member and the developer has been needed for obtaining a good image stably while suppressing damage to an electrophotographic constituent member over a long time period.

Patent Document 1: JP 2002-372800 A
Patent Document 2: JP 10-10770 A
Patent Document 3: JP 2003-15349 A
Patent Document 4: JP 2002-287390 A
Patent Document 5: JP 2002-357912 A
Patent Document 6: JP 2002-287391 A
Patent Document 7: JP 2005-128382 A
Patent Document 8: JP 53-92133 A
Patent Document 9: JP 52-26226 A
Patent Document 10: JP 57-94772 A

DISCLOSURE OF THE INVENTION

Problems to be Solved by the Invention

An object of the present invention is to provide a developer that has solved the above-mentioned problems, and an image forming method involving the use of the developer.

That is, the object of the present invention is to provide a developer with which a high-resolution, high-definition image can be stably obtained over a long time period irrespective of an environment, and an image forming method involving the use of the developer.

Means for Solving the Problems

The inventors of the present invention have conducted investigation into a constituent material to be used in a developer with a view to achieving the above object. As a result, the inventors have found that a high-resolution, high-definition image which: does not cause, for example, a stripe-like density reduction due to the insufficient conveyance of a developer to a developing roller; and is free of fogging or the like can be stably obtained over a long time period irrespective of an environment by controlling a relationship between a toner particle containing at least a binder resin and a composite inorganic fine powder.

According to an aspect of the present invention, there is provided a developer including at least: toner particles each containing at least a binder resin; and a composite inorganic fine powder containing strontium titanate, strontium carbonate, and titanium oxide, in which: the composite inorganic fine powder has a peak at a Bragg angle (2θ±0.20 deg) of each of 32.20 deg, 25.80 deg, and 27.50 deg in a CuKα characteristic X-ray diffraction pattern; and a half width of the X-ray diffraction peak at a Bragg angle (2θ±0.20 deg) of 32.20 deg is 0.20 to 0.30 deg.

Further, according to the aspect of the present invention, in the developer, an intensity level (Ia) of the peak at a Bragg angle (2θ±0.20 deg) of 32.20 deg in the CuKα characteristic X-ray diffraction pattern of the composite inorganic fine powder, an intensity level (Ib) of the peak at a Bragg angle of 25.80 deg in the pattern, and an intensity level (Ic) of the peak at a Bragg angle of 27.50 deg in the pattern preferably satisfy the following formulae:

$$0.010<(Ib)/(Ia)<0.150$$

$$0.010<(Ic)/(Ia)<0.150.$$

Further, according to the aspect of the present invention, in the developer, the composite inorganic fine powder preferably has a number average particle diameter of 30 nm or more to less than 1,000 nm.

According to another aspect of the present invention, there is provided an image forming method including at least the steps of: charging an image bearing member; forming an electrostatic latent image on the image bearing member by exposure; developing the electrostatic latent image on the image bearing member with a developer to form a developer image; transferring the developer image onto a transfer material through or without through an intermediate transfer member; and fixing the transferred developer image to the transfer material, in which the above-mentioned developer is used as the developer.

EFFECT OF THE INVENTION

According to the present invention, a high-resolution, high-definition image in which, for example, an image defect such as a stripe-like density reduction and fogging are sufficiently suppressed can be stably obtained over a long time period irrespective of an environment.

DESCRIPTION OF REFERENCE NUMERALS

Figure 1:
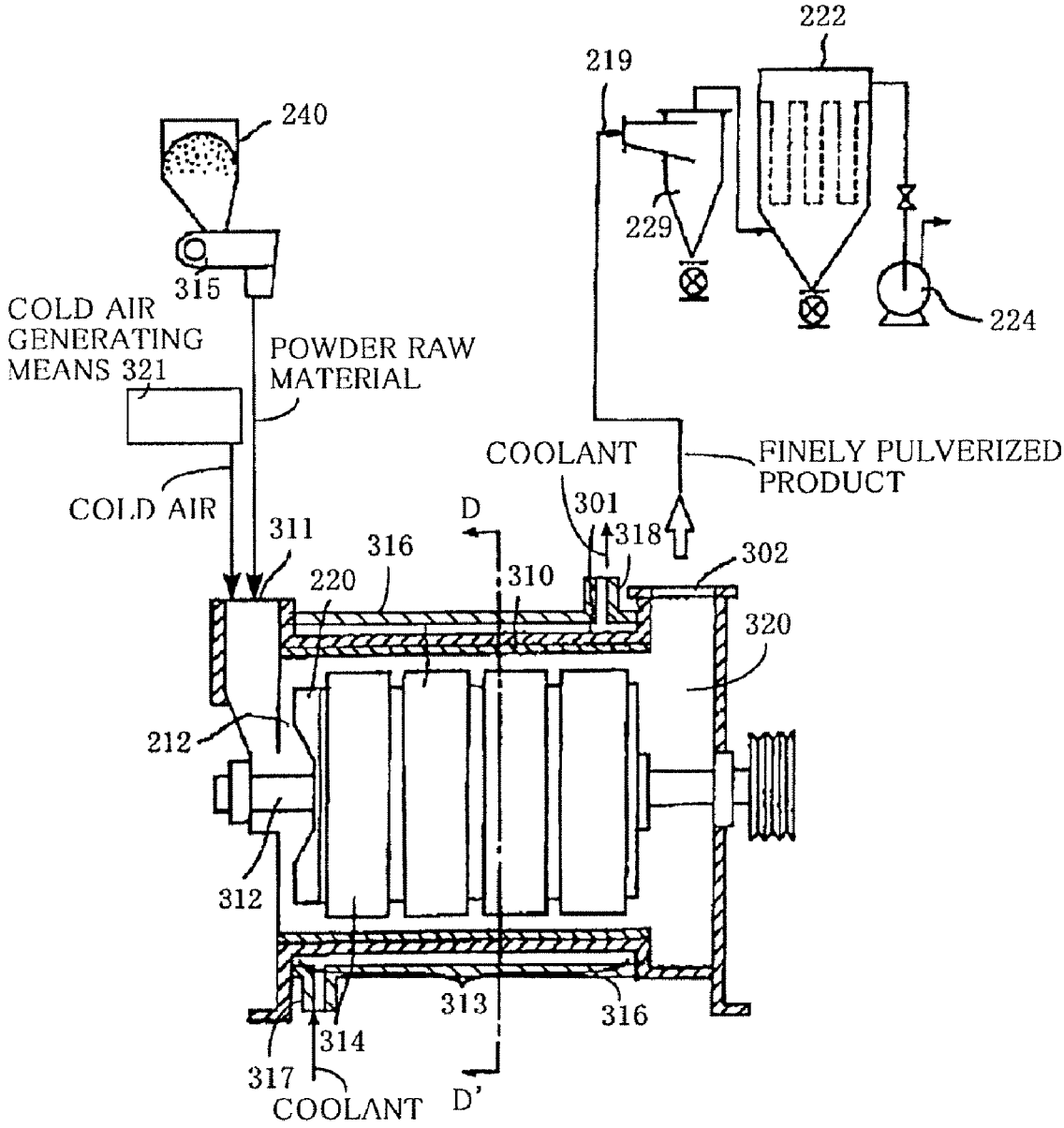
FIG. 1 is an outline sectional view of an example of a mechanical pulverizer to be used in a toner pulverizing step of the present invention.

161: acceleration tube inlet
162: acceleration tube
163: acceleration tube outlet
164: impact member
165: powder inlet
166: impact surface
167: powder discharge port
168: pulverization chamber
212: vortex chamber
219: pipe
220: distributor
222: bug filter
224: suction filter
229: collection cyclone
240: hopper
301: mechanical pulverizer
302: raw material discharge port
310: stator
311: raw material input port
312: central rotation axis
313: casing
314: rotator
315: first constant amount supplier
316: jacket
317: coolant supply port
318: coolant discharge port
320: rear chamber
321: cold air generating means
601: test chart
601*a*: solid black image portion
601*b*: solid white image portion
1: abrasive sheet
2-1, 2-2, 2-3, 2-4: guide roller
3: back-up roller
4: image bearing member
5: winding means
6: base material
7, 7-1, 7-2: binder resin
8: abrasive grain
α: axis

BEST MODE FOR CARRYING OUT THE INVENTION

A developer of the present invention has at least: toner particles each containing at least a binder resin; and a composite inorganic fine powder.

The binder resin of each of the toner particles in the developer is preferably a binder resin containing a polyester resin, a vinyl copolymer resin, an epoxy resin, or a hybrid resin having a vinyl polymer unit and a polyester unit.

In the case of using the polyester resin as the binder resin, an alcohol and a carboxylic acid, a carboxylic anhydride, and a carboxylate ester are used as raw material monomers.

Specific examples of a dihydric alcohol component include: bisphenol A alkylene oxide adducts such as polyoxypropylene(2.2)-2,2-bis(4-hydroxyphenyl)propane, polyoxypropylene(3.3)-2,2-bis(4-hydroxyphenyl)propane, polyoxyethylene(2.0)-2,2-bis(4-hydroxyphenyl)propane, polyoxypropylene(2.0)-polyoxyethylene(2.0)-2,2-bis(4-hydroxyphenyl)propane, and polyoxypropylene(6)-2,2-bis(4-hydroxyphenyl)propane; ethylene glycol; diethylene glycol; triethylene glycol; 1,2-propylene glycol; 1,3-propylene glycol; 1,4-butanediol; neopentyl glycol; 1,4-butenediol; 1,5-pentanediol; 1,6-hexanediol; 1,4-cyclohexanedimethanol; dipropylene glycol; polyethylene glycol; polypropylene glycol; polytetramethylene glycol; bisphenol A; and hydrogenated bisphenol A.

Examples of a trihydric or higher alcohol component include sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, trimethylolpropane, and 1,3,5-trihydroxymethylbenzene.

Examples of a carboxylic acid component include: aromatic dicarboxylic acids such as phthalic acid, isophthalic acid, and terephthalic acid, or anhydrides thereof; alkyldicarboxylic acids such as succinic acid, dodecenylsuccinic acid, adipic acid, sebacic acid, and azelaic acid, or anhydrides thereof; succinic acid substituted by an alkyl group having 6 to 12 carbon atoms, or anhydrides thereof; and unsaturated dicarboxylic acids such as fumaric acid, maleic acid, and citraconic acid, or anhydrides thereof.

Examples of a trivalent or higher carboxylic acid component for forming a polyester resin with a crosslinking site include 1,2,4-benzenetricarboxylic acid, 1,2,5-benzenetricarboxylic acid, 1,2,4-naphthalenetricarboxylic acid, 2,5,7-naphthalenetricarboxylic acid, 1,2,4,5-benzenetetracarboxylic acid, and anhydrides and ester compounds thereof. The amount of the trivalent or higher carboxylic acid component to be used is preferably 0.1 to 1.9 mol % on the basis of a total of monomers.

It is particularly preferable that, of those, a bisphenol derivative represented by the following general formula (1) be used as a diol component, and a carboxylic acid component (such as fumaric acid, maleic acid, maleic anhydride, phthalic acid, terephthalic acid, trimellitic acid, or pyromellitic acid) composed of a divalent or higher carboxylic acid, an anhydride thereof, or a lower alkylester thereof be used as an acid component because a polyester resin obtained by polycondensation of those components has excellent charging property.

[Chem 1]

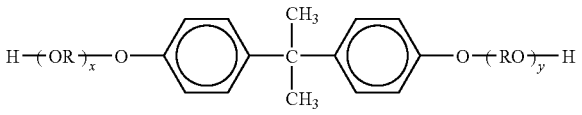

(In the formula, R represents an ethylene or propylene group, x and y each represents an integer of one or more, and x+y has an average value of 2 to 10.)

Further, when vinyl-based polymer resin is used as a binder resin, examples of the vinyl-based monomer for forming the vinyl-based polymer resin include: styrene; styrene derivatives such as o-methylstyrene, m-methylstyrene, p-methylstyrene, α-methylstyrene, p-phenylstyrene, p-ethylstyrene, 2,4-dimethylstyrene, p-n-butylstyrene, p-tert-butylstyrene, p-n-hexylstyrene, p-n-octylstyrene, p-n-nonylstyrene, p-n-decylstyrene, p-n-dodecylstyrene, p-methoxystyrene, p-chlorostyrene, 3,4-dichlorostyrene, m-nitrostyrene, o-nitrostyrene, and p-nitrostyrene; unsaturated monoolefins such as ethylene, propylene, butylene, and isobutylene; unsaturated polyenes such as butadiene and isoprene; vinyl halides such as vinyl chloride, vinylidene chloride, vinyl bromide, and vinyl fluoride; vinyl esters such as vinyl acetate, vinyl propionate, and vinyl benzoate; methacrylates such as methyl methacrylate, ethyl methacrylate, propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate, and diethylaminoethyl methacrylate; acrylates such as methyl acrylate, ethyl acrylate, propyl acrylate, n-butyl acrylate, isobutyl acrylate, n-octyl acrylate, dodecyl acrylate, 2-ethylhexyl acrylate, stearyl acrylate, 2-chloroethyl acrylate, and phenyl acrylate; vinyl ethers such as vinyl methyl ether, vinyl ethyl ether, and vinyl isobutyl ether; vinyl ketones such as vinyl methyl ketone, vinyl hexyl ketone, and methyl isopropenyl ketone; N-vinyl compounds such as N-vinylpyrrole, N-vinylcarbazole, N-vinylindole, and N-vinylpyrrolidone; vinylnaphthalenes; and acrylic acid or methacrylic acid derivatives such as acrylonitrile, methacrylonitrile, and acrylamide.

The examples further include monomers each having a carboxyl group such as: unsaturated dibasic acids such as maleic acid, citraconic acid, itaconic acid, alkenylsuccinic acid, fumaric acid, and mesaconic acid; unsaturated dibasic anhydrides such as maleic anhydride, citraconic anhydride, itaconic anhydride, and alkenylsuccinic anhydrides; half esters of unsaturated dibasic acids such as methyl maleate half ester, ethyl maleate half ester, butyl maleate half ester, methyl citraconate half ester, ethyl citraconate half ester, butyl citraconate half ester, methyl itaconate half ester, methyl alkenylsuccinate half ester, methyl fumarate half ester, and methyl mesaconate half ester; unsaturated dibasic esters such as dimethyl maleate and dimethyl fumarate; α,β-unsaturated acids such as acrylic acid, methacrylic acid, crotonic acid, and cinnamic acid; α,β-unsaturated acid anhydrides such as crotonic anhydride and cinnamic anhydride; anhydrides of the α,β-unsaturated acids with lower fatty acids; and alkenylmalonic acid, alkenylglutaric acid, alkenyladipic acid, acid anhydrides thereof, and monoesters thereof.

The examples still further include monomers each having a hydroxy group such as: acrylates or methacrylates such as 2-hydroxyethyl acrylate, 2-hydroxyethyl methacrylate, and 2-hydroxypropyl methacrylate; and 4-(1-hydroxy-1-methylbutyl)styrene and 4-(1-hydroxy-1-methylhexyl)styrene.

In addition, the vinyl copolymer resin may be crosslinked with a crosslinking agent having 2 or more vinyl groups to have a crosslinking structure. Examples of a crosslinking agent used in this case include: aromatic divinyl compounds such as divinylbenzene and divinylnaphthalene; diacrylate compounds linked with an alkyl chain such as ethylene glycol diacrylate, 1,3-butylene glycol diacrylate, 1,4-butanediol diacrylate, 1,5-pentanediol diacrylate, 1,6-hexanediol diacrylate, and neopentyl glycol diacrylate, and the above compounds whose acrylate moiety has been replaced with methacrylate; diacrylate compounds linked with an alkyl chain containing an ether linkage such as diethylene glycol diacrylate, triethylene glycol diacrylate, tetraethylene glycol diacrylate, polyethylene glycol #400 diacrylate, polyethylene glycol #600 diacrylate, and dipropylene glycol diacrylate, and the above compounds whose acrylate moiety has been replaced with methacrylate; and diacrylate compounds linked with a chain containing an aromatic group and an ether linkage such as polyoxyethylene(2)-2,2-bis(4-hydroxyphenyl) propane diacrylate and polyoxyethylene(4)-2,2-bis(4-hydroxyphenyl)propane diacrylate, and the above compounds whose acrylate moiety has been replaced with methacrylate.

Examples of a polyfunctional crosslinking agent include: pentaerythritol triacrylate, trimethylolethane triacrylate, trimethylolpropane triacrylate, tetramethylolmethane tetraacrylate, and oligoester acrylate, and the above compounds whose acrylate moiety has been replaced with methacrylate; triallylcyanurate; and triallyltrimellitate.

Examples of a polymerization initiator to be used in producing the vinyl copolymer resin include: ketone peroxides such as 2,2'-azobisisobutyronitrile, 2,2'-azobis(4-methoxy-2,4-dimethylvaleronitrile), 2,2'-azobis(2,4-dimethylvaleronitrile), 2,2'-azobis(2-methylbutyronitrile), dimethyl-2,2'-azobisisobutyrate, 1,1'-azobis(1-cyclohexanecarbonitrile), 2-(carbamoylazo)-isobutyronitrile, 2,2'-azobis(2,4,4-trimethylpentane), 2-phenylazo-2,4-dimethyl-4-methoxyvaleronitrile, 2,2'-azobis(2-methyl-propane), methyl ethyl ketone peroxide, acetylacetone peroxide, and cyclohexanone peroxide; 2,2-bis(t-butylperoxy)butane; t-butyl hydroperoxide; cumene hydroperoxide; 1,1,3,3-tetramethylbutyl hydroperoxide; di-t-butyl peroxide; t-butylcumyl peroxide; dicumyl peroxide; α,α'-bis(t-butylperoxyisopropyl)benzene; isobutyl peroxide; octanoyl peroxide; decanoyl peroxide; lauroyl peroxide; 3,5,5-trimethylhexanoyl peroxide; benzoyl peroxide; m-trioyl peroxide; di-isopropyl peroxydicarbonate; di-2-ethylhexyl peroxydicarbonate; di-n-propyl peroxydicarbonate; di-2-ethoxyethyl peroxycarbonate; di-methoxyisopropyl peroxydicarbonate; di(3-methyl-3-methoxybutyl)peroxycarbonate; acetylcyclohexylsulfonyl peroxide; t-butyl peroxyacetate; t-butyl peroxyisobutyrate; t-butyl peroxyneodecanoate; t-butyl peroxy-2-ethylhexanoate; t-butyl peroxylaurate; t-butyl peroxybenzoate; t-butyl peroxyisopropylcarbonate; di-t-butyl peroxyisophthalate; t-butyl peroxyallylcarbonate; t-amylperoxy-2-ethylhexanoate; di-t-butyl peroxyhexahydroterephthalate, and di-t-butyl peroxyazelate.

Further, when a hybrid resin having a polyester unit and a vinyl polymer unit is used as the binder resin, additionally good durability can be expected. The term "hybrid resin component" as used in the present invention refers to a resin component in which a vinyl polymer unit and a polyester unit are chemically bonded to each other. To be specific, the hybrid resin component is one formed by an ester exchange reaction between a polyester unit and a vinyl polymer unit obtained by polymerizing a monomer having a carboxylate ester group such as a (meth)acrylate, and is preferably a graft copolymer (or block copolymer) using a vinyl-based polymer as a stem polymer and a polyester unit as a branch polymer.

It should be noted that the term "polyester unit" as used in the present invention refers to a moiety derived from polyester, and "vinyl copolymer unit" refers to a moiety derived from vinyl copolymer. Polyester-based monomers of which a polyester unit is constituted are a polyvalent carboxylic acid component and a polyhydric alcohol component while monomers constituting the vinyl copolymer unit is a monomer component having the vinyl group described above.

When a hybrid resin is used as the binder resin, at least one of a vinyl polymer component and a polyester resin component preferably contains a monomer component capable of reacting with both the resin components. Examples of a monomer capable of reacting with the vinyl polymer component among the monomers each constituting the polyester resin component include unsaturated dicarboxylic acids such as phthalic acid, maleic acid, citraconic acid, and itaconic acid, and anhydrides of the acids. Examples of a monomer capable of reacting with the polyester resin component among the monomers each constituting the vinyl-based polymer component include vinyl monomers each having a carboxyl group or a hydroxyl group, and acrylates or methacrylates.

A method of obtaining a product as a result of a reaction between a vinyl polymer and a polyester resin, that is, a hybrid resin is preferably a method involving subjecting one or both of the above-mentioned vinyl polymer and polyester resin to a polymerization reaction in the presence of a polymer containing a monomer component capable of reacting with each of the resins to obtain the hybrid resin.

Examples of a method of producing the hybrid resin to be incorporated into each of the toner particles in the developer of the present invention include the following production methods (1) to (5):

(1) a method involving producing a vinyl polymer and a polyester resin separately, dissolving and swelling them in a small amount of an organic solvent, adding an esterification catalyst and an alcohol to the resultant, and heating the resultant to perform such an ester exchange reaction that a hybrid resin is obtained;

(2) a method involving producing a vinyl polymer and polymerizing a monomer for producing polyester in the presence of the polymer to provide a hybrid resin having a vinyl polymer unit and a polyester unit;

(3) a method involving producing a polyester resin and polymerizing a vinyl monomer in the presence of the resin to provide a hybrid resin having a polyester unit and a vinyl polymer unit;

(4) a method involving producing each of a vinyl polymer resin and a polyester resin, adding a vinyl monomer and/or a polyester monomer (such as an alcohol or carboxylic acid) in the presence of these polymer units, and subjecting the mixture to a reaction to provide a hybrid resin having a vinyl polymer unit and a polyester unit; and (5) a method involving mixing a vinyl monomer and a polyester monomer (such as an alcohol or carboxylic acid) and subjecting the mixture to addition polymerization and condensation polymerization reactions continuously to provide a hybrid resin having a vinyl polymer unit and a polyester unit.

In each of the above production methods (1) to (5), a hybrid resin may be produced by using multiple vinyl polymer units and polyester units different from each other in molecular weight or degree of crosslinking.

In addition, after the production of a hybrid resin component, at least one of addition polymerization and condensation polymerization reactions may be additionally performed by adding a vinyl monomer and/or a polyester monomer (such as an alcohol or carboxylic acid).

The glass transition temperature of the binder resin is preferably 40 to 90° C., more preferably 45 to 85° C., or particularly preferably 53 to 62° C. The acid value of the binder resin is preferably 1 to 40 mgKOH/g.

In addition, the binder resin preferably has a main peak molecular weight Mp based on GPC of tetrahydrofuran (THF) soluble matter of 5,000 to 20,000, a weight average molecular weight Mw of 5,000 to 300,000, and a ratio Mw/Mn of the weight average molecular weight Mw to a number average molecular weight Mn of 5 to 50. When the molecular weight distribution of the binder resin is in the above range, compatibility between hot offset property and low-temperature fixability can be favorably achieved.

In addition, the binder resin preferably contains 15 to 50 mass % of THF insoluble matter originating from a binder resin component upon extraction for 16 hours, or more preferably contains 15 to 45 mass % of the THF insoluble matter. The presence of the THF insoluble matter in the above range provides good offset resistance.

The molecular weight distribution of the THF soluble matter of the binder resin, the THF insoluble matter amount of the resin, and the glass transition temperature of the resin can be determined by the following measurement methods.

(1) Measurement of Molecular Weight Distribution of THF Soluble Matter by GPC

A column is stabilized in a heat chamber at 40° C. THF as a solvent is allowed to flow into the column at the temperature at a flow rate of 1 ml/min, and about 100 μl of a THF sample solution are injected for measurement. In measuring the molecular weight of the sample, the molecular weight distribution possessed by the sample was calculated from a relationship between a logarithmic value of an analytical curve prepared by several kinds of monodisperse polystyrene standard samples and the number of counts. Examples of standard polystyrene samples for preparing an analytical curve that can be used include samples manufactured by TOSOH CORPORATION or by Showa Denko K.K. each having a molecular weight of about $10^2$ to $10^7$. At least about ten standard polystyrene samples are suitably used. In addition, an RI (refractive index) detector is used as a detector. It is recommended that a combination of multiple commercially available polystyrene gel columns be used as the column. Examples of the combination include: a combination of shodex GPC KF-801, 802, 803, 804, 805, 806, 807, and 800P manufactured by Showa Denko K.K.; and a combination of TSK gel G1000H ($H_{XL}$), G2000H ($H_{XL}$), G3000H ($H_{XL}$), G4000H ($H_{XL}$), G5000H ($H_{XL}$), G6000H ($H_{XL}$), G7000H ($H_{XL}$), and TSK guard column manufactured by TOSOH CORPORATION.

In addition, the sample is produced as described below.

A sample is placed in THF, and the whole is left at 25° C. for several hours. After that, the resultant is sufficiently shaken, and the sample is mixed with THF well (until the coalesced body of the sample disappears). Then, the resultant is left standing for an additional 12 hours or longer. In this case, the time period for which the sample is left in THF is set to 24 hours. After that, the resultant is passed through a sample treatment filter (having a pore size of 0.2 to 0.5 μm, for example, a Myshori Disc H-25-2 (manufactured by TOSOH CORPORATION) can be used), and is regarded as a sample for GPC. In addition, a sample concentration is adjusted so that the concentration of a resin component is 0.5 to 5 mg/ml.

(2) Measurement of THF Insoluble Matter Amount 0.5 to 1.0 g of a sample is weighed ($W_1$ g). The weighed sample is placed in extraction thimble (such as No. 86R manufactured by ADVANTEC), and is subjected to a Soxhlet extractor so that the sample is extracted by using 100 to 200 ml of THF as a solvent for 6 hours. After THF has been evaporated from a solution containing a soluble component extracted with THF, the remainder is dried in a vacuum at 100° C. for several hours, and the amount of a THF soluble resin component is weighed ($W_2$ g). A THF insoluble matter amount is determined from the following equation:

$$THF \text{ insoluble matter (mass \%)} = \{(W_1 - W_2)/W_1\} \times 100.$$

(3) Measurement of Glass Transition Temperature of Each of Binder Resin and Toner Measurement is performed in accordance with ASTM D3418-82 by using a differential scanning calorimeter (DSC) MDSC-2920 (manufactured by TA Instruments) as a measuring device. 2 to 10 mg, preferably 3 mg, of a measurement sample are precisely weighed. The sample is placed in an aluminum pan, and measurement is performed in the measurement temperature range of 30 to 200° C. under normal temperature and normal humidity by using an empty aluminum pan as a reference. Analysis is performed by using a DSC curve obtained as a result of a temperature increase at a rate of temperature increase of 10° C./min after the acquisition of pre-hysteresis by one temperature increase and one temperature decrease.

A release agent can be added to each of the toner particles in the developer as required.

Examples of the release agent which may be used in the present invention include the following. Aliphatic hydrocarbon-based waxes such as low-molecular weight polyethylene, low-molecular weight polypropylene, a microcrystalline wax, and a paraffin wax; oxides of aliphatic hydrocarbon-based waxes such as polyethylene oxide wax; block copolymers of aliphatic hydrocarbon-based waxes and oxides thereof; waxes mainly composed of fatty acid esters such as a carnauba wax, a sasol wax, and a montanic acid ester wax; and partially or wholly deacidified fatty acid esters such as a deacidified carnauba wax. The examples further include: linear saturated fatty acids such as palmitic acid, stearic acid, and montan acid; unsaturated fatty acids such as brassidic acid, eleostearic acid, and barinarin acid; saturated alcohols such as stearyl alcohol, aralkyl alcohol, behenyl alcohol, carnaubyl alcohol, ceryl alcohol, and melissyl alcohol; long-chain alkyl alcohols; polyalcohols such as sorbitol; fatty amides such as linoleic amide, oleic amide, and lauric amide; saturated fatty bis amides such as methylene bis stearamide, ethylene bis capramide, ethylene bis lauramide, and hexamethylene bis stearamide; unsaturated fatty amides such as ethylene bis oleamide, hexamethylene bis oleamide, N,N'-dioleyl adipamide, and N,N'-dioleyl sebacamide; aromatic bis amides such as m-xylene bis stearamide and N—N'-distearyl isophthalamide; fatty acid metallic salts (generally called metallic soaps) such as calcium stearate, calcium laurate, zinc stearate, and magnesium stearate; graft waxes in which aliphatic hydrocarbon waxes are grafted with vinyl monomers such as styrene and acrylic acid; partially esterified compounds of fatty acids and polyalcohols such as behenic monoglyceride; and methyl ester compounds having hydroxyl groups obtained by hydrogenation of vegetable oil. Any one of those release agents may be used alone, or two or more of the release agents may be used together in the toner particles.

The addition amount of the release agent is preferably 0.1 to 20 parts by mass, or more preferably 0.5 to 10 parts by mass with respect to 100 parts by mass of the binder resin.

In addition, each of those release agents can be typically incorporated into each toner particle by a method involving dissolving a resin in a solvent, increasing the temperature of the resin solution, and adding and mixing the release agent to and with the solution while stirring the solution, or a method involving mixing the release agent at the time of kneading.

A charge control agent can be used in the developer for additionally stabilizing the chargeability of the developer as required. Examples of the charge control agent include the following.

For example, an organometallic complex or a chelate compound is an effective charge control agent for controlling toner to be negatively chargeable. Examples of such charge control agent include: monoazo metal complexes; and metal complexes of aromatic hydroxycarboxylic acids or aromatic dicarboxylic acids. The examples further include: aromatic hydroxycarboxylic acids; aromatic monocarboxylic and polycarboxylic acids, and metal salts and anhydrates of the acids; esters; and phenol derivatives such as bisphenol.

Examples of a charge control agent for controlling toner to be positively chargeable include: nigrosin and denatured products of nigrosin with aliphatic metal salts, and the like; quaternary ammonium salts such as tributylbenzyl ammonium-1-hydroxy-4-naphtosulfonate and tetrabutyl ammonium tetrafluoroborate, and analogs of the salts, which are onium salts such as phosphonium salts and chelate pigments of the salts; triphenyl methane dyes and lake pigments of the dyes (lake agents include phosphotungstic acid, phosphomolybdic acid, phosphotungsten molybdic acid, tannic acid, lauric acid, gallic acid, ferricyanic acid, and ferrocyanide); metal salts of higher aliphatic acids; diorganotin oxides such as dibutyltin oxide, dioctyltin oxide, and dicyclohexyltin oxide; and diorganotin borates such as dibutyltin borate, dioctyltin borate, and dicyclohexyltin borate.

The content of the charge control agent is preferably 0.5 to 10 parts by mass with respect to 100 parts by mass of the binder resin. The use of the charge control agent in the range provides good charging property irrespective of an environment, and hardly causes a problem in terms of compatibility between the agent and any other material.

A magnetic material can be added to each of the toner particles in the developer as required. A magnetic oxide such as magnetite, maghemite, or ferrite, or the mixture of the magnetic oxides is preferably used as the magnetic material.

The magnetic material is, for example, magnetic iron oxide containing at least one element selected from the group consisting of, for example, lithium, beryllium, boron, magnesium, aluminum, silicon, phosphorus, sulfur, germanium, titanium, zirconium, tin, lead, zinc, calcium, barium, vanadium, chromium, manganese, cobalt, copper, nickel, gallium, indium, silver, palladium, gold, platinum, tungsten, molybdenum, niobium, osmium, strontium, yttrium, technetium, ruthenium, rhodium, and bismuth. Of those, lithium, beryllium, boron, magnesium, aluminum, silicon, phosphorus, germanium, titanium, zirconium, tin, sulfur, calcium, barium, vanadium, chromium, manganese, cobalt, copper, nickel, strontium, bismuth, and zinc are preferable. Magnetic iron oxide containing an element selected from magnesium, aluminum, silicon, phosphorus, and zirconium as a dissimilar element is particularly preferable. Each of those elements may be captured in an iron oxide crystal lattice, may be captured as an oxide in iron oxide, or may be present as an oxide or a hydroxide on the surface of iron oxide; each of those elements is preferably incorporated as an oxide into iron oxide.

Each of those magnetic materials has a number average particle diameter of preferably 0.05 to 1.0 μm, or more preferably 0.1 to 0.5 μm. The magnetic material has a BET specific surface area based on nitrogen adsorption of preferably 2 to 40 $m^2/g$, or more preferably 4 to 20 $m^2/g$. The preferable magnetic properties of the magnetic material are as follows: an intensity of magnetization, a remanent magnetization, and a coercive force measured in a magnetic field of 795.8 kA/m are preferably 10 to 200 $Am^2/kg$, 1 to 100 $Am^2/kg$, and 1 to 30 kA/m, respectively, or are more preferably 70 to 100 $Am^2/kg$, 2 to 20 $Am^2/kg$, and 2 to 15 kA/m, respectively. The content of the magnetic material is preferably 20 to 200 parts by mass with respect to 100 parts by mass of the binder resin.

A colorant is added to each of the toner particles in the developer as required. An arbitrary appropriate pigment or dye can be used as the colorant.

Examples of the pigment include carbon black, aniline black, acetylene black, naphthol yellow, hansa yellow, rhodamine yellow, alizarin yellow, blood red, and phthalocyanine blue. The addition amount of the pigment is preferably 0.1 to 20 parts by mass, or more preferably 0.2 to 10 parts by mass with respect to 100 parts by mass of the binder resin.

In addition, examples of the dye include an azo dye, an anthraquinone dye, a xanthene dye, and a methine dye. The addition amount of the dye is preferably 0.1 to 20 parts by mass, or more preferably 0.3 to 10 parts by mass with respect to 100 parts by mass of the binder resin.

As described above, the developer contains a composite inorganic fine powder.

The composite inorganic fine powder has a peak at a Bragg angle (2θ±0.20 deg) of each of 32.20 deg, 25.80 deg, and 27.50 deg in a CuKα characteristic X-ray diffraction pattern. The peak at 32.20 deg originates from the (1, 1, 0) surface of a strontium titanate crystal, the peak at 25.80 deg originates from strontium carbonate, and the peak at 27.50 deg originates from titanium oxide. That is, the composite inorganic fine powder is a composite of strontium titanate, strontium carbonate, and titanium oxide. It should be noted that the term "composite" as used in the present invention means not that those materials are merely mixed but that those materials are integrally formed into a particle by a method such as sintering.

A variation in charging between the toner particles is alleviated and uniformized by the three components different from one another in charging ability. In addition, strontium titanate does not show any structural change even in an environment where a strong mechanical stress is applied such as a portion where a developing roller and a blade are close to each other in a developing step because strontium titanate has a stable crystalline structure. As a result, strontium titanate can maintain the following effect over a long time period: uniform charge is applied to a developer owing to charging alleviation.

In addition, the composite inorganic fine powder is characterized in that the half width of the X-ray diffraction peak at a Bragg angle (2θ±0.20 deg) of 32.20 deg in the CuKα characteristic X-ray diffraction pattern is 0.20 to 0.30 deg. The incorporation of such composite inorganic fine powder uniformizes the charging of the surface of the developer, and alleviates the electrostatic agglomeration of the developer.

The fact that the peak half width is less than 0.30 deg means that the number of lattice defects and the like is small, and the crystallinity of strontium titanate is high. When the peak half width exceeds 0.30 deg, the water resistance of strontium titanate weakens owing to a crystal lattice defect of strontium titanate, hydration due to moisture absorption is apt to occur, and a reduction in charge of the developer is apt to be caused. In addition, strontium titanate cannot maintain a stable structure, so it becomes vulnerable to a mechanical stress, and cannot maintain a stable effect in long-term use. In addition, when the peak half width is less than 0.20 deg, the particle diameter of the strontium titanate crystal increases, and hence strontium titanate cannot be sufficiently dispersed in the developer. As a result, the charging of the developer becomes uneven, and, for example, a reduction in image density or fogging occurs.

In addition, the intensity level (Ia) of the peak at a Bragg angle (2θ±0.20 deg) of 32.20 deg in the CuKα characteristic X-ray diffraction pattern of the composite inorganic fine powder, the intensity level (Ib) of the peak at a Bragg angle of 25.80 deg in the pattern, and the intensity level (Ic) of the peak at a Bragg angle of 27.50 deg in the pattern preferably satisfy the following formulae:

$$0.010<(Ib)/(Ia)<0.150$$

$$0.010<(Ic)/(Ia)<0.150.$$

When the ratio (Ib)/(Ia) is 0.150 or more, that is, a ratio of the peak intensity of strontium carbonate to the peak intensity of strontium titanate is 0.150 or more, the particle hardness of the composite inorganic fine powder reduces, and a sweeping effect on the developer adhering to a developing roller or to a blade reduces under a high-temperature environment. As a result, the developer causes a charging failure, so adverse effects are apt to be exerted on, for example, image quality, an image density, and the suppression of fogging.

In addition, when the ratio (Ib)/(Ia) is 0.010 or less, that is, a ratio of the peak intensity of strontium carbonate to the peak intensity of strontium titanate is 0.010 or less, an alleviating effect on the charging of a toner particle reduces, so the electrostatic agglomeration of toner particles occurs. In addition, image unevenness or the like is apt to occur owing to the insufficient conveyance of the developer.

When the ratio (Ic)/(Ia) is 0.150 or more, that is, a ratio of the peak intensity of titanium oxide to the peak intensity of strontium titanate is 0.150 or more, the charge amount of the developer is insufficient under a high-humidity environment, so a reduction in image density, a fogging phenomenon, or the like is apt to occur. In addition, when the ratio (Ic)/(Ia) is 0.010 or less, that is, a ratio of the peak intensity of titanium oxide to the peak intensity of strontium titanate is 0.010 or less, an alleviating effect on charging similarly reduces, and the electrostatic agglomeration of the developer occurs, so a reduction in image quality or image unevenness is apt to occur.

X-ray diffraction measurement is performed by the following method.

[Preparation of External Additive Sample]

1) 3 g of a developer are charged into a 500-ml beaker, and 200 ml of tetrahydroxyfuran (THF) are added to 3 g of the developer.
2) The solution obtained in the section (1) is irradiated with an ultrasonic wave for 3 minutes so that the developer is dispersed and an external additive (composite inorganic fine powder) is liberated.
3) A THF supernatant solution containing the liberated external additive obtained in the section (2) is separated by decantation, and the resultant is defined as a sample solution.
4) 200 ml of THF are added to the toner particles remaining after the operation of the section (3) again, and the whole is repeatedly subjected to the operations of the sections (2) and (3) (about three times).
5) The operations of the sections (1) to (4) are repeated until a required amount of the sample solution is obtained.
6) The resultant sample solution (THF supernatant solution containing the liberated external additive) is filtrated in a vacuum by using a 2-μm membrane filter, and the solid content is collected, whereby an external additive sample is obtained.

The resultant external additive sample is subjected to X-ray diffraction measurement by using a CuKα ray. The X-ray diffraction measurement is performed by using, for example, a sample horizontal strong X-ray diffracting device (RINT TTRII) manufactured by Rigaku Corporation under the following conditions:

[Measurement Conditions for X-Ray Diffraction]

| | |
|---|---|
| Vessel: | Cu |
| Parallel beam optical system | |
| Voltage: | 50 kV |
| Current: | 300 mA |
| Starting angle: | 30° |
| Ending angle: | 50° |
| Sampling width: | 0.02° |
| Scan speed: | 4.00°/min |
| Divergence slit: | Open |
| Divergence longitudinal slit: | 10 mm |
| Scattering slit: | Open |
| Light receiving slit: | 1.0 mm |

Figure 14:
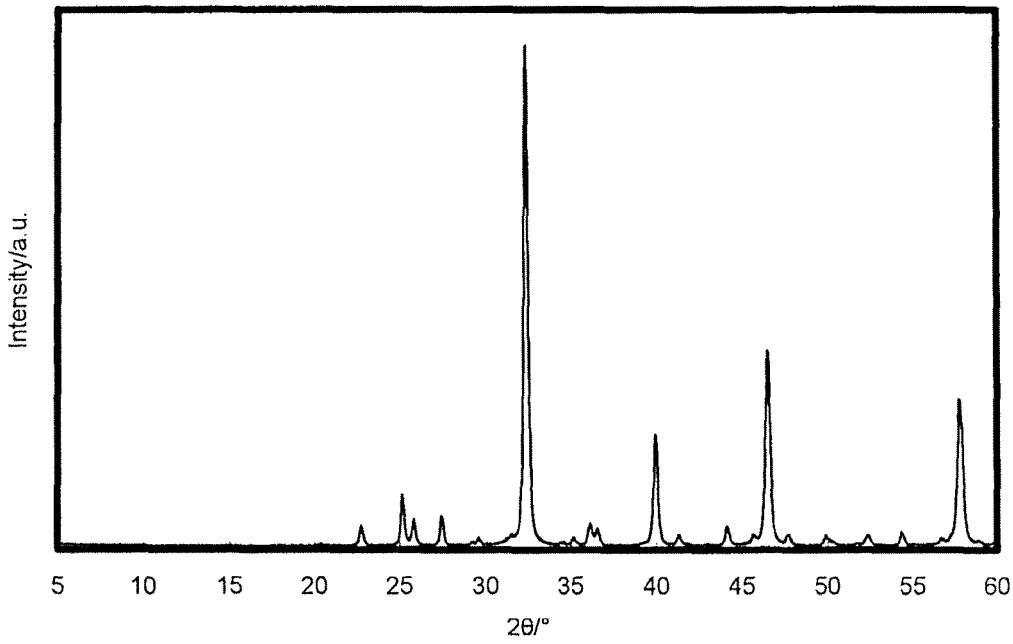
FIG. 14 is an example of a chart showing the results of measurement of the X-ray analysis of a composite inorganic fine powder.

The attribution and half width of an obtained X-ray diffraction peak are calculated by using an analytical software "Jade6" manufactured by Rigaku Corporation. In addition, similarly, peak intensity is calculated from a peak area by peak separation using the software. FIG. 14 shows an example of a chart showing the results of measurement of the X-ray diffraction of the composite inorganic fine powder.

The composite inorganic fine powder has a number average particle diameter of preferably 30 nm or more to less than 1,000 nm, more preferably 70 nm or nm or more to less than 220 nm. When the number average particle diameter of the composite inorganic fine powder is less than 30 nm, the specific surface area of the composite inorganic fine powder increases, and the hygroscopic property of the powder deteriorates, with the result that a reduction in charge of the developer is apt to occur. In addition, the disturbance of an image is caused by the adhesion of the powder to a main body member, and, furthermore, the powder is apt to be responsible for the shortening of the lifetime of the main body member. When the number average particle diameter is 1,000 nm or more, an alleviating effect on the charging of a toner particle reduces, and the electrostatic agglomeration of toner particles occurs, so image unevenness or a reduction in image quality is apt to occur.

The number average particle diameter of the composite inorganic fine powder was determined as follows: the particle diameters of 100 particles in a picture photographed at a magnification of 50,000 with an electron microscope were measured, and the average of the particle diameters was defined as the number average particle diameter. The diameter of a spherical particle was defined as the particle diameter of the particle. The average value for the shorter and longer diameters of an elliptical particle was defined as the particle diameter of the particle. The average value for such particle diameters was determined and defined as the number average particle diameter.

The addition amount of the composite inorganic fine powder is preferably 0.01 to 5.0 parts by mass, or more preferably 0.05 to 3.0 parts by mass with respect to 100 parts by mass of the toner particles. The addition of the composite inorganic fine powder in the range provides a sufficient effect, so the addition can not only suppress the electrostatic agglomeration of the developer in a developing unit but also allow the developer to maintain good charging. As a result, the occurrence of problems such as a reduction in density and fogging can be suppressed.

A method of producing the composite inorganic fine powder is not particularly limited. For example, the powder is produced by the following method.

An example of a general method of producing strontium titanate particles is a method involving subjecting titanium oxide and strontium carbonate to a solid phase reaction and sintering the resultant. A known reaction to be adopted in the production method can be represented by the following formula:

$$TiO_2+SrCO_3 \rightarrow SrTiO_3+CO_2.$$

That is, the strontium titanate particles are produced by washing, drying, and sintering a mixture containing titanium oxide and strontium carbonate and by mechanically pulverizing and classifying the resultant. At this time, a composite inorganic fine powder containing strontium titanate, strontium carbonate, and titanium oxide can be obtained by adjusting a raw material and a sintering condition.

Strontium carbonate as a raw material in this case is not particularly limited as long as it is a substance having $SrCO_3$ composition, and any commercially available one can be used. Strontium carbonate to be used as a raw material has a number average particle diameter of preferably 30 to 300 nm, or more preferably 50 to 150 nm.

In addition, titanium oxide as a raw material in this case is not particularly limited as long as it is a substance having $TiO_2$ composition. Examples of the titanium oxide include metatitanic acid slurry obtained by a sulfuric acid method (undried, water-containing titanium oxide) and a titanium oxide powder. Metatitanic acid slurry obtained by a sulfuric acid method is preferable titanium oxide. This is because the slurry is excellent in uniform dispersibility in an aqueous wet material. Titanium oxide has a number average particle diameter of preferably 20 to 50 nm.

A molar ratio $TiO_2$:$SrCO_3$ between those essential raw materials, which is not particularly limited, is preferably 1.00:0.80 to 1.00:1.10. When the amount of $SrCO_3$ is excessive as compared to that of $TiO_2$, the composite inorganic fine powder to be obtained does not contain $TiO_2$ in some cases.

The sintering is performed at a temperature of preferably 500 to 1,300° C., or more preferably 650 to 1,100° C. When the sintering temperature is higher than 1,300° C., secondary agglomeration between particles due to the sintering is apt to occur, with the result that a load in a pulverizing step increases. In addition, in some cases, strontium carbonate and titanium oxide completely react with each other, and hence the composite inorganic fine powder to be obtained does not contain them. In such cases, an effect of the composite inorganic fine powder cannot be sufficiently exerted. In addition, when the sintering temperature is lower than 600° C., the amount of a remaining unreacted component increases, thereby making it difficult to produce stable strontium titanate particles.

In addition, a sintering time is preferably 0.5 to 16 hours, or more preferably 1 to 5 hours. When the sintering time is longer than 16 hours, as in the case of the foregoing, strontium carbonate and titanium oxide completely react with each other, and hence the composite inorganic fine powder to be obtained does not contain them in some cases. When the sintering time is shorter than 0.5 hour, as in the case of the foregoing, the amount of a remaining unreacted component increases, thereby making it difficult to produce stable strontium titanate particles.

An inorganic oxide such as silica, alumina, or titanium oxide, or an inorganic fine powder having a fine particle diameter such as carbon black or fluorocarbon may be added as an external additive except the composite inorganic fine powder to the developer. The addition of each of those additives can impart additionally good fluidity, additionally good chargeability, or the like to the developer.

The addition amount of each of those external additives except the composite inorganic fine powder is preferably 0.03 to 5 parts by mass with respect to 100 parts by mass of the toner particles. The use of any such external additive in the range can not only provide a sufficient fluidity imparting effect but also prevent the developer from excessively fastening. Further, when the addition amount is excessively large, the excessive liberation of such external additive occurs.

Further, a fluidity improver may be added to the developer. The fluidity improver improves fluidity through external addition to toner particles. Examples of such fluidity improver include: a fluorine resin powder such as a vinylidene fluoride fine powder or a polytetrafluoroethylene fine powder; fine powdered silica such as silica obtained through a wet process or silica obtained through a dry process; powdered titanium oxide; powdered alumina and treated silica obtained by treating the surface of any one of the above-mentioned silicas with a silane coupling agent, a titanium coupling agent, silicone oil, or the like.

A preferable fluidity improver is a fine powder produced through the vapor phase oxidation of a silicon halide compound, the fine powder being called dry process silica or fumed silica. For example, the production utilizes a thermal decomposition oxidation reaction in oxygen and hydrogen of a silicon tetrachloride gas, and a basic reaction formula for the reaction is represented by the following formula:

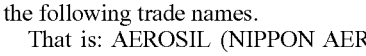

$$SiCl_4+2H_2+O_2 \rightarrow SiO_2+4HCl$$

A composite metal silica of silica and any other metal oxide can also be obtained by using a silicon halide compound with any other metal halide compound such as aluminum chloride or titanium chloride in the production step, and silica comprehends those as well.

A silica fine powder having an average primary particle size in the range of preferably 0.001 to 2 μm, more preferably 0.002 to 0.2 μm, or particularly preferably 0.005 to 0.1 μm is desirably used with regard to the particle size of the fluidity improver.

Examples of a commercially available silica fine powder produced through the vapor phase oxidation of a silicon halide compound include those commercially available under the following trade names.

That is: AEROSIL (NIPPON AEROSIL Co., Ltd.) 130, 200, 300, 380, TT600, MOX170, MOX80, COK84; Ca—O-SiL (CABOT Co.) M-5, MS-7, MS-75, HS-5, EH-5; (WACKER-CHEMIE GMBH), HDK, N20, N15, N20E, T30, T40; D-CFine Silica (DOW CORNING Co.); and Fransol (Fransil).

Hydrophobicity is imparted to the fluidity improver by chemically treating the silica fine powder with, for example, an organic silicon compound that reacts with, or physically adsorbs to, the silica fine powder. A preferable fluidity improver with hydrophobicity is obtained by treating the silica fine powder produced through the vapor phase oxidation of a silicon halide compound with an organic silicon compound.

Examples of such organic silicon compound include hexamethyldisilazane, trimethylsilane, trimethylchlorosilane, trimethylethoxysilane, dimethyldichlorosilane, methyltrichlorosilane, allyldimethylchlorosilane, allylphenyldichlorosilane, benzyldimethylchlorosilane, bromomethyldimethylchlorosilane, α-chloroethyltrichlorosilane, p-chloroethyltrichlorosilane, chloromethyldimethylchlorosilane, triorganosilylmercaptan, trimethylsilylmercaptan, triorganosilylacrylate, vinyldimethylacetoxysilane, dimethylethoxysilane, dimethyldimethoxysilane, diphenyldiethoxysilane, hexamethyldisiloxane, 1,3-divinyltetramethyldisiloxane, 1,3-diphenyltetramethyldisiloxane, and dimethylpolysiloxane which has 2 to 12 siloxane units per molecule and contains a hydroxyl group bound to Si within a unit located in each of terminals. Further, silicone oils such as dimethylsilicone oil may be used. One of those compounds is used alone or mixture of two or more thereof is used.

The fluidity improver has a specific surface area of preferably 30 $m^2/g$ or more, or more preferably 50 $m^2/g$ or more. The specific surface area is measured by a BET method based on nitrogen adsorption. The addition amount of the fluidity improver is preferably 0.01 to 8 parts by mass, or more preferably 0.1 to 4 parts by mass with respect to 100 parts by mass of the developer.

The fluidity improver has a degree of hydrophobicity of preferably 30% or more, or more preferably 50% or more in terms of methanol wettability. A silane compound and silicone oil each of which is a silicon-containing surface treatment agent are preferable hydrophobic treatment agents.

Examples of the silicon-containing surface treatment agent include: alkylalkoxysilanes such as dimethyldimethoxysilane, trimethylethoxysilane, and butyltrimethoxysilane; and silane-coupling agents such as dimethyldichlorsilane, trimethylchlorsilane, allyldimethylchlorsilane, hexamethylenedimethylchlorsilane, allylphenyldimethylchlorsilane, benzyldimethylchlorsilane, vinyltriethoxysilane, γ-methacryloxypropyltrimethoxysilane, divinylchlorsilane, and dimethylvinylchlorsilane.

A method of measuring the methanol wettability of the above fluidity improver will be described below. The methanol wettability of the inorganic fine powder added to the developer can be measured by using a powder wettability tester (WET-100P, manufactured by RHESCA COMPANY, LIMITED). 50 ml of pure water (ion-exchanged water or commercially available purified water) are charged into a 100-ml beaker. 0.2 g of an inorganic fine powder is precisely weighed, and is added to the beaker. Methanol is dropped at a rate of 3 ml/min while the mixture is stirred. A methanol concentration (%) at which a transmittance shows a value of 80% is defined as methanol wettability.

The developer contains preferably 60 to 90 number %, more preferably 65 to 85 number %, or still more preferably 70 to 80 number % of particles having an average circularity of 0.920 or more in the particles each having a coarse particle ratio of 30% or more in the particle size distribution of particles each having a circle-equivalent diameter of 3 μm or more by a flow-type particle image measuring device.

In ordinary cases, in a triboelectric charging system, when a particle in a developer becomes finer, the particle has a larger specific surface area than that of a coarse particle. As a result, the fine particle can be quickly charged with ease, so a variation in charging between a fine particle and a coarse particle is apt to occur. An ability of the composite inorganic fine powder is sufficiently exerted by controlling the shape of a coarse particle in a developer as in the case of the present invention. As a result, the charge amount of a coarse particle can be uniformized, and the degree of fluidity of the coarse particle can be improved. In addition, the amount in which the composite inorganic fine powder adheres to the surface of a fine toner particle and the amount in which the composite inorganic fine powder adheres to the surface of a coarse toner particle can be brought into balance. As a result, charging alleviation in a developer can be caused by the circulation of the developer in a developing unit, whereby the entirety of the developer can be brought into a uniformly charged state.

In addition, when the content of the particles having an average circularity of 0.920 or more in the particles each having a coarse particle ratio of 30% or more in the particle size distribution is in the above range, the packing of the developer in a developing unit can be suppressed, and the adhesion and sticking of the developer to a developer carrier can also be suppressed.

In order that the uniform charging of the developer may be highly achieved, the average circularity a of the entire particles each having a circle-equivalent diameter of 3 μm or more by a flow-type particle image measuring device and the average circularity b of particles each having a coarse particle ratio of 30% or more in the particle size distribution of the particles each having a circle-equivalent diameter of 3 μm or more preferably satisfy the following expression:

$$0.975 < b/a < 1.010.$$

A state where the ratio b/a is in the above range means that a coarse particle and a fine particle have the same shape. In this case, the fluid flow of the developer in a developing unit can be uniformized, the opportunities of coarse and fine particles for triboelectric charging can be made identical to each other, and the charging of the developer in the developing unit can be highly uniformized.

The average circularity and circle-equivalent diameter of the developer are measured under the following conditions.

The average circularity is used as a simple method with which the shape of a particle can be quantitatively represented, and the average circularity can be determined by performing measurement by using a flow-type particle image analyzer "FPIA-2100" manufactured by SYSMEX CORPORATION. In the present invention, the circularity and the like of a particle having a circle-equivalent diameter of 3 μm or more are measured. The circle-equivalent diameter is defined by the following equation (1). In addition, the circularity is defined by the following equation (2), and the average circularity is defined by the following equation (3).

In the following equation, the term "particle projected area" is defined as an area of a binarized particle image, while the term "circumferential length of a particle projected image" is defined as the length of a borderline obtained by connecting the edge points of the particle image. The measurement is performed by the device by processing the image at an image processing resolution of 512×512 (a pixel measuring 0.3 μm×0.3 μm).

(Equation 3)

$$\text{Average circularity } C = \sum_{i=1}^{m} (c_i / m) \tag{3}$$

In the above equation (3), circularity of each particle is denoted by ci and the number of measured particles is denoted by m.

The circularity in the present invention is an indication of the degree of irregularities on a toner. The circularity is 1.00 when the developer has a completely spherical shape. The more complicated the surface shape, the lower the circularity.

After measuring circularity of the particles using "FPIA-2100", the average circularity is calculated by calculating the circularities of the respective particles having 0.40 to 1.00 circularity and dividing those into 61 classes. The method of calculating the average circularity and circularity reference deviation by using the central value of each divisional point of each class and the number of the particles classified into each class is employed. An error between the average circularity obtained by the calculation method and the average circularity obtained by the above-mentioned calculation equation involving directly using the circularity of each particle is so small as to be substantially negligible. Therefore, in the present invention, such calculation method is employed because of reasons in terms of data processing such as the shortening of a calculation time and the simplification of a calculation operational expression.

Further, the measuring device "FPIA-2100" used in the present invention has a thinner sheath flow (7 μm→4 μm), an increased magnification of a processed particle image and an increased processing resolution of a captured image (256×256→512×512) as compared to a measuring device "FPIA-1000" which has been conventionally used for calculating the shape of the developer. Therefore, the measuring device "FPIA-2100" has increased accuracy of shape measurement of the developer. As a result, the measuring device "FPIA-2100" has achieved additionally accurate capture of a fine particle. Therefore, in the case where a shape must be measured additionally accurately as in the case of the present invention, the FPIA-2100 that can furnish additionally accurate information about the shape is preferably used.

A specific measurement method for FPIA-2100 is as follows. Under a normal-temperature and normal-humidity environment (23° C./50% RH), 100 to 150 ml of water from which an impurity and the like have been removed in advance are prepared in a vessel. An appropriate amount of a surfactant, preferably 0.1 to 0.5 ml of sodium dodecylbenzenesulfonate is added to the water as a dispersant and about 0.1 to 0.5 g of the measurement sample is further added thereto. The resultant mixture is irradiated with ultrasonic waves (50 kHz, at 120 W) for 2 minutes by using an ultrasonic dispersing unit "Tetora 150" (manufactured by Nikkaki-Bios Co., Ltd.) as dispersion means to prepare a dispersion for measurement. At that time, the dispersion is appropriately cooled in order that the temperature of the dispersion does not become 40° C. or higher.

A sample dispersion liquid having a dispersion liquid concentration of 12,000 to 20,000 particles/μl is prepared, and the circularity distribution of particles each having a circle-equivalent diameter of 0.60 μm or more and less than 159.21 μm is measured by using the above flow-type particle image analyzer.

The outline of measurement involving the use of the above flow-type particle image analyzer is as described below.

The sample dispersion liquid is passed through the flow path of a flat, plane flow cell (expanding along a flow direction). In order that an optical path passing across the thickness of the flow cell may be formed, a stroboscope and a CCD camera are mounted so as to be opposite to each other with respect to the flow cell. While the sample dispersion liquid flows, stroboscopic light is applied at an interval of 1/30 second in order that the image of a particle flowing in the flow cell may be obtained. As a result, each particle is photographed as a two-dimensional image having a certain range parallel to the flow cell. The diameter of a circle having the same area as that of the two-dimensional image of each particle is calculated as a circle-equivalent diameter. The circularity of each particle is calculated from the projected area of the two-dimensional image of the particle and the circumferential length of the projected image by using the above circularity calculation equation.

Before data acquired by the method is used, data on particles each having a circle-equivalent diameter of less than 3.00 μm is discarded. After that, the average circularity of particles each having a coarse particle ratio of 30% or more on a number basis of the circle-equivalent diameter of the entirety of the developer and the accumulated value of particles each having a circularity of 0.920 or more on a number basis are calculated.

Next, a method of producing a developer will be described.

The developer of the present invention can be obtained by: sufficiently mixing a binder resin, any other additive, and the like by using a mixer such as a Henschel mixer or a ball mill; melting and kneading the mixture by using a heat kneader such as a heat roll, a kneader, or an extruder; cooling the kneaded product to be solidified; grinding and classifying the solidified product; and sufficiently mixing a desired additive with the composite inorganic fine powder by using a mixer such as a Henschel mixer as required.

Examples of a mixer include: a Henschel mixer (manufactured by Mitsui Mining Co., Ltd.); a Super mixer (manufactured by Kawata); a Ribocorn (manufactured by Okawara Corporation); a Nauta mixer, a Turbulizer, and a Cyclomix (manufactured by Hosokawa Micron Corporation); a Spiral pin mixer (manufactured by Pacific Machinery & Engineering Co., Ltd.); and a Lodige mixer (manufactured by Matsubo Corporation). Examples of a kneader include: a KRC kneader (manufactured by Kurimoto, Ltd.); a Buss co-kneader (manufactured by Buss); a TEM extruder (manufactured by Toshiba Machine Co., Ltd.); a TEX biaxial kneader (manufactured by Japan Steel Works Ltd.); a PCM kneader (manufactured by Ikegai); a Three-roll mill, a Mixing roll mill, and a Kneader (manufactured by Inoue Manufacturing Co., Ltd.); a Kneadex (manufactured by Mitsui Mining Co., Ltd.); an MS pressure kneader and a Kneader-ruder (manufactured by Moriyama Manufacturing Co., Ltd.); and a Banbury mixer (manufactured by Kobe Steels, Ltd.). Examples of a pulverizer include: a Counter jet mill, a Micronjet, and an Inomizer (manufactured by Hosokawa Micron Corporation); an IDS mill and a PJM jet grinder (manufactured by Nippon Pneumatic Mfg, Co., Ltd.); a Cross jet mill (manufactured by Kurimoto, Ltd.); an Urumax (manufactured by Nisso Engineering Co., Ltd.); an SK Jet O Mill (manufactured by Seishin Enterprise Co., Ltd.); a Kryptron system (manufactured by Kawasaki Heavy Industries); and a Turbo mill (manufactured by Turbo Kogyo Co., Ltd.). Examples of a classifier include: a Classiel, a Micron classifier, and a Spedic classifier (manufactured by Seishin Enterprise Co., Ltd.); a Turbo classifier (manufactured by Nisshin Engineering Inc.); a Micron separator, a Turboplex (ATP), and a TSP separator (manufactured by Hosokawa Micron Corporation); an Elbow jet (manufactured by Nittetsu Mining Co., Ltd.); a Dispersion separator (manufactured by Nippon Pneumatic Mfg, Co., Ltd.); and a YM microcut (manufactured by Yasukawa Shoji). Examples of a sieving device to be used for sieving coarse particles and the like include: an Ultrasonic (manufactured by Koei Sangyo Co., Ltd.); a Resonasieve and a Gyrosifter (manufactured by Tokuju Corporation); a Vibrasonic system (manufactured by Dalton Corporation); a Soniclean (manufactured by Shintokogio Ltd.); a Turbo screener (manufactured by Turbo Kogyo Co., Ltd.); a Microsifter (manufactured by Makino mfg Co., Ltd.); and a circular vibrating screen.

A mechanical pulverizer is particularly preferably used as pulverizing means to be used in a method of producing a developer involving controlling the shape of a coarse particle as a preferred embodiment of the present invention. Examples of the mechanical pulverizer include an Inomizer as a pulverizer manufactured by Hosokawa Micron Corporation, a KTM as a pulverizer manufactured by Kawasaki Heavy Industries, and a Turbo mill manufactured by Turbo Kogyo Co., Ltd. Each of those devices is preferably used as it is, or is preferably used after having been appropriately improved.

Figure 2:
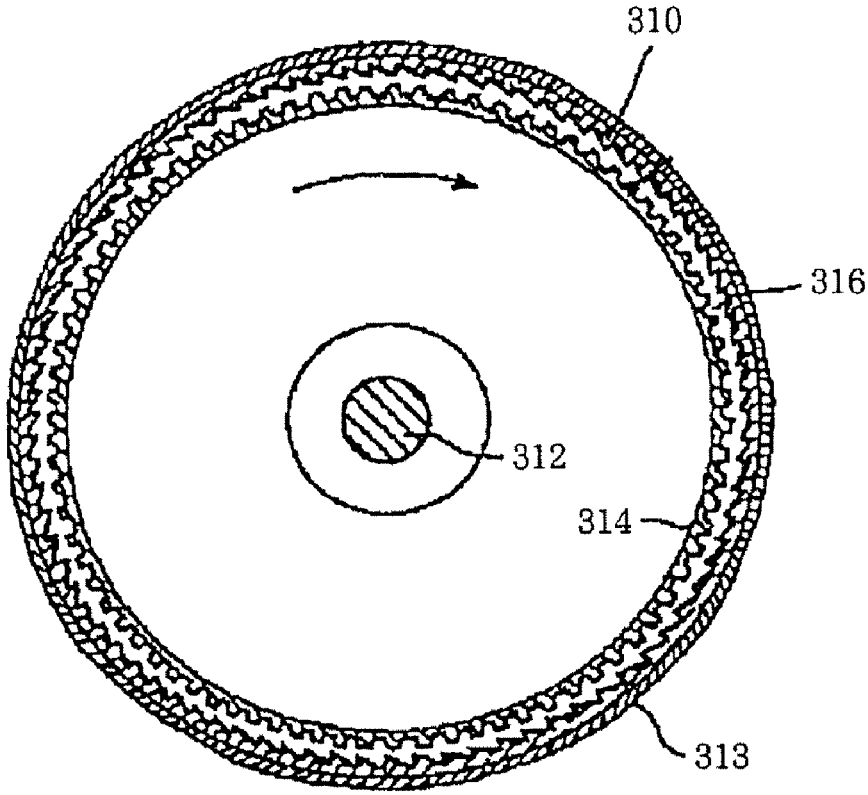
FIG. 2 is an outline sectional view taken along the surface D-D' shown in FIG. 1.
Figure 3:
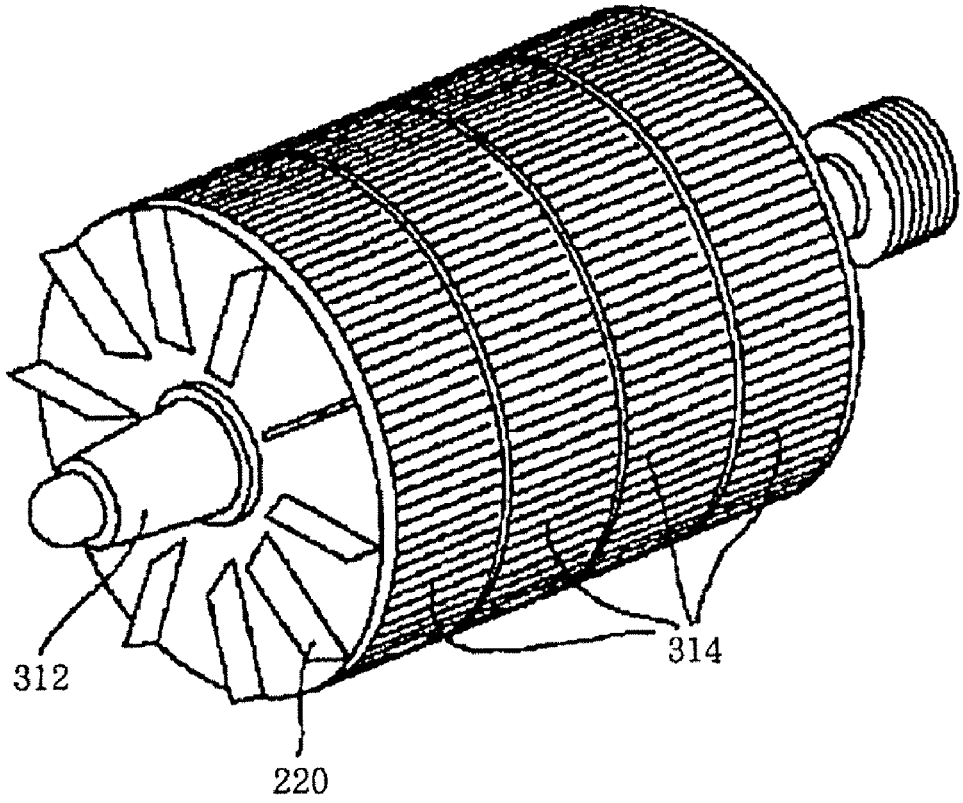
FIG. 3 is a perspective view of a rotator shown in FIG. 1.

In the present invention, such mechanical pulverizer as shown in each of FIGS. 1, 2, and 3 among those is preferably used because the control of the shape of a coarse particle and the pulverization treatment of a powder raw material can be easily performed, and hence an improvement in efficiency can be achieved.

Hereinafter, the mechanical pulverizer shown in each of FIGS. 1, 2, and 3 will be described. FIG. 1 shows an outline sectional view of an example of a mechanical pulverizer to be used in the present invention, FIG. 2 shows an outline sectional view taken along the surface D-D' shown in FIG. 1, and FIG. 3 shows a perspective view of a rotator 314 shown in FIG. 1. As shown in FIG. 1, the mechanical pulverizer is constituted of: a casing 313; a jacket 316; a distributor 220; the rotator 314 composed of a body of rotation placed in the casing 313 and attached to a central rotation axis 312, the rotator rotating at a high speed and having a surface provided with a large number of grooves; a stator 310 placed on the outer periphery of the rotator 314 while retaining a certain interval between itself and the rotator, the stator having a surface provided with a large number of grooves; a raw material input port 311 for introducing a raw material to be treated; and a raw material discharge port 302 for discharging a powder after a treatment.

A pulverization operation in the mechanical pulverizer constituted as described above is performed, for example, as described below.

After a predetermined amount of a powder raw material has been inputted from the powder inlet 311 of the mechanical pulverizer shown in FIG. 1, the particles are introduced into a pulverization treatment chamber, and are instantaneously pulverized by: the impact of a powder with the rotator 314, which rotates at a high speed in the pulverization treatment chamber and has a surface provided with a large number of grooves, or with the stator 310 having a surface provided with a large number of grooves, the impact occurring between the rotator and the stator; a large number of very high speed vortex flows occurring behind the impact; and high-frequency pressure vibration generated by the flows. After that, the resultant passes the raw material discharge port 302 to be discharged. The air conveying toner particles passes the raw material discharge port 302, a pipe 219, a collection cyclone 229, a bug filter 222, and a suction filter 224 via the pulverization treatment chamber to be discharged to the outside of a device system. The powder raw material is pulverized as described above, so a desired pulverization treatment can be easily performed without any increase in amount of a fine powder or coarse powder. The adjustment of the flow rate of the conveying air can control the shape of, in particular, a coarse toner particle.

In addition, upon pulverization of the powder raw material with the mechanical pulverizer, cold air is preferably blown into the mechanical pulverizer by cold air generating means 321 together with the powder raw material. Further, the temperature of the cold air is preferably 0 to −18° C.

Further, the mechanical pulverizer is preferably of a structure having a jacket structure 316 as means for cooling the inside of a mechanical pulverizer main body, and coolant (or preferably antifreeze such as ethylene glycol) is preferably passed through the jacket structure. Further, a temperature T inside a vortex chamber 212 in the mechanical pulverizer in communication with the powder introduction port is set to preferably 0° C. or lower, more preferably −5 to −15° C., or still more preferably −7 to −12° C. by the cold air device and the jacket structure described above. When the temperature T1 of the vortex chamber in the pulverizer is set to preferably 0° C. or lower, more preferably −5 to −15° C., or still more preferably −7 to −12° C., the alteration of the surface of a developer due to heat can be suppressed, whereby the powder raw material can be efficiently pulverized. Therefore, the temperature of the chamber is preferably in such range as described above in terms of developer productivity. A temperature T1 of the vortex chamber in the pulverizer in excess of 0° C. is not preferable in terms of developer productivity because the alteration of the surface of the developer or the fusion of the developer to the inside of the pulverizer is apt to occur owing to heat at the time of pulverization. In addition, when the pulverizer is operated while the temperature T1 of the vortex chamber in the pulverizer is set to a temperature lower than −15° C., a refrigerant (alternate chlorofluorocarbon) used in the above cold air generating means 321 must be changed to a chlorofluorocarbon.

The removal of a chlorofluorocarbon has been currently advanced from the viewpoint of the protection of an ozone layer, so it is not preferable to use a chlorofluorocarbon as the refrigerant of the above cold air generating means 321 in terms of the environmental problem of the entire earth.

Examples of the alternate chlorofluorocarbon include R134A, R404A, R407C, R410A, R507A, and R717. Of those, R404A is particularly preferable in terms of energy saving property and safety.

It should be noted that the coolant (or preferably antifreeze such as ethylene glycol) is supplied from a coolant supply port 317 to the inside of the jacket, and is discharged from a coolant discharge port 318.

In addition, the finely pulverized product produced in the mechanical pulverizer is discharged to the outside of the mechanical pulverizer from the discharge port 302 via a rear chamber 320 of the mechanical pulverizer. At this time, a temperature T2 of the rear chamber 320 of the mechanical pulverizer is preferably 30 to 60° C. When the temperature T2 of the rear chamber 320 of the mechanical pulverizer is set to 30 to 60° C., the alteration of the surface of the developer due to heat can be suppressed, whereby the powder raw material can be efficiently pulverized. Therefore, the temperature of the chamber is preferably in such range as described above in terms of developer productivity. A temperature T2 in the mechanical pulverizer of lower than 30° C. is not preferable in terms of developer performance because the powder raw material may cause a short path without being pulverized. A temperature T2 in excess of 60° C. is not preferable either in terms of developer productivity because the powder raw material may be excessively pulverized at the time of pulverization, so the alteration of the surface of the developer or the fusion of the developer to the inside of the pulverizer is apt to occur owing to heat.

In addition, a temperature difference ΔT (T2−T1) between the temperature T1 of the vortex chamber 212 of the mechanical pulverizer and the temperature T2 of the rear chamber 320 of the mechanical pulverizer upon pulverization of the powder raw material with the mechanical pulverizer is preferably 40 to 70° C., more preferably 42 to 67° C., or still more preferably 45 to 65° C. When the temperature difference ΔT between the temperatures T1 and T2 in the mechanical pulverizer is set to preferably 40 to 70° C., more preferably 42 to 67° C., or still more preferably 45 to 65° C., the alteration of the surface of the developer due to heat can be suppressed, whereby the powder raw material can be efficiently pulverized. Therefore, the temperature difference ΔT is preferably in such range as described above in terms of developer productivity. A temperature difference ΔT between the temperatures T1 and T2 in the mechanical pulverizer of lower than 40° C. is not preferable in terms of developer performance because the powder raw material may cause a short path without being pulverized. A temperature difference ΔT in excess of 70° C. is not preferable either in terms of developer productivity because the powder raw material may be excessively pulverized at the time of pulverization, so the alteration of the surface of the developer or the fusion of the developer to the inside of the pulverizer is apt to occur owing to heat.

In addition, the glass transition temperature (Tg) of the binder resin upon pulverization of the powder raw material with the mechanical pulverizer is preferably 45 to 75° C., or more preferably 55 to 65° C. In addition, the temperature T1 of the vortex chamber 212 of the mechanical pulverizer is preferably 0° C. or lower, and is preferably lower than the Tg by 60 to 75° C. in terms of developer productivity. When the temperature T1 of the vortex chamber 212 of the mechanical chamber is set to 0° C. or lower and to be lower than the Tg by 60 to 75° C., the alteration of the surface of the developer due to heat can be suppressed, whereby the powder raw material can be efficiently pulverized. In addition, the temperature T2 of the rear chamber 320 of the mechanical pulverizer is lower than the Tg by preferably 5 to 30° C., or more preferably 10 to 20° C. When the temperature T2 of the rear chamber 320 of the mechanical pulverizer is set to be lower than the Tg by preferably 5 to 30° C., or more preferably 10 to 20° C., the alteration of the surface of the developer due to heat can be suppressed, whereby the powder raw material can be efficiently pulverized.

In addition, the tip circumferential speed of the rotating rotator 314 is preferably 80 to 180 m/sec, more preferably 90 to 170 m/sec, or still more preferably 100 to 160 m/sec. When the tip circumferential speed of the rotating rotator 314 is set to preferably 80 to 180 m/sec, more preferably 90 to 170 m/sec, or still more preferably 100 to 160 m/sec, the insufficient pulverization or excessive pulverization of the developer can be suppressed, whereby the powder raw material can be efficiently pulverized. Therefore, the tip circumferential speed is preferably in such range as described above in terms of developer productivity. A tip circumferential speed of the rotator of less than 80 m/sec is not preferable in terms of developer performance because the powder raw material is apt to cause a short path without being pulverized. A tip circumferential speed of the rotator 314 in excess of 180 m/sec is not preferable either in terms of developer productivity because a load on the pulverizer itself increases, and, at the same time, the powder raw material is excessively pulverized at the time of pulverization, so the alteration of the surface of the developer or the fusion of the developer to the inside of the pulverizer is apt to occur owing to heat.

In addition, the minimum interval between the rotator 314 and the stator 310 is preferably 0.5 to 10.0 mm, more preferably 1.0 to 5.0 mm, or still more preferably 1.0 to 3.0 mm. When the interval between the rotator 314 and the stator 310 is set to preferably 0.5 to 10.0 mm, more preferably 1.0 to 5.0 mm, or still more preferably 1.0 to 3.0 mm, the insufficient pulverization or excessive pulverization of the developer can be suppressed, whereby the powder raw material can be efficiently pulverized. An interval between the rotator 314 and the stator 310 of more than 10.0 mm is not preferable in terms of developer performance because the powder raw material is apt to cause a short path without being pulverized. An interval between the rotator 314 and the stator 310 of less than 0.5 mm is not preferable either in terms of developer productivity because a load on the pulverizer itself increases, and, at the same time, the powder raw material is excessively pulverized at the time of pulverization, so the alteration of the surface of the developer or the fusion of the developer to the inside of the pulverizer is apt to occur owing to heat.

Figure 4:
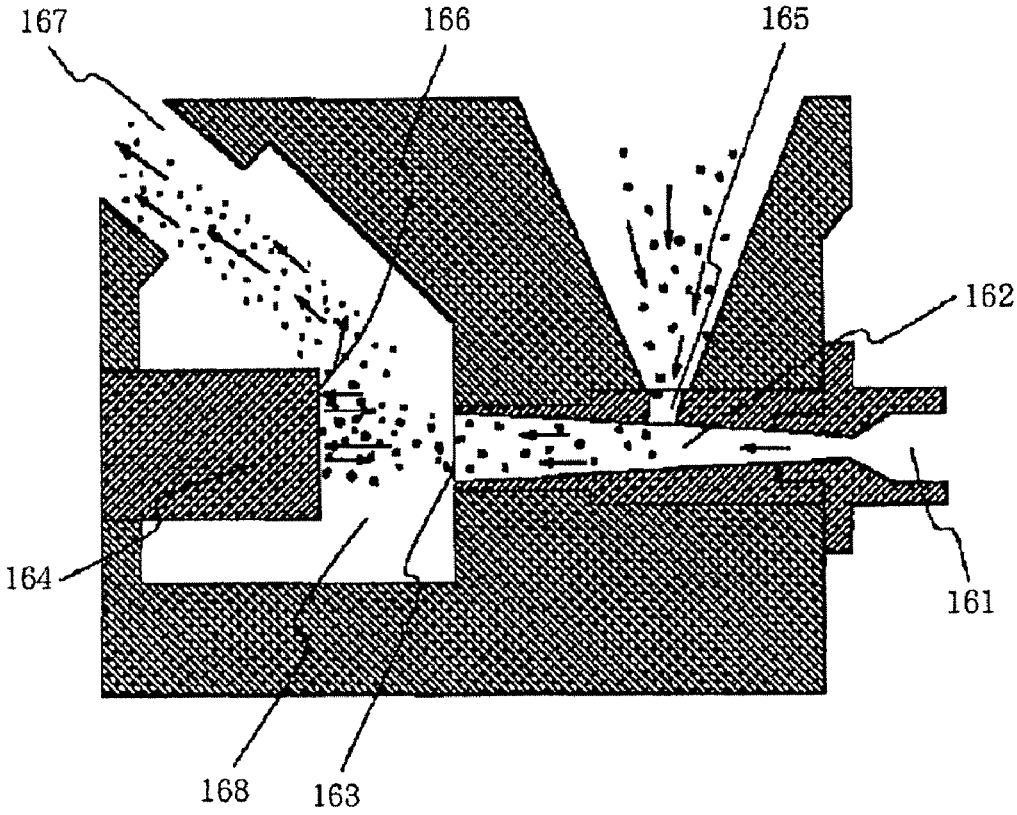
FIG. 4 is an outline sectional view of a conventional collision type air pulverizer.

The pulverization method is of not only a simple constitution but also a constitution that does not require a large air quantity for pulverizing a powder raw material. Accordingly, electric energy consumed in a pulverizing step per 1 kg of a developer is about one third or less of that in the case where a developer is produced by using a conventional collision type air pulverizer shown in FIG. 4, whereby an energy cost can be suppressed.

The developer of the present invention can be used in, for example, an image forming method including at least the steps of: charging an image bearing member (which may hereinafter be referred to as "photosensitive member"); forming an electrostatic latent image on the image bearing member by exposure; developing the electrostatic latent image on the image bearing member with a developer to form a developer image; transferring the developer image onto a transfer material through or without through an intermediate transfer member; and fixing the transferred developer image to the transfer material. In addition, such effect as described above can be obtained when the developer is used in such image forming method.

In addition, in an image forming method involving: charging the surface of an image bearing member having a conductive substance, and a photoconductive layer containing at least amorphous silicon and a surface protective layer on the conductive substance (which may hereinafter be referred to as "amorphous silicon photosensitive member"); forming an electrostatic latent image on the image bearing member by exposure; and developing the electrostatic latent image by using a developer according to a reversal development mode, the use of the developer of the present invention provides a preventing effect on the break of a surface layer (in some cases, the entire image bearing member) resulting from a peeling discharge phenomenon and a leak phenomenon as well as such effect as described above.

The break of the surface layer or of the image bearing member itself is due to: the continuous generation of peeling discharge opposite in polarity to the charged polarity of the image bearing member over a long time period upon separation (stripping) of the developer from the surface of the image bearing member; and the convergence of the energy of a leak phenomenon caused by a high electric field on part of the surface of the image bearing member. The use of the developer of the present invention can alleviate a peeling discharge phenomenon and a leak phenomenon on the surface of the image bearing member, whereby the break can be prevented.

Accordingly, the use of the developer of the present invention in an image forming method involving performing development by using an amorphous silicon photosensitive member according to a reversal development mode can effectively suppress a peeling discharge phenomenon and a leak phenomenon which occur on the surface of an image bearing member without sacrificing developability. As a result, a high-quality print in which image density unevenness and a black spot are stably suppressed over a long time period can be continuously outputted.

The inventors of the present invention have made investigation into a step in which the peeling discharge and leak phenomena occur on the surface of the amorphous silicon photosensitive member. As a result, they have confirmed that those discharge phenomena occur mainly in a transferring step and a cleaning step. Further, they have found that the frequency at which such phenomena occur in the cleaning step is higher than the frequency at which such phenomena occur in the transferring step. A possible reason for the foregoing is as follows: the discharge phenomena are apt to occur upon forced stripping of a developer having high chargeability, the developer remaining without being transferred from the surface of the image bearing member in the transferring step, in the cleaning step.

In the present invention, the following has been found: when a composite inorganic fine powder obtained by incorporating strontium carbonate and titanium oxide each of which is confirmed to have an alleviating effect on the discharge phenomena into strontium titanate exerting a small detrimental effect on developability is added to a toner particle, the discharge phenomena can be suppressed while the developability is not sacrificed.

The peeling discharge and leak phenomena in the cleaning step are expected to occur at the instant when the developer remaining on the surface of the image bearing member is separated. Therefore, in the case of a general cleaning step involving the use of a cleaning blade, the discharge phenomena are expected to occur at a cleaning blade edge portion as a point of contact between the cleaning blade and the surface of the image bearing member. The cleaning blade edge portion is structured so as to narrow spatially toward a contact point portion between the blade and the image bearing member little by little. A significant suppressing effect on the discharge phenomena can be obtained when the composite inorganic fine powder is of such a size that the powder can enter the narrow space. Accordingly, the composite inorganic fine powder has a number average particle diameter of preferably 30 nm or more to less than 1,000 nm.

In addition, the composition ratio of the composite inorganic fine powder plays an important role in establishing a balance between the discharge phenomena on the surface of the image bearing member and developability. The ratio (Ib)/(Ia) is preferably more than 0.010 and less than 0.150, and the ratio (Ic)/(Ia) is preferably more than 0.010 and less than 0.150.

In addition, in an image forming method including the steps of: forming an electrostatic latent image on an image bearing member having a photosensitive layer on a base body; and dislocating a developer mounted on a developer carrier toward the electrostatic latent image to develop the image, the image bearing member to be used having, in its surface, 20 to 1,000 grooves each having a groove width of 0.5 to 40.0 μm per 1,000 μm in a circumferential direction, the use of the developer of the present invention provides such effect as described above. In addition, a high-resolution, high-definition image which: is hardly affected by an environmental fluctuation; and has a suppressed image defect resulting from the adhesion and fusion of a product liberated from the developer, and has, for example, suppressed fogging can be obtained additionally stably. In addition, a load on a member such as a cleaning blade can be alleviated, and high durability can be obtained. It should be noted that the presence of a groove in a circumferential direction refers to a state where a groove is present in a direction substantially parallel to the rotational direction of the image bearing member, and a state where a groove is present in the direction perpendicular to the longitudinal direction of the image bearing member.

The composite inorganic fine powder to be incorporated into the developer of the present invention exerts the following effect: a toner particle and any other minute liberated product accumulating at a recessed portion in a groove in the surface of the image bearing member are electrostatically adsorbed and swept, and the accumulation of, for example, a product liberated from the developer on the surface of the image bearing member is prevented. In addition, the composite inorganic fine powder has a stable crystalline structure. As a result, the structure of the powder does not change even in an environment where a strong mechanical stress is applied to the developer such as the inside of a developer container at the time of the stirring or conveyance of the developer or a space between the image bearing member and the cleaning blade, so a removing effect on, for example, a liberated product present on the surface of the image bearing member can be maintained over a long time period.

In addition, in the image forming method as well, the composite inorganic fine powder has a number average particle diameter of preferably 30 nm or more to less than 1,000 nm from the viewpoint of compatibility between an adverse effect concerning hygroscopic property and a suppressing effect on a liberated product on the surface of the image bearing member.

In addition, in order that a sufficient removing effect on, for example, a liberated product present on the surface of the image bearing member may be obtained, the ratio (Ib)/(Ia) is preferably more than 0.010 and less than 0.150, and the ratio (Ic)/(Ia) is preferably more than 0.010 and less than 0.150.

The image bearing member to be used in the above image forming method is preferably such image bearing member as described below. The image bearing member has a conductive, cylindrical support (base body) and a photosensitive layer, or a photosensitive layer and a protective layer, on the conductive, cylindrical support. The surface of the image bearing member is composed of a combination of grooves formed in a circumferential direction and a flat portion. The grooves each have a groove width of 0.5 to 40.0 μm, and the number of grooves is 20 or more to 1,000 or less per 1,000 μm in the circumferential direction. In the case of the above groove width, no flaw-like image defects resulting from the grooves occur on an image. In addition, in the case of the above number of grooves, the chipping of the edge portion of the cleaning blade does not occur, and the contamination of charging means, the deterioration of the chargeability of the developer in developing means, a flaw on transferring means, and the like do not occur.

In addition, in the surface of the image bearing member, the flat portion has a width of more preferably 0.5 to 40 μm. When the width of the flat portion exceeds 40 μm, in the case where the image bearing member is used in an electrophotographic device having a cleaning blade as cleaning means, torque between the image bearing member and the cleaning blade is apt to increase, and a cleaning failure is apt to occur, though the degree of the increase or of the cleaning failure varies depending on the surface of the image bearing member, a constituent material for the developer, and various process conditions.

Further, the average width W (μm) of the grooves present in the image bearing member, and the number average particle diameter d (nm) of the composite inorganic fine powder preferably satisfy the following formulae:

$$30 \leqq d < 1{,}000$$

$$20.0 \leqq W/(d \times 10^{-3}) \leqq 500.0.$$

When the above relationships are satisfied, a relationship between a groove width in the surface of the image bearing member and the particle diameter of the composite inorganic fine powder is proper, and an electrostatically adsorbing effect on a portion where a toner particle and the like accumulate is sufficiently exerted.

Groove widths in the surface of the image bearing member, the average width of the grooves, and the number of grooves per unit length of 1,000 μm are measured by using, for example, a non-contact three-dimensional surface measuring machine (trade name: Micromap 557N, manufactured by Ryoka Systems Inc.) as described below.

The optical microscope portion of the Micromap 557N is mounted with a two-beam interference objective lens having a magnification of 5. The image bearing member is fixed below the lens, and a surface shape image for the member is vertically scanned with an interference image in a Wave mode by using a CCD camera, whereby a three-dimensional image is obtained. A range measuring 1.6 mm by 1.2 mm in the resultant image is analyzed, whereby the number of grooves per unit length of 1,000 μm and the widths of the grooves are obtained. The average width of the grooves, and the number of grooves per unit length of 1,000 μm are determined on the basis of the data. In addition, the average width of the grooves, and the number of grooves per unit length of 1,000 μm can be determined by processing, with an image processing software (such as a WinROOF (manufactured by MITANI CORPORATION)), the image of the surface of the image bearing member obtained by using, for example, a commercially available laser microscope (an ultradeep shape measuring microscope VK-8550 or VK-9000 (manufactured by KEYENCE CORPORATION), a scanning confocal laser microscope OLS 3000 (manufactured by OLYMPUS CORPORATION), a real color confocal microscope Oplitecs C130 (manufactured by Lasertec Corporation), or a digital microscope VHX-100 or VH-8000 (manufactured by KEYENCE CORPORATION)) instead of the Micromap 557N. In addition, the use of, for example, a three-dimensional non-contact shape measuring device (New View 5032 (manufactured by Zygo)) enables measurement similar to that of the Micromap 557N.

A flaw may be generated on the surface of the image bearing member owing to the rubbing of the surface of the image bearing member with a paper powder or toner particle sandwiched between the image bearing member and an abutting member such as a charging member or a cleaning member. In order that the generation of a flaw may be suppressed, the surface of the image bearing member preferably has a universal hardness value HU ($N/mm^2$) of 150 or more to 240 or less, and an elastic deformation ratio We of 44% or more to 65% or less.

The universal hardness value (HU) and elastic deformation ratio of the image bearing member are values measured by using a microhardness measuring device FISCHERSCOPE H100V (manufactured by Fischer Technology) under a 25° C./50% RH environment. The FISCHERSCOPE H100V continuously measures the hardness of a measuring object (the surface of the image bearing member) by: bringing an indenter into abutment with the object; continuously applying a load to the indenter; and directly reading an indentation depth under the load.

In the measurement, a Vickers square pyramid diamond indenter attached to the device and having an angle between opposite faces of 136° was used as the indenter, the final value for a load to be continuously applied to the indenter (final load) was 6 mN, and a time period (retention time) for which a state where the final load of 6 mN was applied to the indenter was kept was 0.1 second. In addition, the number of points of measurement was 273.

In addition, the surface roughness Rz (ten point height of irregularities) of the surface of the image bearing member is preferably 0.3 to 1.3 μm in terms of the suppression of image deletion and an improvement in character reproducibility. It should be noted that the surface roughness Rz of the surface of the image bearing member can be an index representing the depth of a groove.

In addition, a difference between a maximum surface roughness Rmax and the surface roughness Rz (Rmax−Rz) is preferably 0.3 or less, or more preferably 0.2 or less from the viewpoint of the suppression of density unevenness in a half tone image.

The surface roughness of the surface of the image bearing member is measured by using a contact type surface roughness measuring machine (trade name: Surfcorder SE3500, manufactured by Kosaka Laboratory Ltd.) under the following conditions.

The maximum surface roughness Rmax and the ten point height of irregularities Rz are determined in accordance with JIS B 0601 (1982) by using a diamond needle having a tip radius R of 2 μm (needle pressure 0.7 mN) as a detector and a 2CR as a filter with a cutoff value, a measurement length, and a feeding speed set to 0.8 mm, 2.5 mm, and 0.1 mm, respectively.

An example of an image bearing member having a groove in its surface and a method of producing the member will be described below.

The term "groove" as used in the present invention refers to one formed by surface-roughening means and having a groove width of 40 μm or less. To be additionally specific, the difference between the maximum surface roughness Rmax and the ten point height of irregularities Rz (Rmax−Rz) is preferably 0.3 or less. In contrast to the term "groove", the term "flaw" refers to one having a groove width in excess of 40 μm.

A method involving physically abrading the surface of the image bearing member to form the surface shape is a specific example of the surface-roughening means. Alternatively, a method involving maintaining the surface shape of a support having a roughened surface up to the surface of the image bearing member in a step of applying a photosensitive layer or a protective layer onto the support, a method involving forming the image bearing member surface shape with surface-roughening means in a state where a photosensitive layer or a protective layer has fluidity before drying or curing after application, and the like are also available.

Figure 11:
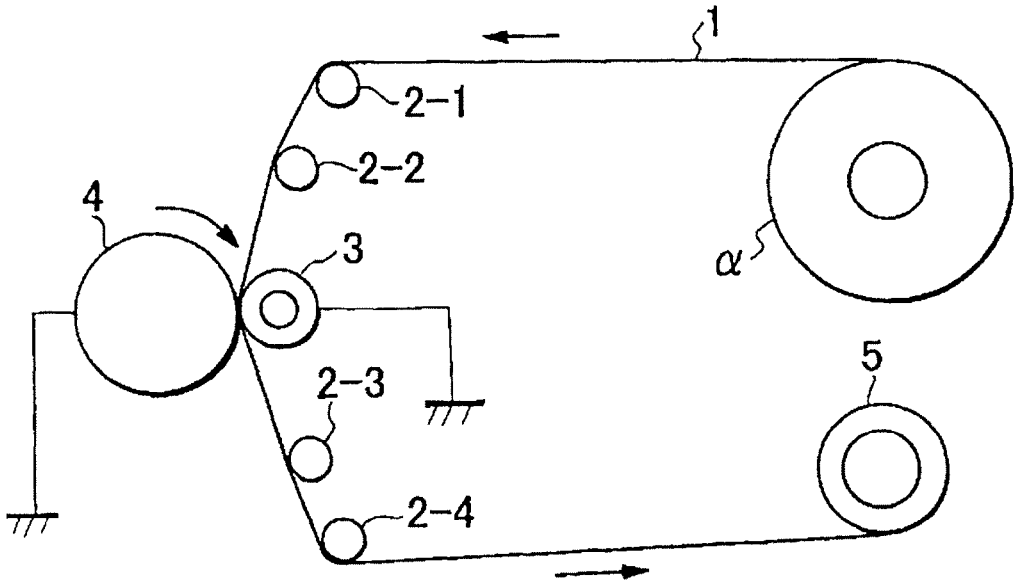
FIG. 11 is an outline view of means for roughening an image bearing member.

FIG. 11 shows an example of an abrading machine provided with an abrasive sheet as surface-roughening means to be used in the production of the image bearing member. An abrasive sheet 1 is a sheet obtained by applying abrasive grains dispersed in a binder resin to a base material. The abrasive sheet 1 is wound around a hollow axis α, and a motor (not shown) for applying a tension to the abrasive sheet 1 is placed in the direction opposite to the direction in which the sheet is fed to the axis α. The abrasive sheet 1 is fed in the direction indicated by an arrow, and passes a back-up roller 3 via guide rollers 2-1 and 2-2. The sheet after abrasion is wound around winding means 5 by a motor (not shown) via guide rollers 2-3 and 2-4. The abrasion is basically performed as follows: an untreated abrasive sheet is always brought into press contact with the surface of an image bearing member to roughen the surface of the image bearing member. Since the abrasive sheet 1 is basically insulative, a portion with which the sheet is in contact is preferably grounded, or preferably has conductivity.

The rate at which the abrasive sheet is fed is preferably in the range of 10 to 500 mm/sec. A small feed rate is not preferable because of the following reason: the abrasive sheet that has abraded the surface of the image bearing member contacts with the surface of the image bearing member again, so the generation of a deep flaw on the surface of the image bearing member, the unevenness of a surface groove, the adhesion of the binder resin to the surface of the abrasive sheet, and the like may occur.

An image bearing member 4 is placed at a position opposed to the back-up roller 3 through the abrasive sheet 1. In this case, the back-up roller 3 is pressed against the image bearing member 4 from the base material side of the abrasive sheet 1 for a predetermined time period, whereby the surface of the image bearing member is roughened. The rotational direction of the image bearing member may be identical or opposite to the direction in which the abrasive sheet 1 is fed, or may be changed during the abrasion.

The optimum value for the pressure at which the back-up roller 3 is pressed against the image bearing member 4 varies depending on the kind and particle diameter of each of the abrasive grains, the grain size of each of the abrasive grains dispersed in the abrasive sheet, the base material thickness of the abrasive sheet, the binder resin thickness of the abrasive grain sheet, the hardness of the back-up roller 3, and the hardness of a surface layer of which the surface of the image bearing member 4 is constituted. The groove shape of the surface of the image bearing member is achieved as long as the pressure is in the range of 0.005 to 1.5 $N/m^2$. It should be noted that, in, for example, the case where the abrasive sheet is used as surface-roughening means, the groove shape/distribution of the surface of the image bearing member can be adjusted by appropriately selecting the rate at which the abrasive sheet is fed, the pressure at which the back-up roller 3 is pressed, the particle diameter and shape of each of the abrasive grains, the grain size of each of the abrasive grains dispersed in the abrasive sheet, the binder resin thickness and base material thickness of the abrasive sheet, and the like.

Examples of the abrasive grains include aluminum oxide, chromium oxide, silicon carbide, diamond, iron oxide, cerium oxide, corundum, silica stone, silicon nitride, boron nitride, molybdenum carbide, silicon carbide, tungsten carbide, titanium carbide, and silicon oxide. The abrasive grains have an average particle diameter of preferably 0.01 to 50 μm, or more preferably 1 to 15 μm. When the particle diameter is small, a groove depth and a groove average width suitable in the present invention cannot be obtained. When the particle diameter is large, the difference Rmax−Rz increases, and, for example, the following inconvenience tends to occur: when unevenness or a flaw is generated on a half tone image, an influence of the flaw is conspicuous on the image. It should be noted that the average particle diameter of the abrasive grains refers to a median diameter D50 measured by a centrifugal sedimentation method.

The abrasive grains dispersed in the binder resin are applied onto the base material. The abrasive grains are preferably dispersed in the binder resin to have a grain size distribution, and the grain size distribution may be controlled. For example, when particles having large particle diameters are removed even on condition that an average particle diameter is maintained, a numerical value for the difference Rmax−Rx≦0.3 can be additionally reduced. Further, a variation in average particle diameter at the time of the production of the sheet can be suppressed, whereby a variation in surface roughness (Rz) of the surface of the image bearing member can be suppressed.

There is a correlation between the grain size of each of the abrasive grains dispersed in the binder resin and the particle diameter of each of the abrasive grains. As the grain size of each of the abrasive grains becomes smaller, the average particle diameter of the abrasive grains becomes larger, so a flaw is more liable to occur on the surface of the image bearing member. Therefore, the grain size of each of the abrasive grains is in the range of preferably 500 to 20,000, or more preferably 1,000 to 3,000.

Examples of the binder resin to be used in an abrasive sheet include known resins such as thermoplastic resins, thermosetting resins, reactive resins, electron beam curable resins, ultraviolet curable resins, visible light curable resins, and antifungal resins. Examples of the thermoplastic resins include vinyl chloride resins, polyamide resins, polyester resins, polycarbonate resins, amino resins, styrene butadiene copolymers, urethane elastomers, and nylon-silicone resins. Examples of the thermosetting resins include phenol resins, phenoxy resins, epoxy resins, polyurethane resins, polyester resins, silicone resins, melamine resins, and alkyd resins.

The binder resin thickness of the abrasive sheet is preferably 1 to 100 μm. When the binder resin thickness is large, the thickness of the binder resin becomes uneven, with the result that large irregularities are formed on the surface of the abrasive sheet, and the difference Rmax−Rx≦0.3 is hardly maintained upon abrasion of the image bearing member. On the other hand, when the binder resin thickness is excessively small, the abrasive grains tend to fall off. A commercially available product such as: a MAXIMA or a MAXIMA T type manufactured by Ref-lite; a Lapika manufactured by KOVAX; a Microfinishing Film or a Wrapping Film manufactured by Sumitomo 3M Limited; a Mirror Film or a Wrapping Film manufactured by Sankyo-Rikagaku Co., Ltd.; or a MIPOX manufactured by Nihon Micro Coating Co., Ltd. can be used as the abrasive sheet to be used in the present invention.

In addition, in the present invention, a surface-roughening step can be performed multiple times in order that an image bearing member surface having a desired groove shape may be obtained. In this case, the step may be performed in each of the following orders: the step may be performed with an abrasive sheet in which abrasive grains each having a coarse grain size are dispersed and then with an abrasive sheet in which abrasive grains each having a fine grain size are dispersed, or, in contrast, the step may be performed with an abrasive sheet in which abrasive grains each having a fine grain size are dispersed and then with an abrasive sheet in which abrasive grains each having a coarse grain size are dispersed. In the former case, an additionally fine groove can be superimposed on the surface of a coarse groove in the surface of the image bearing member, and, in the latter case, the unevenness of abraded grooves can be reduced.

Alternatively, the image bearing member may be abraded with abrasive sheets containing different abrasive grains having the same grain size. The use of abrasive grains different from each other in hardness can additionally optimize a groove shape in the surface of the image bearing member. Examples of a base material to be used in an abrasive sheet include a polyester resin, a polyolefin resin, a cellulose resin, a vinyl-based resin, a polycarbonate resin, a polyimide resin, a polyamide resin, a polysulfone resin, and a polyphenylsulfone resin. The base material thickness of the abrasive sheet is preferably 10 to 150 μm, or more suitably 15 to 100 μm. A thin base material thickness is not preferable because of the following reason: when the sheet is pressed against the surface of the image bearing member with the back-up roller, the slippage of the abrasive sheet occurs owing to the occurrence of pressing pressure unevenness, a recessed portion in the surface of the image bearing member produces an unabraded portion having a size of about several millimeters, a projected portion on the surface produces a deep groove, and the unabraded portion and the deep groove appear as density unevenness on a half tone image. A thick base material thickness makes it difficult to adjust the number of grooves because the hardness of the sheet itself increases, and abrasive grain distribution unevenness, pressing pressure unevenness, and the like are reflected in the surface of the image bearing member.

The back-up roller 3 is effective means for forming a desired groove in the surface of the image bearing member. Although the image bearing member can be abraded only with the tension of the abrasive sheet 1, in the case where the hardness of the surface layer of the image bearing member is high (the case where a curable resin is mainly used), the back-up roller 3 is desirably used because the pressure at which the abrasive sheet is in contact with the surface of the image bearing member tends to be low when the member is abraded only with the tension of the sheet.

The abrasive sheet 1 and the surface of the image bearing member are each charged to not a small extent during the abrasion. Although the charged voltages of the sheet and the surface differ from each other owing to, for example, the resistances of the sheet and the surface, each of the sheet and the surface may be charged to as high as several kilovolts. Accordingly, antistatic air, electrostatic air, or the like may be blown to, for example, the surface of the image bearing member, the abrasive sheet, and a nip portion between the surface and the sheet during the surface-roughening step.

Figure 12:
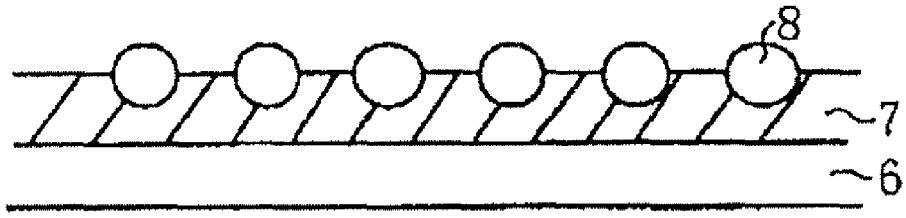
FIG. 12 is an outline view of an example of an abrasive sheet to be used in a method of producing an image bearing member.
Figure 13:
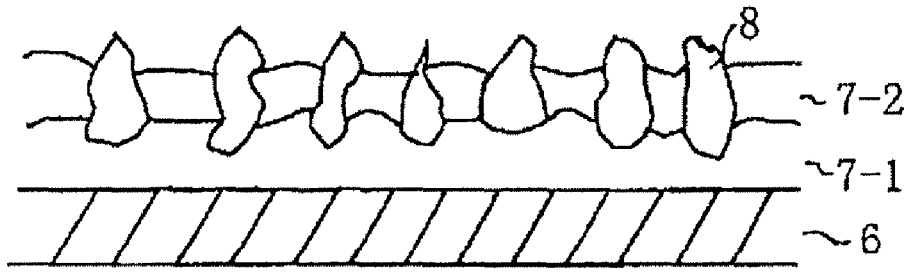
FIG. 13 is an outline view of another example of the abrasive sheet to be used in the method of producing an image bearing member.

As shown in FIG. 12, the abrasive sheet is constituted so that a binder resin 7 for sticking abrasive grains 8 to a base material 6 is applied onto the base material 6. FIG. 13 shows another example of the abrasive sheet. In FIG. 13, the edge of each of the abrasive grains 8 is stood. After a binder resin 7-1 and the abrasive grains 8 have been electrostatically applied, a binder resin 7-2 is applied so that the edge of each of the grains is stabilized.

Hereinafter, the laminated structure of an image bearing member will be described. The image bearing member has a photosensitive layer formed on a conductive support. The photosensitive layer can adopt each of a constitution obtained by laminating a charge generating layer and a charge transporting layer in the stated order, a constitution obtained by laminating the charge transporting layer and the charge generating layer in the stated order, and a constitution constituted of a single layer obtained by dispersing a charge generating substance and a charge transporting substance in a binder resin.

In each of the above cases, a surface layer of which the surface of the image bearing member is constituted is preferably a layer containing a compound which polymerizes, or causes a crosslinking reaction, by heating or irradiation with radiation so as to cure. The durable performance of the image bearing member is sufficiently improved by adopting, as the surface layer, a layer containing a compound which polymerizes, or causes a crosslinking reaction, by heating or irradiation with radiation so as to cure.

In terms of electrophotographic properties, in particular, electrical properties such as a residual potential, and durability, the image bearing member is preferably constituted as follows: the image bearing member has a laminated photosensitive layer obtained by laminating a charge generating layer and a charge transporting layer in the stated order and the charge transporting layer serves as a surface layer, or a surface layer is additionally formed on the laminated photosensitive layer obtained by laminating the charge generating layer and the charge transporting layer in the stated order. That is, the surface layer may serve as the charge transporting layer to constitute part of the photosensitive layer, or may be constituted on the photosensitive layer.

The surface layer may be formed of any compound as long as the compound polymerizes, or crosslinks, by heating or irradiation with radiation so as to cure. That is, any compound can be used as a constituent material for the surface layer as long as the compound generates an active site such as a radical by heating or irradiation with radiation, and then polymerizes or crosslinks so as to cure. Of such compounds, a compound having a chain polymerizable functional group in any one of its molecules, in particular, a compound having an unsaturated polymerizable functional group is preferable in terms of, for example, high reactivity, a high reaction rate, and the general-purpose properties of a material. The compound having an unsaturated polymerizable functional group is not limited to any one of a monomer, an oligomer, and a macromer.

In each of the case where the surface layer is positioned as part of the photosensitive layer and the case where the surface layer is additionally provided on the photosensitive layer, the surface layer preferably has a charge transporting ability after curing. In the case where the compound having an unsaturated polymerizable functional group to be used in the surface layer does not have charge transporting property, charge transporting property is desirably secured for the surface layer by adding a charge transporting substance or a conductive material. On the other hand, the foregoing description is not applicable to the case where the compound having an unsaturated polymerizable functional group itself is a compound having charge transporting property; provided that a compound having charge transporting property like the latter case is more preferably used in terms of the film hardness of the surface layer and various electrophotographic properties. Further, among the compounds each having charge transporting property, a compound having hole transporting property is still more preferable in terms of an electrophotographic process and the general-purpose properties of a material.

The conductive support (base body) to be used in the image bearing member has only to have conductivity. Examples of the conductive support include: a support obtained by molding a metal or alloy such as aluminum, copper, chromium, nickel, zinc, or stainless steel into a drum shape or a sheet shape; a support obtained by laminating a metal foil made of, for example, aluminum or copper on a plastic film; a support obtained by depositing, for example, aluminum, indium oxide, or tin oxide from the vapor onto a plastic film; and a metal, a plastic film, or paper provided with a conductive layer obtained by applying a conductive substance alone or together with a binder resin.

A conductive layer in which a conductive pigment, a resistance adjusting pigment, and the like are dispersed may be formed between the conductive support and the photosensitive layer. The conductive layer has a roughened surface owing to the dispersion of the pigments. When exposing means to be used in an electrophotographic device uses coherent light such as laser light, an interference fringe often appears on an image to be obtained. Accordingly, the conductive support is subjected to surface-roughening by using certain means. However, the conductive layer provides an effect equivalent to the surface-roughening of the support. Further, the conductive layer acts to cover a defect of the conductive support because the layer is applied onto the support. Accordingly, the layer eliminates the need for taking measures directed toward the removal of a defect of the support. The thickness of the conductive layer is preferably 0.2 to 40 μm, more preferably 1 to 35 μm, or still more preferably 5 to 30 μm.

Examples of a resin to be used in the conductive layer include: polymers and copolymers of vinyl compounds such as styrene, vinyl acetate, vinyl chloride, an acrylate, a methacrylate, vinylidene fluoride, and trifluoroethylene; polyvinyl alcohol; polyvinyl acetal; polycarbonate; polyester; polysulfone; polyphenylene oxide; polyurethane; a cellulose resin; a phenol resin; a melamine resin; a silicon resin; and an epoxy resin. The conductive layer is formed by using a solution prepared by dispersing or dissolving the conductive pigment, the resistance adjusting pigment, and the like in the resin as an application liquid. In some cases, a compound which polymerizes, or crosslinks, by heating or irradiation with radiation so as to cure can be added to the application liquid.

Examples of the conductive pigment and the resistance adjusting pigment include: metals such as aluminum, zinc, copper, chromium, nickel, silver, and stainless steel, and products obtained by depositing these metals from the vapor onto the surfaces of plastic particles; and metal oxides such as zinc oxide, titanium oxide, tin oxide, antimony oxide, indium oxide, bismuth oxide, tin-doped indium oxide, and antimony- or tantalum-doped tin oxide. Each of them can be used alone, or two or more kinds of them can be used in combination. When two or more kinds of them are used in combination, they may be merely mixed, or may be formed into a solid solution or fused product.

In the present invention, a base layer having a barrier function and an adhesion function can be provided between the conductive support (or a conductive layer) and the photosensitive layer. The base layer is formed for, for example, improving the adhesiveness of the photosensitive layer, improving the application property of the photosensitive layer, protecting the conductive support, covering a defect of the conductive support, improving the property with which charge is injected from the conductive support, and protecting the photosensitive layer against an electrical break.

Examples of a material of which the base layer is constituted include polyvinyl alcohol, poly-N-vinylimidazole, polyethylene oxide, ethylcellulose, an ethylene-acrylic acid copolymer, casein, polyamide, N-methoxymethylated 6-nylon, copolymerized nylon, glue, and gelatin. The base layer is formed by: applying a solution prepared by dissolving any one of those materials in an appropriate solvent onto the conductive support; and drying the applied solution. The thickness of the base layer is preferably about 0.1 to 2 μm.

Examples of a charge generating substance to be used in the charge generating layer include: selenium-tellurium, pyrylium, and thiapyrylium dyes; phthalocyanine compounds having various central metals and various crystal types, specifically, phthalocyanine compounds having crystal types such as α, β, γ, ∈, and X types; an anthanthrone pigment; a dibenzpyrenequinone pigment; a pyranthrone pigment; a trisazo pigment; a disazo pigment; a monoazo pigment; an indigo pigment; a quinacridone pigment; an asymmetric quinocyanine pigment; quinocyanine; and amorphous silicon described in JP-A-54-143645.

The charge generating layer is formed by: sufficiently dispersing the charge generating substance together with a binder resin and a solvent the total mass of which is 0.3 to 4 times as large as that of the substance by using, for example, a homogenizer, an ultrasonic dispersing machine, a ball mill, a vibrating ball mill, a sand mill, an attritor, or a roll mill; applying the resultant dispersion liquid onto the conductive support or the base layer; and drying the applied liquid. Alternatively, the charge generating layer is formed as a film composed only of the charge generating substance obtained by depositing the substance from the vapor. The thickness of the charge generating layer is preferably 5 μm or less, and is particularly preferably in the range of 0.1 to 2 μm.

Examples of the binder resin to be used in a charge generating layer include: polymers and copolymers formed of vinyl compounds such as styrene, vinyl acetate, vinyl chloride, acrylic ester, methacrylic ester, vinylidene fluoride, and trifluoroethylene; polyvinyl alcohol; polyvinyl acetal; polycarbonate; polyester; polysulphone; polyphenylene oxide; polyurethane; cellulose resins; phenol resins; melamine resins; silicon resins; and epoxy resins.

Next, the charge transporting layer will be described. In the present invention, when the surface layer constitutes part of the photosensitive layer, the charge transporting layer is preferably formed so as to contain a charge transporting substance and a compound which polymerizes, or crosslinks, by heating or irradiation with radiation so as to cure.

Examples of the charge transporting substance include: polymer compounds each having a heterocyclic ring or a fused polycyclic aromatic group such as poly-N-vinylcarbazole and polystyrylanthracene; heterocyclic compounds such as pyrazoline, imidazole, oxazole, triazole, and carbazole; triarylalkane derivatives such as triphenylmethane; triarylamine derivatives such as triphenylamine; and low-molecular-weight compounds such as a phenylenediamine derivative, an N-phenylcarbazole derivative, a stilbene derivative, and a hydrazone derivative. The charge transporting layer is formed by: dispersing or dissolving any one of those materials together with a compound which polymerizes, or crosslinks, by heating or irradiation with radiation so as to cure in an appropriate solvent; applying the solution onto the above-mentioned charge generating layer; and heating the applied liquid, or irradiating the liquid with radiation, as described below to cure the liquid.

As described above, the compound which polymerizes, or crosslinks, by heating or irradiation with radiation so as to cure has only to be a compound which can generate an active site such as a radical by heating or irradiation with radiation so as to polymerize or crosslink, and a general example of such compound is a compound having a chain polymerizable functional group. Of such compounds, a compound having an unsaturated polymerizable functional group in any one of its molecules is preferable in terms of, for example, high reactivity, a high reaction rate, and the general-purpose properties of a material. Particularly preferable examples of the unsaturated polymerizable functional group include an acryloyloxy group, a methacryloyloxy group, and a styrene group. Compounds each having any one of those groups is not limited to any of monomers, oligomers, macromers, and polymers, and can be appropriately selected, or can be used in combination. In addition, when a compound which has charge transporting property, or preferably hole transporting property and which polymerizes, or crosslinks, by heating or irradiation with radiation so as to cure is used, the charge transporting layer can be formed of the compound alone, and a charge transporting substance and a compound which does not have charge transporting property and which polymerizes, or crosslinks, by heating or irradiation with radiation so as to cure can be additionally mixed into the layer in an appropriate manner.

Examples of the compound which has charge transporting property and which polymerizes, or crosslinks, by heating or irradiation with radiation so as to cure include a known hole transportable compound having an unsaturated polymerizable functional group and a compound obtained by adding an unsaturated polymerizable functional group to part of the known hole transportable compound. Examples of the known hole transportable compound include a hydrazone compound, a pyrazoline compound, a triphenylamine compound, a benzidine compound, and a stilbene compound; any compound can be used as long as it is a hole transportable compound. Further, in the present invention, in order that the hardness of the surface layer may be sufficiently secured, the compound having an unsaturated polymerizable functional group is preferably a compound having multiple unsaturated polymerizable functional groups in any one of its molecules.

In the case of an image bearing member having a single-layer photosensitive layer which itself serves as a surface layer, the photosensitive layer is preferably formed by curing a solution prepared by dispersing or dissolving at least a charge generating substance, a charge transporting substance, and a compound which polymerizes, or crosslinks, by heating or irradiation with radiation so as to cure. In this case as well, as in the case of the above-mentioned image bearing member having a laminated photosensitive layer, the compound which polymerizes, or crosslinks, by heating or irradiation with radiation so as to cure preferably has charge transporting property.

When the surface layer is constituted on the photosensitive layer, the surface layer is preferably formed of a resin cured by heating or irradiation with radiation irrespective of whether the photosensitive layer is a laminated photosensitive layer or a single-layer photosensitive layer. In this case, the photosensitive layer as a lower layer of the surface layer may be each of a laminated photosensitive layer constituted by laminating a charge generating layer and a charge transporting layer in the stated order, a laminated photosensitive layer constituted by laminating a charge transporting layer and a charge generating layer in the stated order, and a single-layer photosensitive layer; the photosensitive layer is preferably a laminated photosensitive layer constituted by laminating a charge generating layer and a charge transporting layer in the stated order because of the above-mentioned reason. In this case, the charge generating layer is formed by a method similar to that described above, and the charge transporting layer is formed by using a solution prepared by dispersing or dissolving the charge transporting substance in a binder resin such as: a polymer or copolymer of a vinyl compound such as styrene, vinyl acetate, vinyl chloride, an acrylate, a methacrylate, vinylidene fluoride, or trifluoroethylene; polyvinyl alcohol; polyvinyl acetal; polycarbonate; polyester; polysulfone; polyphenylene oxide; polyurethane; a cellulose resin; a phenol resin; a melamine resin; a silicon resin; or an epoxy resin as an application liquid. In some cases, a compound which polymerizes, or crosslinks, by heating or irradiation with radiation so as to cure can be added to the application liquid for a charge transporting layer.

Even when the surface layer is constituted on the photosensitive layer, the surface layer preferably has charge transporting property after curing as described above. In the case where a compound itself to be used in the surface layer which polymerizes, or crosslinks, so as to cure is a compound which does not have charge transporting property, charge transporting property is desirably secured by adding a charge transporting substance to be used in the charge transporting layer or a conductive material. In this case, the charge transporting substance may or may not have a functional group capable of polymerizing, or crosslinking, by heating or irradiation with radiation; the charge transporting substance desirably has such group in order that a reduction in mechanical strength of the surface layer due to the plasticity of the charge transporting substance may be avoided. A conductive fine particle made of, for example, titanium oxide or tin oxide is generally used as the conductive material. Alternatively, a conductive polymer compound or the like can also be utilized. In the case where a compound itself to be used in the surface layer which polymerizes, or crosslinks, by heating or irradiation with radiation so as to cure has charge transporting property, the need for adding a charge transporting substance or a conductive material is eliminated. In terms of the film hardness of the surface layer and various electrophotographic properties, such surface layer as in the latter case formed by using a compound which has charge transporting property and which polymerizes, or crosslinks, by heating or irradiation with radiation so as to cure is preferable.

Any one of the known application methods such as an immersion coating method, a spray coating method, a curtain coating method, and a spin coating method can be employed as a method of applying a solution for forming each layer; the immersion coating method is preferable in terms of efficiency and productivity. A known film forming method such as vapor deposition or plasma can also be appropriately selected.

Various additives can be added to the base layer, the photosensitive layer, and the like. Examples of the additives include: deterioration inhibitors such as an antioxidant and a UV absorber; and lubricants such as a fluorine resin fine particle.

Next, a method of forming a surface layer or the like involving curing a compound which polymerizes, or crosslinks, by heating or irradiation with radiation so as to cure will be described. A compound which polymerizes, or crosslinks, by irradiation with radiation so as to cure is preferably used.

Irradiation with radiation will be described.

In the present application, examples of the radiation include an electron beam and a γ ray similar to those disclosed in JP-A-2000-066425, and an electron beam is preferable in terms of various points such as the size, safety, cost, and general-purpose properties of a device. In case of irradiation with an electron beam, an accelerator to be used may be of any one of, for example, a scanning type, an electrocurtain type, a broad beam type, a pulse type, and a laminar type.

The accelerating voltage and absorbed dose of the electron beam are very important factors in the sufficient expression of the electrical characteristics and durable performance of the image bearing member. The accelerating voltage of the electron beam is preferably 300 kV or less, or more preferably 150 kV or less. In addition, the dose of the electron beam is in the range of preferably 1 to 100 Mrad ($1\times10^4$ Gy to 1 MGy), or more preferably 50 Mrad ($5\times10^5$ Gy) or less. In addition, a radical as a reaction active site continues to be present for a certain time period after the irradiation with the electron beam. Accordingly, a polymerization or crosslinking reaction can be additionally advanced by increasing the temperature of the system during the presence of the radical after the irradiation with the electron beam, whereby a film having an additionally high degree of cure can be formed with the same dose. The utilization of the polymerization or crosslinking reaction with the aid of heating after the irradiation with the electron beam can provide sufficient curing property with a smaller dose than a conventional one.

The heating after the irradiation with the radiation will be described. The heating after the irradiation with the radiation can be performed from the outside or inside of the image bearing member. Examples of a method of heating the image bearing member from the outside of the member include a method involving installing various heaters and the like near the image bearing member to heat the member directly and a method involving heating an atmosphere surrounding the image bearing member, or bringing a heated gas into contact with the image bearing member, to heat the member indirectly. Examples of a method of heating the image bearing member from the inside of the member include a method involving installing various heaters in the image bearing member and a method involving passing a heated fluid through the image bearing member. In addition, two or more of those heating methods can be combined.

The temperature at which the image bearing member is heated is preferably set so that the temperature of the image bearing member becomes room temperature or higher, or more preferably the temperature of the image bearing member itself at the time of the irradiation with the radiation or higher. In ordinary cases, the irradiation with the radiation is generally performed under a room temperature atmosphere having a temperature around 20° C. At the time of the irradiation with the radiation, the image bearing member and a medium around the member absorb the energy of the radiation, so their temperatures increase. The ratio at which the temperature of each of the image bearing member and the medium increases depends on a heat balance between energy to be applied to a system such as an accelerating voltage, a dose, or an irradiation time and energy on an absorbing side, that is, for example, the size or material of an irradiation space, the flow of an ambient gas, the cooling system of a device, or the material constitution of the image bearing member itself. In an actual dose, the temperature of the image bearing member itself generally increases to room temperature or higher.

The reason why the temperature at which the image bearing member is heated is set so that the temperature of the image bearing member becomes room temperature or higher, or preferably the temperature of the image bearing member itself at the time of the irradiation with the radiation or higher may result from a polymerization reaction mechanism. At the time of the irradiation with the radiation, reaction active sites are generated first in a polymerization or crosslinking layer, and polymerization proceeds in a molecular distance in which a constituent material can move at a molecular level, that is, a bimolecular reaction can occur. As polymerization or crosslinking proceeds to some extent, the constituent material, which has been turned into an oligomer or a polymer, can no longer move at a molecular level at the temperature, so a reaction may stop on a temporary basis. At this point in time, each reaction active site can be present with some degree of lifetime as described above, so increasing the temperature of a system at this stage may allow an additional motion at a molecular level and the additional progress of a polymerization or crosslinking reaction. A higher temperature is more effective for the polymerization or crosslinking reaction. In the case of the image bearing member, however, the upper limit temperature is about 250° C.

The time period for which the image bearing member is heated can range from about several seconds to several tens of minutes, though the range varies depending on the temperature at which the image bearing member is heated. Heating the image bearing member for a time period shorter than that described above involves no particular problems, but is not practical in terms of, for example, a problem concerning the control of a device and an increase in load. On the other hand, heating the image bearing member for a time period longer than that described above is also possible, but is not very good in terms of, for example, productivity. The image bearing member may be heated in any one of the air, an inert gas, and a vacuum. In consideration of the mechanism of the polymerization or crosslinking reaction, the member is preferably heated in an inert gas or in a vacuum for avoiding the deactivation of each reaction active site due to oxygen to the extent possible; the member is more preferably heated in an inert gas in terms of the complexity and convenience of a device. Examples of a usable inert gas include nitrogen, helium, and argon; nitrogen is preferably used in terms of cost.

A time period commencing on the irradiation with the radiation and ending on the heating is preferably set to be short for the purpose of avoiding the deactivation of the reaction active sites to the extent possible. When the rate at which each of the sites deactivates is slow, that is, heating is performed in an inert gas or in a vacuum, the time period can be long. For example, the time period can be one day or longer. In addition, the image bearing member can be heated by a combination of several kinds of those heating methods.

EXAMPLES

Hereinafter, specific examples of the present invention are described. However, the present invention is not limited to these examples.

Composite Inorganic Fine Powder Production
Example 1

A titanyl sulfate powder was dissolved in distilled water so that a Ti concentration in the solution would be 1.5 (mol/l). Next, sulfuric acid and distilled water were added to the solution so that a sulfuric acid concentration after the completion of a reaction would be 2.8 (mol/l). The solution was heated in a sealed vessel at 110° C. for 36 hours, whereby a hydrolysis reaction was performed. After that, the resultant was sufficiently washed with water so that sulfuric acid and an impurity would be removed. As a result, metatitanic acid slurry was obtained. Strontium carbonate (having a number average particle diameter of 80 nm) was added to the slurry in a molar amount equivalent to that of titanium oxide. After having been sufficiently mixed in an aqueous medium, the resultant was washed and dried. After that, the resultant was sintered at 800° C. for 3 hours, pulverized by a mechanical impact force, and classified, whereby Composite Inorganic Fine Powder 1 having a number average particle diameter of 100 nm was obtained. Table 2 shows the physical properties of Composite Inorganic Fine Powder 1 obtained here.

Composite Inorganic Fine Powder Production Examples 2 to 12

Composite Inorganic Fine Powders 2 to 12 were each obtained in the same manner as in Composite Inorganic Fine Powder Production Example 1 except that: the above metatitanic acid slurry was used while the particle diameter of, and sintering conditions for, strontium carbonate to be used were changed as shown in Table 1; and pulverization and classification conditions were appropriately adjusted. Table 2 shows the physical properties of the resultant composite inorganic fine powders.

TABLE 1

| | | The particle diameter of $SrCO_3$ as a raw material (nm) | Sintering temperature (° C.) | Sintering time (h) |
|---|---|---|---|---|
| Production Example 1 | Composite Inorganic Fine Powder 1 | 80 | 800 | 3 |
| Production Example 2 | Composite Inorganic Fine Powder 2 | 90 | 700 | 15 |
| Production Example 3 | Composite Inorganic Fine Powder 3 | 80 | 750 | 8 |
| Production Example 4 | Composite Inorganic Fine Powder 4 | 60 | 750 | 7 |
| Production Example 5 | Composite Inorganic Fine Powder 5 | 120 | 700 | 8 |
| Production Example 6 | Composite Inorganic Fine Powder 6 | 150 | 750 | 7 |
| Production Example 7 | Composite Inorganic Fine Powder 7 | 80 | 700 | 5 |
| Production Example 8 | Composite Inorganic Fine Powder 8 | 150 | 750 | 7 |
| Production Example 9 | Composite Inorganic Fine Powder 9 | 150 | 750 | 7 |
| Production Example 10 | Composite Inorganic Fine Powder 10 | 120 | 750 | 4 |
| Production Example 11 | Composite Inorganic Fine Powder 11 | 120 | 1200 | 5 |
| Production Example 12 | Composite Inorganic Fine Powder 12 | 150 | 1400 | 1 |

TABLE 2

| | Peak intensity (Ia) at 2θ = 32.20 deg (Ia) | The half width of a peak at 2θ = 32.20 deg | Peak intensity (Ib) at 2θ = 27.80 deg (Ib) | Peak intensity (Ic) at 2θ = 27.50 deg (Ic) |
|---|---|---|---|---|
| Composite Inorganic Fine Powder 1 | 224000 | 0.26 | 9400 | 10500 |
| Composite Inorganic Fine Powder 2 | 202000 | 0.22 | 4300 | 3800 |
| Composite Inorganic Fine Powder 3 | 183000 | 0.28 | 14700 | 13200 |
| Composite Inorganic Fine Powder 4 | 265000 | 0.24 | 2300 | 19500 |
| Composite Inorganic Fine Powder 5 | 196000 | 0.27 | 29800 | 14800 |
| Composite Inorganic Fine Powder 6 | 251000 | 0.28 | 2100 | 2200 |
| Composite Inorganic Fine Powder 7 | 185000 | 0.29 | 28200 | 28600 |
| Composite Inorganic Fine Powder 8 | 260000 | 0.22 | 2000 | 1800 |
| Composite Inorganic Fine Powder 9 | 268000 | 0.29 | 2500 | 2400 |
| Composite Inorganic Fine Powder 10 | 203000 | 0.21 | 32000 | 30800 |
| Composite Inorganic Fine Powder 11 | 271000 | 0.23 | — | — |
| Composite Inorganic Fine Powder 12 | 14200 | 0.18 | 200 | 150 |

| | Ib/Ia | Ic/Ia | Number average particle diameter (nm) |
|---|---|---|---|
| Composite Inorganic Fine Powder 1 | 0.042 | 0.047 | 100 |
| Composite Inorganic Fine Powder 2 | 0.021 | 0.019 | 150 |
| Composite Inorganic Fine Powder 3 | 0.080 | 0.072 | 80 |
| Composite Inorganic Fine Powder 4 | 0.009 | 0.074 | 160 |
| Composite Inorganic Fine Powder 5 | 0.152 | 0.076 | 80 |
| Composite Inorganic Fine Powder 6 | 0.008 | 0.009 | 230 |
| Composite Inorganic Fine Powder 7 | 0.152 | 0.155 | 70 |
| Composite Inorganic Fine Powder 8 | 0.008 | 0.007 | 920 |
| Composite Inorganic Fine Powder 9 | 0.009 | 0.009 | 1250 |
| Composite Inorganic Fine Powder 10 | 0.158 | 0.152 | 40 |
| Composite Inorganic Fine Powder 11 | — | — | 1300 |
| Composite Inorganic Fine Powder 12 | 0.014 | 0.011 | 2500 |

Resin Production Example 1

Hybrid Resin

| (1) Production of polyester resin | |
|---|---|
| Terephthalic acid: | 6.2 mol |
| Dodecenylsuccinic anhydride: | 3.7 mol |
| Trimellitic anhydride: | 3.3 mol |
| PO-BPA: | 7.4 mol |
| EO-BPA: | 3.0 mol |

The above polyester monomers were loaded into an autoclave together with 0.10 part by mass of dibutyltin oxide as an esterification catalyst. A decompression device, a water separation device, a nitrogen gas introducing device, a temperature measuring device, and a stirring device were attached to the autoclave, and the mixture was subjected to a condensation polymerization reaction while being heated to 215° C. under a nitrogen gas atmosphere, whereby a polyester resin was obtained. The polyester resin had an acid value of 29.0 mgKOH/g, a Tg of 60° C., a peak molecular weight of 7,200, a weigh average molecular weight (Mw) of 25,000, and an Mw/Mn of 3.3.

(2) Production of Hybrid Resin Component 80 parts by mass of the above polyester resin were dissolved and swollen in 100 parts by mass of xylene. Next, 15 parts by mass of styrene, 5 parts by mass of 2-ethylhexyl acrylate, and 0.15 part by mass of dibutyltin oxide as an esterification catalyst were added to the resultant, and the whole was heated to the reflux temperature of xylene, whereby an ester exchange reaction between a carboxylic acid of the polyester resin and 2-ethylhexyl acrylate was initiated. Further, a xylene solution prepared by dissolving 1 part by mass of t-butylhydroperoxide as a radical polymerization initiator in 30 parts by mass of xylene was dropped to the resultant over about 1 hour. The resultant was held at the temperature for 6 hours, whereby a radical polymerization reaction was completed. The resultant was heated to 200° C. under reduced pressure for desolvation, whereby an ester exchange reaction between a hydroxyl group of the polyester resin and 2-ethylhexyl acrylate as a copolymerizable monomer of a vinyl polymer unit was performed. As a result, a hybrid resin produced by the ester bonding of the polyester resin, a vinyl polymer, a polyester unit, and the vinyl-based polymer unit was obtained.

The obtained hybrid resin had an acid value of 28.5 mgKOH/g, a Tg of 58° C., a peak molecular weight (Mn) of 7,400, a weight average molecular weight (Mw) of 45,000, Mw/Mn of 8.3, and contained 12 mass % of THF insoluble matter.

Resin Production Example 2

Polyester Resin

| | |
|---|---|
| Terephthalic acid: | 10 mol % |
| Fumaric acid: | 25 mol % |
| Trimellitic anhydride: | 5 mol % |
| PO-BPO: | 35 mol % |
| EO-BPA: | 25 mol % |

The above polyester monomers were loaded into an autoclave together with 0.10 part by mass of dibutyltin oxide as an esterification catalyst. A decompression device, a water separation device, a nitrogen gas introducing device, a temperature measuring device, and a stirring device were attached to the autoclave, and the mixture was subjected to a condensation polymerization reaction while being heated to 210° C. under a nitrogen gas atmosphere, whereby First Polyester Resin A was obtained.

The obtained First Polyester Resin A had an acid value of 27 mgKOH/g, a hydroxyl value of 42 mgKOH/g, a Tg of 58° C., an Mn of 3,000, an Mw of 11,000, and contained 0 mass % of THF insoluble matter.

Next, the following materials were similarly subjected to a condensation polymerization reaction:

| | |
|---|---|
| Fumaric acid | 33 mol % |
| Trimellitic anhydride | 10 mol % |
| PO-BPO | 35 mol % |
| EO-BPA | 22 mol %. |

3 mol % of trimellitic anhydride were further added in the midst of the polymerization, whereby Second Polyester Resin B was obtained.

Second Polyester Resin B obtained here had an acid value of 24 mgKOH/g, a hydroxyl value of 34 mgKOH/g, a Tg of 62° C., an Mn of 3,000, and an Mw of 155,000, and contained 27 mass % of THF insoluble matter.

50 parts by mass of Polyester Resin A thus obtained and 50 parts by mass of Polyester Resin B thus obtained were mixed with a Henschel mixer, whereby a polyester resin was obtained.

The polyester resin obtained here had an acid value of 25 mgKOH/g, a hydroxyl value of 35 mgKOH/g, a Tg of 59° C., an Mn of 2,700, and an Mw of 83,000, and contained 15 mass % of THF insoluble matter.

Resin Production Example 3

Styrene-Acrylic Resin

| | |
|---|---|
| Styrene | 70 parts by mass |
| n-butyl acrylate | 25 parts by mass |
| Monobutyl maleate | 6 parts by mass |
| Di-t-butyl peroxide | 1 part by mass |

200 parts by mass of xylene were loaded into a four-necked flask, and the air inside the container was sufficiently replaced with nitrogen while xylene was stirred. After the temperature of the flask had been increased to 130° C., the above respective components were dropped over 3.5 hours. Further, polymerization was completed under xylene reflux, and the solvent was removed by distillation under reduced pressure, whereby a styrene-acrylic resin was obtained.

The resultant styrene-acrylic resin had an acid value of 27 mgKOH/g, a Tg of 59° C., a peak molecular weight of 14,000, a weigh average molecular weight (Mw) of 78,000, and an Mw/Mn of 12.0.

Developer Production Example 1

| | |
|---|---|
| Hybrid resin described above | 100 parts by mass |
| Low-molecular-weight polyethylene (Melting point 98.6° C., number average molecular weight 780) | 7 parts by mass |
| Charge control agent (Azo complex compound; T-77 manufactured by Hodogaya Chemical Co., Ltd.) | 2 parts by mass |
| Magnetic iron oxide (Number average particle diameter 0.19 μm, magnetic properties in a magnetic field of 795.8 kA/m (coercive force 11.2 kA/m, remanent magnetization 10.8 $Am^2/kg$, intensity of magnetization 82.3 $Am^2/kg$)) | 90 parts by mass |

(Number average particle diameter 0.19 μm, magnetic properties in a magnetic field of 795.8 kA/m (coercive force 11.2 kA/m, remanent magnetization 10.8 $Am^2/kg$, intensity of magnetization 82.3 $Am^2/kg$))

The above mixture was melted and mixed with a biaxial kneader heated to 130° C., and the cooled mixture was coarsely pulverized with a hammer mill. Further, in a pulverizing step, a mechanical pulverizer shown in FIG. 1 (Turbo mill T-250 manufactured by Turbo Kogyo Co., Ltd.) was used. The pulverizer was operated under the following conditions: a gap between the rotator 314 and the stator 310 shown in FIG. 1 was 1.5 mm, the tip circumferential speed of the rotator 314 was 115 m/s, a conveyance air capacity was 30 $m^3/h$, and the amount of a coarsely pulverized product to be supplied was 24 kg/h.

The resultant coarsely pulverized product was classified with an air classifier, whereby toner particles having a weight average particle diameter (D4) of 7.8 μm and containing particles each having a particle diameter of 10.1 μm or more at a content of 6.3 vol % were obtained.

1.0 part by mass of Composite Inorganic Fine Powder 1 described above and 1.0 part by mass of hydrophobic dry silica (having a BET specific surface area of 300 $m^2/g$) were mixed with and externally added to 100 parts by mass of the toner particles by using a Henschel mixer FM 500 (manufactured by Mitsui Miike Machinery Co., Ltd.) at a stirring blade rotational speed of 1,100 rpm for 4 minutes, whereby Developer 1 was obtained. Table 4 shows the physical properties of Developer 1 obtained here.

Developer Production Examples 2 to 14 and Comparative Developer Production Examples 1 to 4

Developers 2 to 12 were each obtained in the same manner as in Developer Production Example 1 except that a resin component and a pulverization condition upon production of toner particles were changed, and, furthermore, a composite inorganic fine powder to be added was changed as shown in Table 3. In addition, in each of Developer Production Examples 13 and 14, and Comparative Developer Production Examples 1 to 4, a collision type air pulverizer shown in FIG. 4 was used. Table 4 shows the physical properties of Developers 2 to 14 and Comparative Developers 1 to 4 obtained here.

TABLE 3

| | | | | Pulverizing step | | | |
|---|---|---|---|---|---|---|---|
| | Developer | Composite inorganic fine powder | Binder resin | Pulverizing device | Rotator circumferential speed (m/s) | Cold air capacity ($m^3/h$) | Amount of coarsely pulverized product to be supplied (kg/h) |
| Production Example 1 | Developer 1 | Composite inorganic fine powder 1 | Hybrid resin | Mechanical pulverizer | 115 | 30 | 24 |
| Production Example 2 | Developer 2 | Composite inorganic fine powder 2 | Hybrid resin | Mechanical pulverizer | 100 | 40 | 34 |
| Production Example 3 | Developer 3 | Composite inorganic fine powder 3 | Hybrid resin | Mechanical pulverizer | 100 | 40 | 34 |
| Production Example 4 | Developer 4 | Composite inorganic fine powder 4 | Hybrid resin | Mechanical pulverizer | 100 | 40 | 34 |
| Production Example 5 | Developer 5 | Composite inorganic fine powder 5 | Hybrid resin | Mechanical pulverizer | 100 | 40 | 34 |
| Production Example 6 | Developer 6 | Composite inorganic fine powder 6 | Hybrid resin | Mechanical pulverizer | 100 | 40 | 34 |
| Production Example 7 | Developer 7 | Composite inorganic fine powder 7 | Hybrid resin | Mechanical pulverizer | 100 | 40 | 34 |
| Production Example 8 | Developer 8 | Composite inorganic fine powder 8 | Hybrid resin | Mechanical pulverizer | 100 | 40 | 34 |
| Production Example 9 | Developer 9 | Composite inorganic fine powder 9 | Hybrid resin | Mechanical pulverizer | 100 | 40 | 34 |
| Production Example 10 | Developer 10 | Composite inorganic fine powder 10 | Hybrid resin | Mechanical pulverizer | 100 | 40 | 34 |
| Production Example 11 | Developer 11 | Composite inorganic fine powder 10 | Polyester resin | Mechanical pulverizer | 100 | 40 | 34 |
| Production Example 12 | Developer 12 | Composite inorganic fine powder 10 | Styrene-acrylic resin | Mechanical pulverizer | 100 | 40 | 34 |
| Production Example 13 | Developer 13 | Composite inorganic fine powder 10 | Styrene-acrylic resin | Collision type air pulverizer | — | — | 52 |

TABLE 3-continued

| | Developer | Composite inorganic fine powder | Binder resin | Pulverizing step: Pulverizing device | Pulverizing step: Rotator circumferential speed (m/s) | Pulverizing step: Cold air capacity ($m^3$/h) | Pulverizing step: Amount of coarsely pulverized product to be supplied (kg/h) |
|---|---|---|---|---|---|---|---|
| Production Example 14 | Developer 14 | Composite inorganic fine powder 10 | Styrene-acrylic resin | Collision type air pulverizer | — | — | 38 |
| Comparative Production Example 1 | Comparative Developer 1 | Composite inorganic fine powder 11 | Styrene-acrylic resin | Collision type air pulverizer | — | — | 34 |
| Comparative Production Example 2 | Comparative Developer 2 | Composite inorganic fine powder 12 | Styrene-acrylic resin | Collision type air pulverizer | — | — | 34 |
| Comparative Production Example 3 | Comparative Developer 3 | Composite inorganic fine powder 11 | Hybrid resin | Mechanical pulverizer | 100 | 40 | 24 |
| Comparative Production Example 4 | Comparative Developer 4 | Composite inorganic fine powder 12 | Hybrid resin | Mechanical pulverizer | 75 | 45 | 34 |

TABLE 4

| Developer | Entirety: Average circularity a | Entirety: Ratio of particles each having a circularity of 0.920 or more (number %) | Particles each having a coarse particle ratio of 30% or more: Average circularity b | Particles each having a coarse particle ratio of 30% or more: Ratio of particles each having a circularity of 0.920 or more (number %) | Circularity ratio b/a |
|---|---|---|---|---|---|
| Developer 1 | 0.933 | 74.6 | 0.926 | 76.2 | 0.992 |
| Developer 2 | 0.929 | 68.5 | 0.920 | 65.4 | 0.990 |
| Developer 3 | 0.928 | 69.0 | 0.916 | 66.2 | 0.987 |
| Developer 4 | 0.928 | 68.3 | 0.915 | 65.8 | 0.986 |
| Developer 5 | 0.927 | 65.3 | 0.915 | 66.3 | 0.987 |
| Developer 6 | 0.926 | 65.3 | 0.916 | 65.2 | 0.989 |
| Developer 7 | 0.928 | 66.0 | 0.916 | 65.2 | 0.987 |
| Developer 8 | 0.927 | 65.3 | 0.917 | 65.3 | 0.989 |
| Developer 9 | 0.926 | 65.4 | 0.918 | 65.8 | 0.991 |
| Developer 10 | 0.926 | 66.3 | 0.917 | 66.4 | 0.990 |
| Developer 11 | 0.927 | 67.3 | 0.914 | 65.3 | 0.986 |
| Developer 12 | 0.926 | 66.4 | 0.916 | 66.7 | 0.989 |
| Developer 13 | 0.915 | 65.8 | 0.929 | 67.4 | 1.015 |
| Developer 14 | 0.909 | 61.9 | 0.905 | 55.3 | 0.996 |
| Comparative Developer 1 | 0.908 | 61.0 | 0.904 | 56.7 | 0.996 |
| Comparative Developer 2 | 0.907 | 60.8 | 0.905 | 56.5 | 0.998 |
| Comparative Developer 3 | 0.928 | 66.8 | 0.919 | 66.5 | 0.990 |
| Comparative Developer 4 | 0.920 | 66.0 | 0.914 | 65.9 | 0.998 |

Example 1

The following evaluation was performed by using Developer 1 described above. Table 5 shows the results of the evaluation.

<Image Evaluation Test>

A commercially available copying machine iR-4570 (manufactured by Canon Inc.) was reconstructed so that its print speed would be changed from 45 sheets/minute to 80 sheets/minute. 100,000 sheets were copied by using a test chart having a printing ratio of 6% under a high-temperature, high-humidity environment (40° C./90% RH). Evaluation for image density, in-plane uniformity, fogging, dot reproducibility, tailing, and stripe-like void was performed as described below.

1) Image Density

The reflection density of a circle image having a diameter of 5 mm was measured at five points by using a "Macbeth reflection densitometer" (manufactured by GretagMacbeth) and an SPI filter. Evaluation was performed on the basis of the average value for the five measured densities.

Rank 5: 1.45 or more
Rank 4: 1.40 or more and less than 1.45
Rank 3: 1.35 or more and less than 1.40
Rank 2: 1.30 or more and less than 1.35
Rank 1: Less than 1.30

2) In-Plane Density Uniformity

The reflection density of a solid black image was measured by using a "Macbeth reflection densitometer" (manufactured by GretagMacbeth) and an SPI filter. Evaluation for in-plane density uniformity was performed on the basis of a difference (Dmax−Dmin) between the maximum value (Dmax) and minimum value (Dmin) of the reflection density.

Rank 5: Less than 0.02
Rank 4: 0.02 or more and less than 0.05
Rank 3: 0.05 or more and less than 0.10
Rank 2: 0.10 or more and less than 0.20
Rank 1: 0.20 or more 3) Fogging The reflection density (Dr) of transfer paper before the formation of an image, and the worst value (Ds) of a reflection density after the copying of a solid white image were measured by using a "Reflection Densitometer" (REFLECTOMETER MODEL TC-6DS manufactured by Tokyo Denshoku). Evaluation was performed on the basis of a difference (Ds−Dr) as a fogging value.

Figure 5:
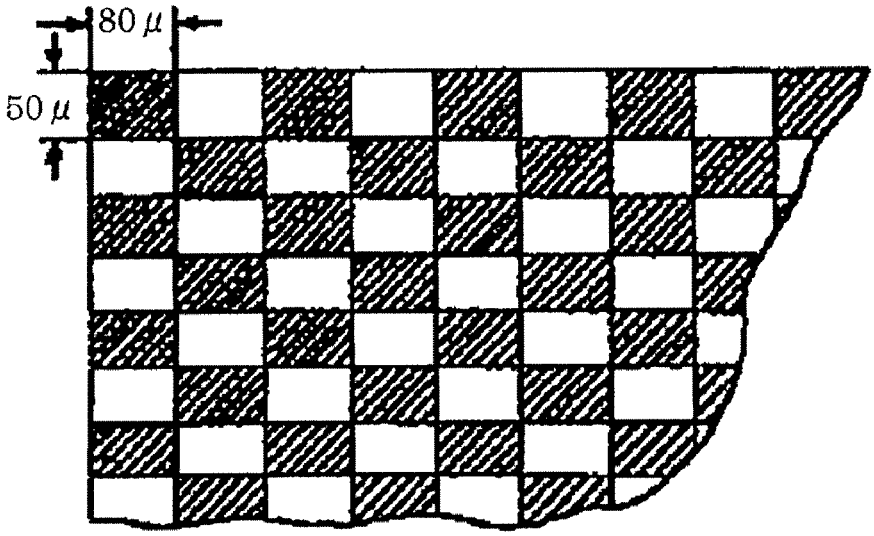
FIG. 5 is an explanatory view of a checker pattern for testing a developer for developing property.

Rank 5: Less than 0.1
Rank 4: 0.1 or more and less than 0.5
Rank 3: 0.5 or more and less than 1.5
Rank 2: 1.5 or more and less than 2.0
Rank 1: 2.0 or more 4) Evaluation for Dot Reproducibility An electrostatic latent image having a checker pattern constituted of one dot, two dots, three dots, or four dots shown in FIG. 5 was formed on an image bearing member. A developer was supplied to the surface of the image bearing member, and the resultant visible image was used as a sample. The sample was observed with an optical microscope, and was evaluated for dot reproducibility.

Rank 5: The image is faithful to the latent image.
Rank 4: The image shows slight scattering when enlarged with the optical microscope.
Rank 3: The image shows scattering and disturbance when enlarged with the optical microscope.
Rank 2: Scattering and the disturbance of the image are visually observed.
Rank 1: The original copy cannot be reproduced.

5) Evaluation for Tailing

A pattern obtained by printing a four-dot transverse line in a 20-dot space was outputted, and the number of tailings on the line was counted.

Rank 5: No tailing
Rank 4: Less than 3
Rank 3: 3 or more and less than 7
Rank 2: 7 or more and less than 15
Rank 1: 15 or more 6) Evaluation for Stripe-Like Image Void 30 solid black images (each having a printing ratio of 100%) were outputted. After that, 5 half tone images (2 dot, 2 spaces) were outputted. Then, the upper portion of a developing roller and each image were visually observed and evaluated.

Rank 5: A developer is uniformly applied onto the developing roller, and no stripe-like void is generated on each image.
Rank 4: The coating unevenness of a developer is observed on the developing roller, but no stripe-like void is generated on each image.
Rank 3: The coating unevenness of a developer occurs on the developing roller. No stripe-like void is observed on a solid black image, but a stripe-like void is observed on a half tone image.
Rank 2: The coating unevenness of a developer occurs on the developing roller, and a stripe-like void is observed even on a solid black image.
Rank 1: Innumerable stripe-like image voids are observed on each image.

Examples 2 to 14 and Comparative Examples 1 to 4

Evaluation was performed in the same manner as in Example 1 by using each of Developers 2 to 14 and Comparative Developers 1 to 4 described above. Table 5 shows the results of the evaluation.

TABLE 5

| | Under high-temperature, high-humidity environment (40° C./90% RH) | | | | | |
|---|---|---|---|---|---|---|
| | Image density | | | | | |
| | Reflection | | In-plane uniformity | | Fogging | |
| | density | Rank | Dmax − Dmin | Rank | Ds-Dr | Rank |
| Example 1 | 1.47 | 5 | 0.03 | 5 | 0.02 | 5 |
| Example 2 | 1.45 | 5 | 0.08 | 5 | 0.04 | 5 |
| Example 3 | 1.43 | 4 | 0.12 | 4 | 0.22 | 4 |
| Example 4 | 1.43 | 4 | 0.13 | 4 | 0.24 | 4 |
| Example 5 | 1.41 | 4 | 0.13 | 3 | 0.40 | 4 |
| Example 6 | 1.41 | 4 | 0.16 | 3 | 0.42 | 4 |
| Example 7 | 1.38 | 3 | 0.18 | 3 | 0.65 | 3 |
| Example 8 | 1.38 | 3 | 0.19 | 3 | 0.67 | 3 |
| Example 9 | 1.38 | 3 | 0.19 | 3 | 0.68 | 3 |
| Example 10 | 1.36 | 3 | 0.18 | 3 | 0.73 | 3 |
| Example 11 | 1.34 | 2 | 0.20 | 3 | 0.82 | 3 |
| Example 12 | 1.32 | 2 | 0.23 | 2 | 1.33 | 2 |
| Example 13 | 1.31 | 2 | 0.26 | 2 | 1.42 | 2 |
| Example 14 | 1.31 | 2 | 0.26 | 2 | 1.41 | 2 |
| Comparative example 1 | 1.28 | 1 | 0.29 | 1 | 2.56 | 1 |
| Comparative example 2 | 1.27 | 1 | 0.33 | 1 | 2.76 | 1 |
| Comparative example 3 | 1.29 | 1 | 0.27 | 1 | 2.23 | 1 |
| Comparative example 4 | 1.28 | 1 | 0.31 | 1 | 2.57 | 1 |

| | Under high-temperature, high-humidity environment (40° C./90% RH) | | |
|---|---|---|---|
| | Dot reproducibility | Evaluation for tailing | Stripe-like image void |
| Example 1 | 5 | 5 | 5 |
| Example 2 | 5 | 5 | 5 |
| Example 3 | 5 | 4 | 5 |
| Example 4 | 4 | 5 | 5 |
| Example 5 | 5 | 4 | 4 |
| Example 6 | 4 | 5 | 5 |
| Example 7 | 4 | 4 | 4 |
| Example 8 | 4 | 4 | 3 |
| Example 9 | 3 | 4 | 3 |
| Example 10 | 3 | 4 | 3 |
| Example 11 | 3 | 3 | 3 |
| Example 12 | 2 | 3 | 2 |
| Example 13 | 2 | 2 | 2 |
| Example 14 | 2 | 2 | 2 |
| Comparative example 1 | 1 | 1 | 1 |

TABLE 5-continued

| | | | |
|---|---|---|---|
| Comparative example 2 | 1 | 1 | 1 |
| Comparative example 3 | 1 | 1 | 1 |
| Comparative example 4 | 1 | 1 | 1 |

Production Example of Composite Inorganic Fine Powder A

A titanyl sulfate powder was dissolved in distilled water so that a Ti concentration in the solution would be 1.5 (mol/l). Next, sulfuric acid and distilled water were added to the solution so that a sulfuric acid concentration after the completion of a reaction would be 2.8 (mol/l). The solution was heated using a sealed vessel at 110° C. for 36 hours, whereby a hydrolysis reaction was performed. After that, the resultant was sufficiently washed with water so that sulfuric acid and an impurity would be removed. As a result, metatitanic acid slurry was obtained. Strontium carbonate (having a number average particle diameter of 85 nm) was added to the slurry in a molar amount equivalent to that of titanium oxide. After having been sufficiently mixed in an aqueous medium, the resultant was washed and dried. After that, the resultant was sintered at 800° C. for 3 hours, pulverized by a mechanical impact force, and classified, whereby Composite Inorganic Fine Powder A having a number average particle diameter of 0.11 μm was obtained. Table 6 shows the physical properties of Composite Inorganic Fine Powder A obtained here.

Production Examples of Composite Inorganic Fine Powders B to G

Composite Inorganic Fine Powders B to G were each obtained in the same manner as in Production Example Composite Inorganic Fine Powder A by using the above metatitanic acid slurry while the particle diameter of, and sintering conditions for, strontium carbonate to be used were changed as shown in Table 6, and by appropriately adjusting pulverization and classification conditions. Table 6 shows the physical properties of the resultant composite inorganic fine powders.

TABLE 6

| | The particle diameter of $SrCO_3$ used as a raw material (nm) | Sintering temperature (° C.) | Sintering time (h) | Peak intensity Ia at 2θ = 32.40 deg | The half width of a peak at 2θ = 32.40 deg | Peak intensity Ib at 2θ = 25.80 deg | Peak intensity Ic at 2θ = 27.40 deg |
|---|---|---|---|---|---|---|---|
| Composite Inorganic Fine Powder A | 85 | 800 | 3 | 224000 | 0.26 | 9450 | 11500 |
| Composite Inorganic Fine Powder B | 85 | 760 | 8 | 183000 | 0.28 | 14800 | 13200 |
| Composite Inorganic Fine Powder C | 85 | 700 | 5 | 185000 | 0.29 | 28000 | 28500 |
| Composite Inorganic Fine Powder D | 155 | 750 | 7 | 262000 | 0.21 | 2100 | 2100 |
| Composite Inorganic Fine Powder E | 155 | 750 | 7 | 262000 | 0.19 | 2100 | 2100 |
| Composite Inorganic Fine Powder F | 120 | 1150 | 5 | 271000 | 0.24 | — | — |
| Composite Inorganic Fine Powder G | 85 | 760 | 8 | 183000 | 0.31 | 14800 | 13200 |

| | Ib/Ia | Ic/Ia | Number average particle diameter (nm) |
|---|---|---|---|
| Composite Inorganic Fine Powder A | 0.042 | 0.051 | 110 |
| Composite Inorganic Fine Powder B | 0.081 | 0.072 | 80 |
| Composite Inorganic Fine Powder C | 0.151 | 0.154 | 60 |
| Composite Inorganic Fine Powder D | 0.008 | 0.008 | 940 |
| Composite Inorganic Fine Powder E | 0.008 | 0.008 | 1410 |

TABLE 6-continued

| | | | |
|---|---|---|---|
| Composite Inorganic Fine Powder F | — | — | 950 |
| Composite Inorganic Fine Powder G | 0.081 | 0.072 | 20 |

Production Example of Binder Resin A 300 parts by mass of xylene were loaded into a four-necked flask, and the air inside the container was sufficiently replaced with nitrogen while xylene was stirred. After that, the temperature of the flask was increased for refluxing xylene. Under the reflux, a mixed liquid of 76 parts by mass of styrene, 24 parts by mass of n-butyl acrylate, and 2 parts by mass of di-tert-butyl peroxide was dropped over 4 hours. After the liquid had been completely dropped, the mixture was held for 2 hours so that polymerization would be completed. As a result, a solution of a low-molecular-weight polymer (1L) was obtained.

300 parts by mass of xylene were loaded into a four-necked flask, and the air inside the container was sufficiently replaced with nitrogen while xylene was stirred. After that, the temperature of the flask was increased for refluxing xylene. Under the reflux, first, a mixed liquid of 73 parts by mass of styrene, 27 parts by mass of n-butyl acrylate, 0.005 part by mass of divinylbenzene, and 0.8 part by mass of 2,2-bis(4,4-di-tert-butylperoxycyclohexyl)propane was dropped over 4 hours. After the liquid had been completely dropped, the mixture was held for 2 hours so that polymerization would be completed. As a result, a solution of a binder resin (1H) was obtained.

200 parts by mass of a solution of the above low-molecular-weight component (1L) in xylene (corresponding to 30 parts by mass of the low-molecular-weight component) were loaded into a four-necked flask. Then, the temperature of the flask was increased, and the solution was stirred under reflux. Meanwhile, 200 parts by mass of the above solution of the high-molecular-weight component (1H) (corresponding to 70 parts by mass of the high-molecular-weight component) were loaded into another container, and were refluxed. The above solution of the low-molecular weight component (1L) and the above solution of the high-molecular-weight component (1H) were mixed under reflux. After that, an organic solvent was removed by distillation, and the resultant resin was cooled, solidified, and pulverized, whereby Binder Resin A was obtained. Table 7 shows the physical properties of Binder Resin A.

Production Example of Binder Resin B

| | |
|---|---|
| Propoxylated bisphenol A (2.2-mol adduct): | 25.0 mol % |
| Ethoxylated bisphenol A (2.2-mol adduct): | 25.0 mol % |
| Terephthalic acid: | 33.0 mol % |
| Trimellitic anhydride: | 5.0 mol % |
| Adipic acid: | 6.5 mol % |
| Acrylic acid: | 3.5 mol % |
| Fumaric acid: | 1.0 mol % |

The above polyester monomers were loaded into a four-necked flask together with 0.10 part by mass of dibutyltin oxide as an esterification catalyst. A decompression device, a water separation device, a nitrogen gas introducing device, a temperature measuring device, and a stirring device were mounted on the flask, and the mixture was stirred at 135° C. under a nitrogen atmosphere. The mixture of a vinyl copolymerizable monomer (styrene: 84 mol % and 2ethylhexyl acrylate: 14 mol %) and 2 mol % of benzoyl peroxide as a polymerization initiator was dropped from a dropping funnel to the resultant over 4 hours. After that, the mixture was subjected to a reaction at 135° C. for 5 hours, and then a reaction temperature at the time of polycondensation was increased to 230° C. Further, 1.0 mol % of fumaric acid was added, and then the whole was subjected to a condensation polymerization reaction. After the completion of the reaction, the resultant was taken out of the container, and was cooled and pulverized, whereby Binder Resin B was obtained. Table 7 shows the physical properties of Binder Resin B.

Production Example of Binder Resin C

| | |
|---|---|
| Terephthalic acid: | 31.0 mol % |
| Trimellitic acid: | 7.0 mol % |
| Propoxylated bisphenol A (2.2-mol adduct): | 35.0 mol % |
| Ethoxylated bisphenol A (2.2-mol adduct): | 27.0 mol % |

The above polyester monomers were loaded into a four-necked flask together with 0.10 part by mass of dibutyltin oxide as an esterification catalyst. A decompression device, a water separation device, a nitrogen gas introducing device, a temperature measuring device, and a stirring device were mounted on the flask, and the mixture was stirred at 135° C. under a nitrogen atmosphere. The mixture of a vinyl copolymerizable monomer (styrene: 84.0 mol % and 2ethylhexyl acrylate: 14.0 mol %) and 2.0 mol % of benzoyl peroxide as a polymerization initiator was dropped from a dropping funnel to the resultant over 4 hours. After that, the mixture was subjected to a reaction at 135° C. for 5 hours, and then a reaction temperature at the time of polycondensation was increased to 230° C., and then the whole was subjected to a condensation polymerization reaction. After the completion of the reaction, the resultant was taken out of the container, and was cooled and pulverized, whereby Binder Resin C was obtained. Table 7 shows the physical properties of Binder Resin C.

Production Example of Binder Resin D

| | |
|---|---|
| Propoxylated bisphenol A (2.2-mol adduct): | 46.8 mol % |
| Terephthalic acid: | 34.8 mol % |
| Trimellitic anhydride: | 11.8 mol % |
| Isophthalic acid: | 5.6 mol % |
| Phenol novolac EO adduct: | 1.0 mol % |

The above monomers were loaded into a 5-1 autoclave together with 0.10 part by mass of dibutyltin oxide as an esterification catalyst. A reflux condenser, a water separation device, a nitrogen gas introducing device, a temperature gauge, and a stirring device were attached to the autoclave, and the mixture was subjected to a polycondensation reaction at 230° C. while a nitrogen gas was introduced into the autoclave. After the completion of the reaction, the resultant was taken out of the container, and was cooled and pulverized, whereby Binder Resin D was obtained. Table 7 shows the physical properties of Binder Resin D.

Production Example of Binder Resin E

| | |
|---|---|
| Propoxylated bisphenol A (2.2-mol adduct): | 47.1 mol % |
| Terephthalic acid: | 49.9 mol % |
| Trimellitic anhydride: | 3.0 mol % |

The above monomers were loaded into a 5-1 autoclave together with 0.10 part by mass of dibutyltin oxide as an esterification catalyst. A reflux condenser, a water separation device, a nitrogen gas introducing device, a temperature gauge, and a stirring device were attached to the autoclave, and the mixture was subjected to a polycondensation reaction at 230° C. while a nitrogen gas was introduced into the autoclave. After the completion of the reaction, the resultant was taken out of the container, and was cooled and pulverized, whereby Binder Resin E was obtained. Table 7 shows the physical properties of Binder Resin E.

TABLE 7

| | Main peak molecular weight Mp | Weight average molecular weight Mw | Mw/Mn | THF insoluble matter (mass %) | Glass transition temperature (° C.) |
|---|---|---|---|---|---|
| Binder Resin A | 800,000/ sub-peak 13,000 | 375000 | 55.2 | 2 | 60.3 |
| Binder Resin B | 7800 | 55000 | 8.1 | 37 | 55.0 |
| Binder Resin C | 6600 | 8400 | 2.5 | 0 | 57.3 |
| Binder Resin D | 7700 | 142000 | 24.1 | 35 | 59.1 |
| Binder Resin E | 7100 | 8200 | 2.3 | 0 | 59.3 |

Production Example of Image bearing Member A

The following layers were laminated on a cylindrical Al base body (having an outer diameter of 108 mm and a length of 358 mm) by a high-frequency plasma CVD (PCVD) method while a base body temperature, a gas kind, a gas flow, the temperature inside a reaction vessel, and the like were appropriately adjusted. As a result, Image bearing Member A which was positively chargeable was produced.

| | |
|---|---|
| Charge injection blocking layer: | Layer composed of a-Si:H doped with phosphorus (P) |
| Photoconductive layer: | Layer composed of amorphous silicon |
| Surface protective layer: | Layer composed of amorphous silicon carbide (a-SiC:H) |

Production Example of Image bearing Member B

Image bearing Member B which was positively chargeable was produced in the same manner as in Production Example of Image bearing Member A except that the surface protective layer was changed to a layer containing hydrogen atom-containing amorphous carbon (a-C:H).

Production Example of Image bearing Member C

Image bearing Member C which was negatively chargeable was produced in the same manner as in Production Example of Image bearing Member A except that the surface protective layer was changed to a layer containing amorphous silicon nitride (a-SiN:H).

Example A

| | |
|---|---|
| Binder Resin A | 100 parts by mass |
| Magnetic iron oxide particles (Octahedron, number average particle diameter 0.16 μm, magnetic properties in a magnetic field of 795.8 kA/m (coercive force 11.2 kA/m, intensity of magnetization 89 $Am^2/kg$, remanent magnetization 15 $Am^2/kg$)) | 90 parts by mass |
| Fischer-Tropsch wax (melting point: 101° C.): | 4 parts by mass |
| Charge Control Agent A (see the following structural formula): | 2 parts by mass |

[Chem 2]

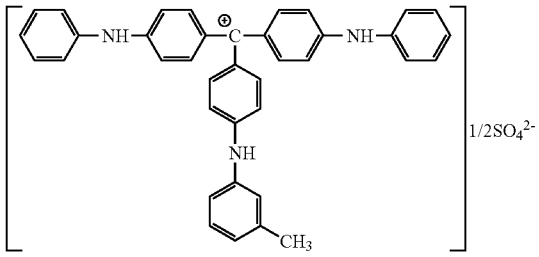

The above materials were premixed with a Henschel mixer, and were then melted and kneaded with a biaxial kneading extruder while such control that the temperature of the kneaded product became 120° C. was performed. The resultant kneaded product was cooled and coarsely pulverized with a hammer mill. After that, the coarsely pulverized product was pulverized with a mechanical pulverizer shown in FIG. 1 (Turbo mill T-250 manufactured by Turbo Kogyo Co., Ltd.). The resultant finely pulverized powder was classified by using a multi-division classifier utilizing a Coanda effect, whereby toner particles having a weight average particle diameter (D4) of 6.3 μm were obtained.

0.8 part by mass of hydrophobic silica obtained by treating 100 parts by mass of Hydrophobic Silica Fine Powder 1 (having a BET specific surface area of 200 $m^2/g$) with 20 parts by mass of amino-denatured silicone oil (amino equivalent=830, viscosity at 25° C.=70 $mm^2/s$), 1.2 parts by mass of Composite Inorganic Fine Powder A, and 3.0 parts by mass of a strontium titanate fine powder having a number average particle diameter of 1.3 μm were externally added to and mixed with 100 parts by mass of the toner particles, and the whole was sifted with a sieve having an aperture of 150 μm, whereby Developer A was obtained. Table 8 shows the main formulation of the developer.

Developer A obtained here was subjected to the respective evaluation tests shown below.

Figure 6:
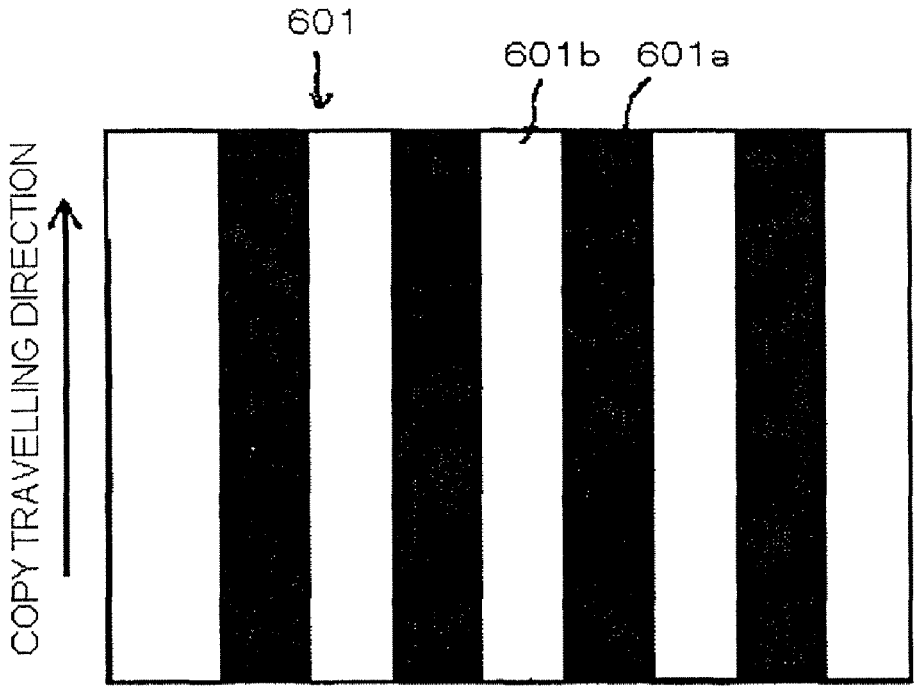
FIG. 6 is a schematic view of a test chart for a durability test.

A commercially available digital copying machine iR7105i (reversal development mode, manufactured by Canon Inc.) was used in evaluation after having been reconstructed as follow: an image bearing member drum was changed to Image bearing Member A described above so that the circumferential speed of the image bearing member drum would be 660 mm/sec. In order that peeling discharge and leak phenomena on the surface of the image bearing member drum might be promoted, a test chart 601 in which solid black image portions 601*a* and solid white image portions 601*b* were alternately arranged in parallel with a print travelling direction (conveyance direction) as shown in FIG. 6 was used to carry out a 1,000,000-sheet continuous printing durability test under the following environmental conditions: each of a normal temperature/low humidity environment (23° C./5% RH) and a high temperature/high humidity environment (30° C./80% RH). After that, evaluation for the following items was performed. It should be noted that the chart 601 was of an A4 size, and a ratio of the solid black image portions 601*a* to the entire region of the chart 601 was 50%.

Table 9 shows the results of the evaluation.

Evaluation for each item was performed on the basis of the ranks categorized as shown below.

<Black Spot>

After the completion of the 1,000,000-sheet durability test, a half tone image (having a latent image density of 50%) was printed, the number of generated black spots at a portion corresponding to the solid black of the test chart was counted, and evaluation was performed by categorizing the number into any one of the following three stages.

A: No black spot is generated.

B: The number of generated extremely small black spots is 1 or more and less than 30.

C: The number of generated extremely small black spots is 30 or more.

<Image Density Stability>

In a half tone image (having a latent image density of 50%), a portion corresponding to the solid black of the test chart was evaluated for density fluctuation. That is, the image density of the portion corresponding to the solid black at an early stage of the durability test, and the image density of the portion corresponding to the solid black after the 1,000,000-sheet durability test were measured with a Macbeth reflection densitometer (manufactured by GretagMacbeth). A difference between the densities was determined, and evaluation was performed by categorizing the difference into any one of the following three stages.

A: A density fluctuation is less than 0.1.

B: A density fluctuation is 0.1 or more and less than 0.2.

C: A density fluctuation is 0.2 or more.

<Drum Potential Reduction Ratio>

Figure 7:
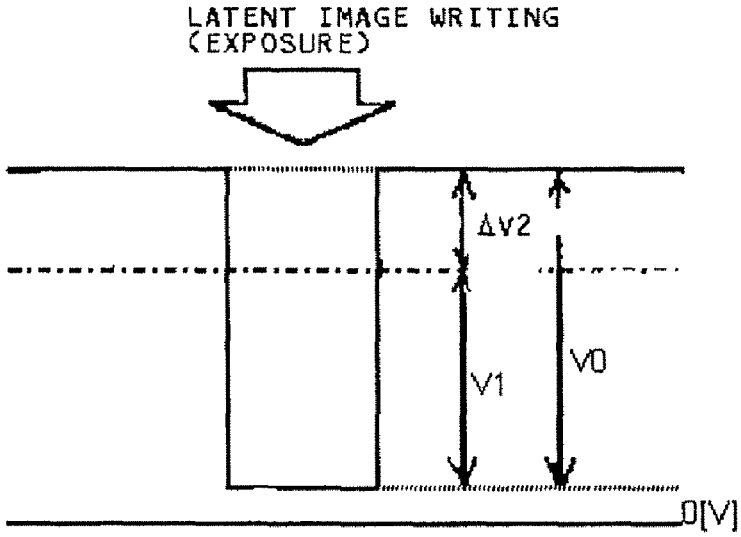
FIG. 7 is a view for explaining an image bearing member potential level and a developing bias level by a direct voltage application mode.

According to a direct voltage application mode (Journal of Electrophotography, vol. 22, first issue (1983)), as shown in FIG. 7, a drum potential reduction ratio (%) was calculated by dividing a difference $\Delta V2$ ($=V_0-V_1$) between the potential ($V_0$) of the portion corresponding to the solid black image on the surface of the drum before the durability test and the potential ($V_1$) of the portion after the 1,000,000-sheet durability test by the potential ($V_0$) before the durability test and by multiplying the answer by 100.

Figure 8:
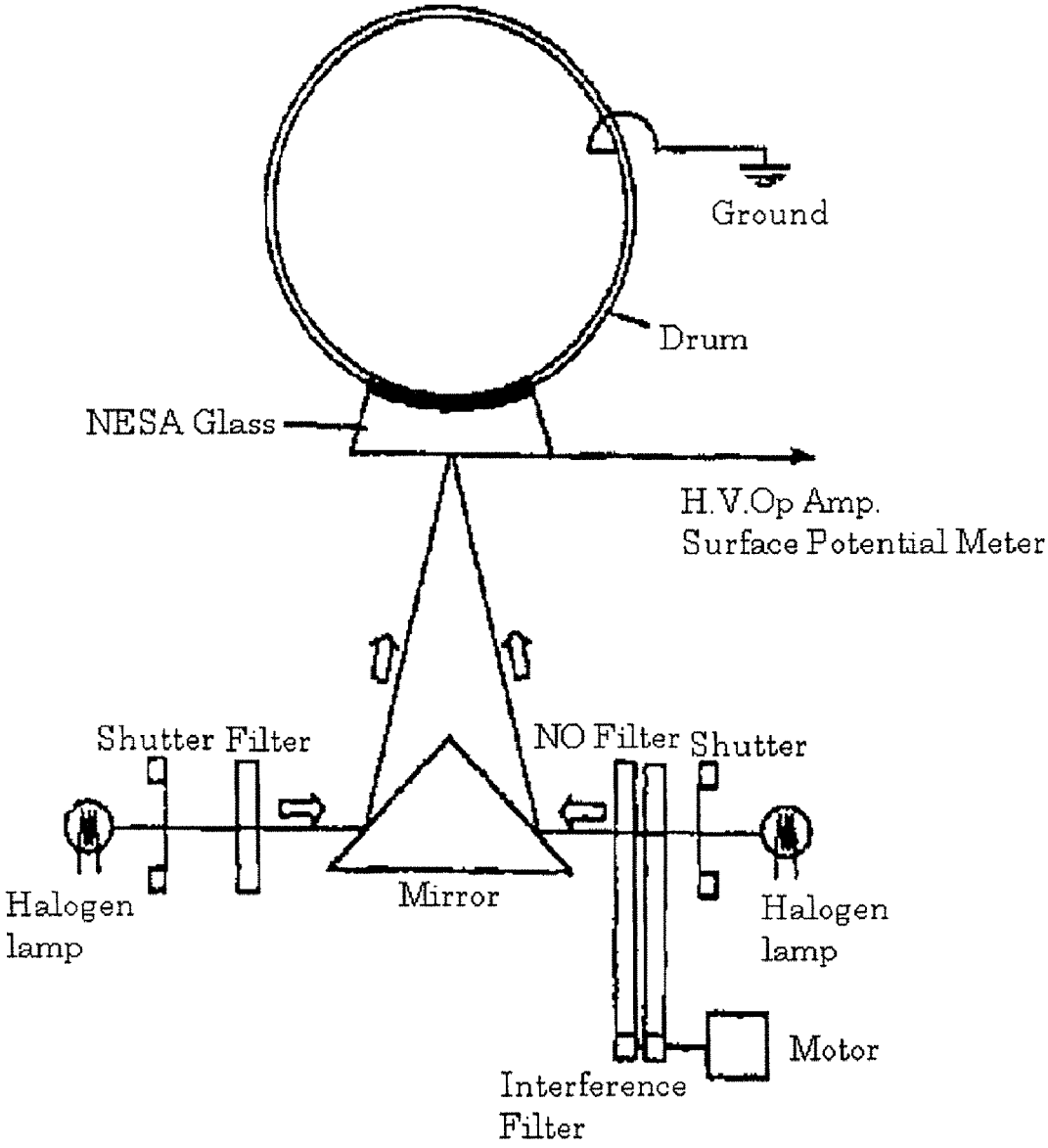
FIG. 8 is an outline view of a measuring device for measuring the charging property of an image bearing member by a direct voltage application mode.

FIG. 8 shows the outline of an image bearing member potential measuring device according to a direct voltage application mode used in this example. A high voltage power supply amplifies an output from a DC/AC converter (controlled by a computer) by using a quick-response operational amplifier. A resistance or a capacitor can be inserted between the power supply and an image bearing member as required, and the insertion can change the time constant of charging. Four light sources are placed on the front, rear, left, and right sides of the image bearing member, and exposure can be performed by using a reflecting mirror placed below an electrode. Any one of various filters can be set between each light source and the image bearing member.

Figure 9:
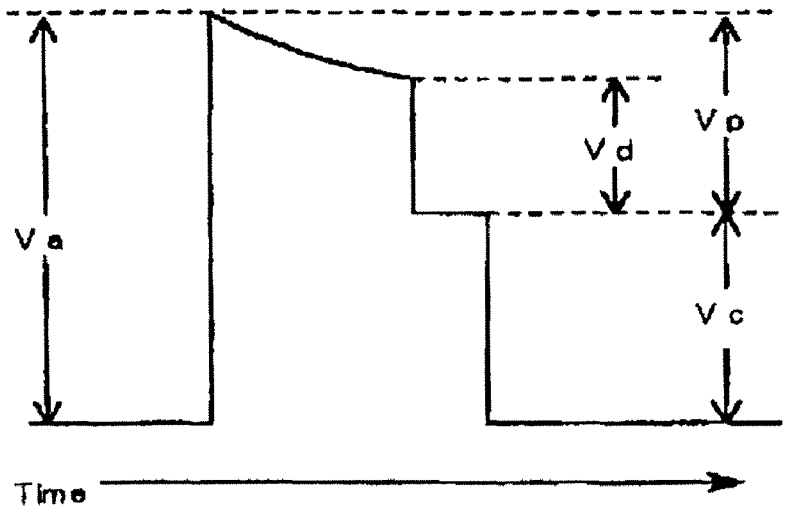
FIG. 9 is an outline view of the sequence of measurement by the measuring device of FIG. 8.
Figure 10:
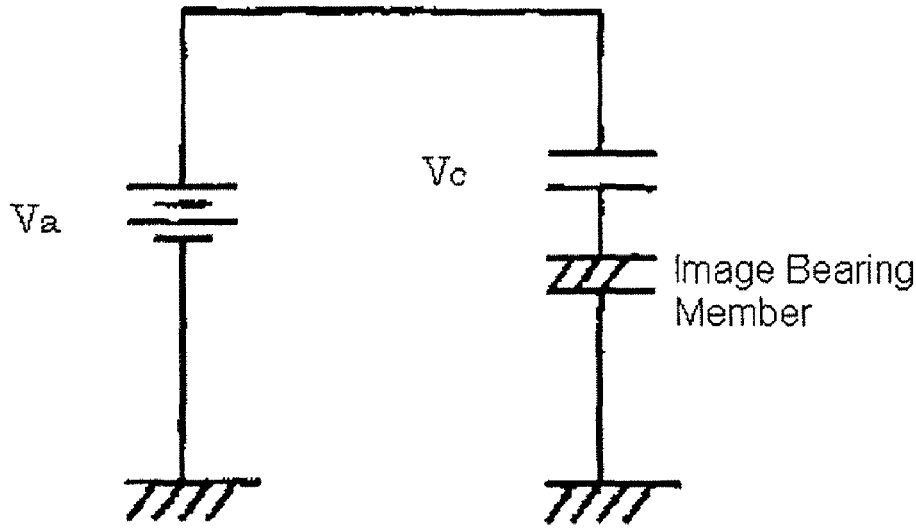
FIG. 10 is an outline view of the measuring circuit of the measuring device of FIG. 8.

Next, a measurement sequence will be described. In this experiment, measurement is performed by using a capacitor model in which an image bearing member drum is regarded as a capacitor. FIG. 9 shows the measurement sequence, and FIG. 10 shows the outline view of a measuring circuit.

Measurement was advanced in accordance with the measurement sequence shown in FIG. 9. The following description describes details about the measurement. An image bearing member was irradiated with erase exposure for eliminating the hysteresis of the image bearing member and pre-exposure by using a light source. About 10 [msec] after the irradiation, a predetermined applied voltage (Va) was applied to the image bearing member. About 0.2 [sec] after the application, a potential corresponding to Vd+Vc was measured. After the measurement, the image bearing member was grounded. Next, the potential of a Vc component was measured. Vd determined from those results was defined as an image bearing member potential.

Evaluation was performed by categorizing the resultant drum potential reduction ratio into any one of the following three stages.

A: The drum potential reduction ratio is less than 10%.

B: The drum potential reduction ratio is 10% or more and less than 30%.

C: The drum potential reduction ratio is 30% or more.

<Image Density>

The image density of the portion corresponding to the solid black of the test chart (dot having a diameter of 5 mm) after the completion of the 1,000,000-sheet durability test was measured by using a Macbeth reflection densitometer (manufactured by GretagMacbeth) and an SPI filter. Evaluation was performed by categorizing the image density into any one of the following ranks.

A: 1.3 or more

B: 1.0 or more and less than 1.3

C: Less than 1.0

<Fogging>

After the 1,000,000-sheet durability test, the reflection density (Dr) of transfer paper before the formation of an image, and the worst value (Ds) of a reflection density after the copying of a solid white image were measured by using a "Reflection Densitometer" (REFLECTOMETER MODEL TC-6DS manufactured by Tokyo Denshoku). Evaluation was performed on the basis of a difference (Ds−Dr) as a fogging value.

A: Less than 0.1

B: 0.1 or more and less than 0.5

C: 0.5 or more and less than 1.5

D: 1.5 or more and less than 2.0

E: 2.0 or more

<Cleaning Failure>

The generation of an image defect (stripe-like or dot-like defect) resulting from the evasion of a transfer residual developer through a cleaning blade was observed during print duration, and evaluation was performed by categorizing the result of the observation into any one of the following ranks.

A: No image defect is generated.

B: The number of times of the generation of a slight dot-like image defect is one or less.

C: The number of times of the generation of a stripe-like image defect is one or more.

Examples B and C, and Comparative Examples A, B, and D

Developers B, C, E, F, and H were each produced in the same manner as in Example A except that a binder resin, a charge control agent, and a composite inorganic fine powder were changed in accordance with the formulation shown in Table 8. It should be noted that Charge Control Agent B is a compound having the following structural formula.

[Chem 3]

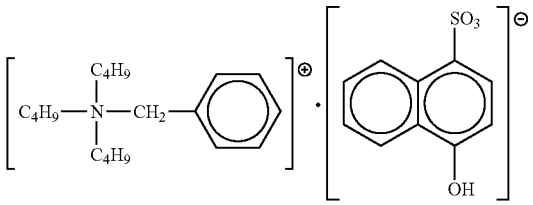

Developers B, C, E, F, and H described above were each evaluated in the same manner as in Example A except that the image bearing member of the evaluation machine in Example A was changed to any one of the image bearing members shown in Table 9. Table 9 shows the results.

Example D and Comparative Example C

A commercially available digital copying machine iR7105i (reversal development mode, manufactured by Canon Inc.) was used in evaluation after having been reconstructed as follow: the reversal development mode was of a negatively chargeable developer/negatively chargeable image bearing member constitution, and an image bearing member drum was changed to Image bearing Member C so that the circumferential speed of the image bearing member drum would be 660 mm/s.

Developers D and G were each produced in the same manner as in Example A except that a binder resin, a charge control agent, and a composite inorganic fine powder were changed as shown in Table 8, and, furthermore, Hydrophobic Silica Fine Powder 1 was changed to 1.0 part by mass of Hydrophobic Silica Fine Powder 2 (having a BET specific surface area of 200 $m^2/g$ and obtained by subjecting a silica parent body to a hydrophobic treatment with 30 parts by mass of hexamethyldisilazane and 10 parts by mass of dimethyl silicone oil). It should be noted that Charge Control Agent C is a compound having the following structural formula.

[Chem 4]

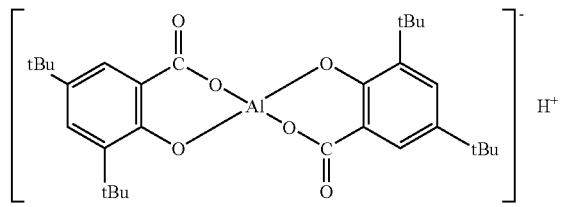

Developers D and G described above were each evaluated in the same manner as in Example A. Table 9 shows the results.

Comparative Examples E and F

Developers I and J were each produced in the same manner as in Example A except that Composite Inorganic Fine Powder A was changed to strontium carbonate (number average particle diameter 150 nm, 1.0 part by mass) or titanium oxide (number average particle diameter 320 nm, 1.5 parts by mass) shown in Table 8. Developers I and J described above were each evaluated in the same manner as in Example A. Table 9 shows the results.

TABLE 8

| | | Developer A | Developer B | Developer C | Developer D | Developer E |
|---|---|---|---|---|---|---|
| Binder resin | Kind | A | B/C | B/C | D/E | B/C |
| | Addition amount (part by mass) | 100 | 80/20 | 80/20 | 50/50 | 80/20 |
| Charge control agent | Kind | A | A | B | C | A |
| | Addition amount (part by mass) | 2 | 2 | 4 | 2 | 2 |
| Composite inorganic fine powder | Kind | A | B | C | D | E |
| | Addition amount (part by mass) | 1.2 | 1.0 | 1.0 | 1.5 | 1.0 |

| | | Developer F | Developer G | Developer H | Developer I | Developer J |
|---|---|---|---|---|---|---|
| Binder resin | Kind | A | D/E | A | A | A |
| | Addition amount (part by mass) | 100 | 50/50 | 100 | 100 | 100 |

TABLE 8-continued

| | | | | | | |
|---|---|---|---|---|---|---|
| Charge control agent | Kind | A | C | A | A | A |
| | Addition amount (part by mass) | 2 | 2 | 2 | 2 | 2 |
| Composite inorganic fine powder | Kind | F | G | — | $SrCO_3$ (150 nm) | $TiO_2$ (320 nm) |
| | Addition amount (part by mass) | 1.2 | 1.0 | | 1.0 | 1.5 |

TABLE 9

| | | Example A | Example B | Example C | Example D |
|---|---|---|---|---|---|
| Developer | | A | B | C | D |
| Photosensitive member | | A | A | B | C |
| Normal temperature and low humidity 23° C./5% RH | Black spot | A | A | B | B |
| | Image density stability | A | A | A | B |
| | Drum potential reduction ratio | B | A | A | B |
| | Image density | A | A | B | A |
| | Fogging | A | B | B | B |
| | Cleaning failure | A | A | A | A |
| High temperature and high humidity 30° C./80% RH | Black spot | A | A | A | A |
| | Image density stability | A | A | A | A |
| | Drum potential reduction ratio | A | A | A | A |
| | Image density | A | B | B | A |
| | Fogging | A | A | A | B |
| | Cleaning failure | A | A | A | A |

| | | Comparative example A | Comparative example B | Comparative example C | Comparative example D | Comparative example E | Comparative example F |
|---|---|---|---|---|---|---|---|
| Developer | | E | F | G | H | I | J |
| Photosensitive member | | A | A | C | B | A | A |
| Normal temperature and low humidity 23° C./5% RH | Black spot | B | C | A | C | B | A |
| | Image density stability | C | C | A | C | C | B |
| | Drum potential reduction ratio | C | C | A | C | C | A |
| | Image density | A | A | B | A | B | C |
| | Fogging | C | D | C | D | E | E |
| | Cleaning failure | A | A | C | A | A | A |
| High temperature and high humidity 30° C./80% RH | Black spot | A | B | A | B | A | A |
| | Image density stability | A | A | A | A | A | A |
| | Drum potential reduction ratio | B | B | A | B | B | A |
| | Image density | A | A | B | A | B | C |
| | Fogging | B | C | D | C | D | D |
| | Cleaning failure | A | A | C | A | A | A |

Image Bearing Member Production Example a

An aluminum cylinder measuring 30 mm in diameter by 357.5 mm in length was used as a conductive support (substance), and an application liquid constituted of the following materials was applied onto the conductive support by an immersion coating method. The applied liquid was thermally cured at 140° C. for 30 minutes, whereby a conductive layer having a thickness of 18 μm was formed.

| | |
|---|---|
| electrically conductive pigment: $SnO_2$-coated barium sulfate (trade name: PATHTRAN PC1 manufactured by MITSUI MINING & SMELTING Co., Ltd.) | 10 parts |

-continued

| | |
|---|---|
| Resistance controlling pigment: titanium oxide (trade name: TITANIX JR manufactured by TAYCA CORPORATION) | 3 parts |
| Binder resin: phenol resin (trade name: Tosspearl 120 manufactured by Toray silicone) | 6 parts |
| Leveling material: silicone oil (trade name: SH28PA manufactured by Toray silicone) | 0.001 parts |
| Solvent: methanol/methoxypropanol = 0.2/0.8 | 13 parts |

Next, a solution to be used as an application liquid prepared by dissolving 3 parts of N-methoxymethylated nylon and 2.5 parts of copolymerized nylon in the mixed solvent of 67 parts of methanol and 32 parts of n-butanol was applied onto the conductive layer by an immersion coating method, whereby a base layer having a thickness of 0.7 μm was formed.

4 parts of hydroxygallium phthalocyanine having a strong peak at a Bragg angle 2θ±0.2 deg in CuKα characteristic X-ray diffraction of each of 7.4 deg and 28.2 deg, 2 parts of polyvinyl butyral (trade name: S-Lec BX-1, manufactured by SEKISUI CHEMICAL CO., LTD.), and 82 parts of cyclohexanone were dispersed for 4 hours with a sand mill device using glass beads each having a diameter of 1 mm. After that, 80 parts of ethyl acetate were added to the resultant, whereby an application liquid for a charge generating layer was prepared. The application liquid was applied onto the base layer by an immersion coating method, whereby a charge generating layer having a thickness of 0.2 μm was formed.

Next, a charge transporting layer was formed on the charge generating layer by using an application liquid for a charge generating layer prepared by dissolving 7 parts of a styryl compound represented by the following general formula (2) and 10 parts of a polycarbonate resin (trade name: Upilon Z800, manufactured by Mitsubishi Engineering-Plastics Corporation) in the mixed solvent of 107 parts of monochlorobenzene, 33 parts of dichloromethane, and 10 parts of polytetrafluorethylene fine particles. The thickness of the charge transporting layer at this time was 10 μm.

[Chem 5]

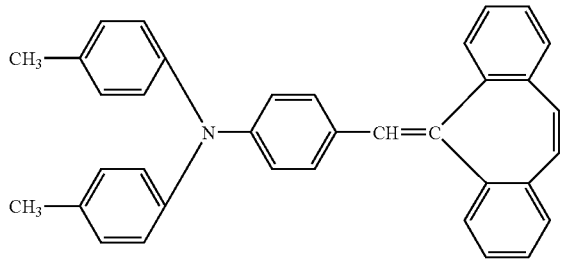

General formula

Next, 45 parts of a hole transportable compound represented by the following general formula (3) were dissolved in 55 parts of n-propyl alcohol, whereby an application liquid for a surface layer was prepared.

[Chem 6]

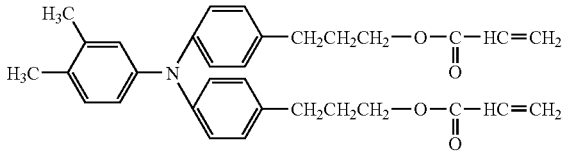

General formula

A surface layer was applied onto the charge transporting layer by using the application liquid, and was then irradiated with an electron beam in nitrogen under conditions including an accelerating voltage of 150 kV and a dose of 1.5 Mrad ($1.5\times10^4$ Gy). After that, the resultant was subsequently subjected to a heat treatment for 3 minutes under such a condition that the temperature of an image bearing member became 150° C. An oxygen concentration at this time was 80 ppm. Further, the resultant was subjected to a drying treatment in the air at 140° C. for 1 hour, whereby a surface layer having a thickness of 5 μm was formed.

Next, the resultant was subjected to surface-roughening for 120 seconds by using an abrasive sheet (trade name: C-2000, manufactured by FUJIFILM Corporation), Si—C (average particle diameter: 9 μm) as abrasive grains, a polyester film (thickness: 75 μm) as a base material, and a back-up roller having an outer diameter of 40 cm and an Asker C hardness of 40 degrees under the following conditions: an abrasive sheet feeding speed was 200 mm/sec, an image bearing member rotational speed was 25 rpm, a pressing pressure (pressing force) was 7.5 N/m$^2$, and the rotational direction of each of the abrasive sheet and the image bearing member was a counter direction (which may hereinafter be referred to as "counter (C)"). As a result, Image bearing Member a was obtained. Table 10 shows the values for the physical properties of Image bearing Member a obtained here.

Image Bearing Member Production Example b

Image bearing Member b was produced in the same manner as in Image bearing Member Production Example a except that a time period for the surface-roughening step was changed to 180 seconds. Table 10 shows the values for the physical properties of Image bearing Member b obtained here.

Image Bearing Member Production Example c

A conductive layer, a base layer, a charge generating layer, and a charge transporting layer were each formed in the same manner as in Image bearing Member Production Example a. Next, 60 parts of a hole transportable compound represented by the following general formula (1) were dissolved in the mixed solvent of 30 parts of monochlorobenzene and 30 parts of dichloromethane, whereby an application liquid for a surface layer was prepared. The upper portion of the charge transporting layer was coated with the application liquid, and the resultant was irradiated with an electron beam in nitrogen under conditions including an accelerating voltage of 150 kV and a dose of 5 Mrad ($5\times10^4$ Gy). After that, the resultant was subsequently subjected to a heat treatment for 3 minutes under such a condition that the temperature of an image bearing member became 150° C.

[Chem 7]

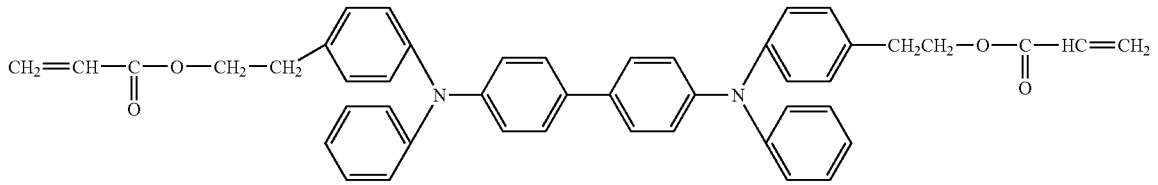

General formula

An oxygen concentration at this time was 80 ppm. Further, the resultant was subjected to a drying treatment in the air at 140° C. for 1 hour, whereby a surface layer having a thickness of 13 μm was formed.

Next, the resultant was subjected to surface-roughening for 120 seconds by using an abrasive sheet (trade name: AX-3000, manufactured by FUJIFILM Corporation), alumina (average particle diameter: 5 μm) as abrasive grains, a polyester film (thickness: 75 μm) as a base material, and a back-up roller having an outer diameter of 40 cm and an Asker C hardness of 40 degrees under the following conditions: an abrasive sheet feeding speed was 150 mm/sec, an image bearing member rotational speed was 15 rpm, a pressing pressure was 7.5 $N/m^2$, and the rotational direction of each of the abrasive sheet and the image bearing member was the same direction (which may hereinafter be referred to as "with (W)"). As a result, Image bearing Member c was obtained. Table 10 shows the values for the physical properties of Image bearing Member c obtained here.

Image Bearing Member Production Example d

Image bearing Member d was produced in the same manner as in Image bearing Member Production Example c except that a time period for the surface-roughening step was changed to 20 seconds. Table 10 shows the values for the physical properties of Image bearing Member d obtained here.

Image Bearing Member Production Example e

Image bearing Member e was produced in the same manner as in Image bearing Member Production Example c except that a time period for the surface-roughening step was changed to 50 seconds. Table 10 shows the values for the physical properties of Image bearing Member e obtained here.

Image Bearing Member Production Example f

This example was different from Image bearing Member Production Example a in that the amount of the polytetrafluorethylene fine particles to be added to the application liquid for a charge transporting layer was changed to 40 parts.

Further, the resultant was alternatively subjected to surface-roughening for 18 minutes by using an abrasive sheet (trade name: AX-3000, manufactured by FUJIFILM Corporation), alumina (average particle diameter: 5 μm) as abrasive grains, a polyester film (thickness: 75 μm) as a base material, and a back-up roller having an outer diameter of 40 cm and an Asker C hardness of 40 degrees under the following conditions: an abrasive sheet feeding speed was 150 mm/sec, an image bearing member rotational speed was 15 rpm, a pressing pressure was 7.5 $N/m^2$, and the rotational direction of each of the abrasive sheet and the image bearing member was the same direction. As a result, Image bearing Member f was obtained. Table 10 shows the values for the physical properties of Image bearing Member f obtained here.

Image Bearing Member Production Example g

Image bearing Member g was produced in the same manner as in Image bearing Member Production Example f except that: the amount of the polytetrafluorethylene fine particles to be added to the application liquid for a charge transporting layer was changed to 50 parts; and a time period for the surface-roughening was changed to 16 minutes. Table 10 shows the values for the physical properties of Image bearing Member g obtained here.

Image Bearing Member Production Example h

Image bearing Member h was produced in the same manner as in Image bearing Member Production Example f except that: the amount of the polytetrafluorethylene fine particles to be added to the application liquid for a charge transporting layer was changed to 60 parts; and a time period for the surface-roughening was changed to 20 minutes. Table 10 shows the values for the physical properties of Image bearing Member h obtained here.

Image Bearing Member Production Example i

A conductive layer, a base layer, a charge generating layer, and a charge transporting layer were each formed in the same manner as in Image bearing Member Production Example a. Next, 50 parts of antimony-doped tin oxide fine particles subjected to a surface treatment with 3,3,3-trifluoropropyltrimethoxysilane (trade name: LS 1090, manufactured by Shin-Etsu Chemical Co., Ltd.) (treatment amount 7 mass %) and 30 parts of an acrylic monomer represented by the following general formula (7) and having no hole transporting property were dispersed in 150 parts of ethanol over 70 hours with a sand mill, whereby an application liquid for a surface layer was prepared.

[Chem 8]

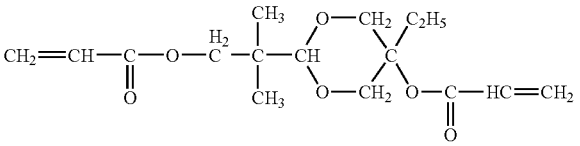

General formula

After the application liquid had been applied to the charge transporting layer, an electron beam irradiation treatment was similarly performed. Image bearing Member i was produced in the same manner as in Image bearing Member Production Example f except that a time period for the surface-roughening treatment was changed to 25 minutes. Table 10 shows the values for the physical properties of Image bearing Member i obtained here.

TABLE 10

| | Conditions for surface-roughening treatment | | | | | | | |
|---|---|---|---|---|---|---|---|---|
| | Abrasive sheet | | | | | Back-up | | |
| | Sheet material | Feeding speed (mm/s) | Rotational direction | Number of revolutions (rpm) | Pressing force ($N/m^2$) | Diameter (cm) | Asker C hardness (degree) | Time |
| Image bearing Member a | C2000 | 200 | Backward direction | 25 | 7.5 | 40 | 40 | 120 seconds |
| Image bearing Member b | C2000 | 200 | Backward direction | 25 | 7.5 | 40 | 40 | 180 seconds |
| Image bearing Member c | AX3000 | 150 | Forward direction | 15 | 7.5 | 40 | 40 | 120 seconds |
| Image bearing Member d | AX3000 | 150 | Forward direction | 15 | 7.5 | 40 | 40 | 20 minutes |
| Image bearing Member e | AX3000 | 150 | Forward direction | 15 | 7.5 | 40 | 40 | 50 seconds |
| Image bearing Member f | AX3000 | 150 | Forward direction | 15 | 7.5 | 40 | 40 | 18 minutes |
| Image bearing Member g | AX3000 | 150 | Forward direction | 15 | 7.5 | 40 | 40 | 16 minutes |
| Image bearing Member h | AX3000 | 150 | Forward direction | 15 | 7.5 | 40 | 40 | 20 minutes |
| Image bearing Member i | AX3000 | 150 | Forward direction | 15 | 7.5 | 40 | 40 | 25 minutes |

| | Number of grooves (grooves/1,000 μm) | Average width W of grooves (μm) | Universal hardness HU ($N/mm^2$) | Elastic deformation ratio We (%) |
|---|---|---|---|---|
| Image bearing Member a | 120 | 4.5 | 180 | 53 |
| Image bearing Member b | 520 | 10.6 | 182 | 54 |
| Image bearing Member c | 80 | 3.2 | 235 | 58 |
| Image bearing Member d | 870 | 18.3 | 235 | 57 |
| Image bearing Member e | 32 | 2.2 | 235 | 56 |
| Image bearing Member f | 900 | 19.2 | 170 | 46 |
| Image bearing Member g | 870 | 20.3 | 148 | 41 |
| Image bearing Member h | 1250 | 25.4 | 135 | 35 |
| Image bearing Member i | 860 | 21.0 | 245 | 67 |

Composite Inorganic Fine Powder Production Example a

A titanyl sulfate powder was dissolved in distilled water so that a Ti concentration in the solution would be 1.5 (mol/l). Next, sulfuric acid and distilled water were added to the solution so that a sulfuric acid concentration after the completion of a reaction would be 2.8 (mol/l). The solution was put in a sealed vessel and heated at 110° C. for 36 hours, whereby a hydrolysis reaction was performed. After that, the resultant was sufficiently washed with water so that sulfuric acid and an impurity would be removed. As a result, metatitanic acid slurry was obtained. Strontium carbonate (measured by the same method as the inorganic fine powder, and having a number average particle diameter of 85 nm) was added to the slurry in a molar amount equivalent to that of titanium oxide. After having been sufficiently mixed in an aqueous medium, the resultant was washed and dried. After that, the resultant was sintered at 820° C. for 3 hours, mechanically pulverized, and classified, whereby Composite Inorganic Fine Powder a having a number average particle diameter of 110 nm was obtained. Table 11 shows the physical properties of Composite Inorganic Fine Powder a obtained here.

Composite Inorganic Fine Powder Production Examples b to h

Composite Inorganic Fine Powders b to h were each obtained in the same manner as in Composite Inorganic Fine Powder Production Example a by using: the above metatitanic acid slurry while the particle diameter of, and sintering conditions for, strontium carbonate to be used were changed as shown in Table 11, and appropriately adjusting pulverization and classification conditions. Table 11 shows the physical properties of the resultant composite inorganic fine powders.

TABLE 11

| | | The particle diameter of $SrCO_3$ used as a raw material (nm) | Sintering temperature (° C.) | Sintering time (h) |
|---|---|---|---|---|
| Production Example a | Composite Inorganic Fine Powder a | 85 | 820 | 3 |
| Production Example b | Composite Inorganic Fine Powder b | 85 | 780 | 8 |
| Production Example c | Composite Inorganic Fine Powder c | 145 | 760 | 7 |
| Production Example d | Composite Inorganic Fine Powder d | 85 | 700 | 5 |
| Production Example e | Composite Inorganic Fine Powder e | 155 | 730 | 7 |
| Production Example f | Composite Inorganic Fine Powder f | 115 | 730 | 4 |
| Production Example g | Composite Inorganic Fine Powder g | 115 | 1150 | 5 |
| Production Example h | Composite Inorganic Fine Powder h | 155 | 1350 | 1 |

| | | Peak intensity Ia at 2θ = 32.20 deg Ia | The half width of a peak at 2θ = 32.20 deg | Peak intensity Ia at 2θ = 25.80 deg Ib | Peak intensity Ia at 2θ = 27.50 deg Ic | Ib/Ia | Ic/Ia | Number average particle diameter (nm) |
|---|---|---|---|---|---|---|---|---|
| Production Example a | Composite Inorganic Fine Powder a | 223000 | 0.26 | 9450 | 11000 | 0.042 | 0.049 | 110 |
| Production Example b | Composite Inorganic Fine Powder b | 185000 | 0.28 | 14800 | 13000 | 0.080 | 0.070 | 75 |
| Production Example c | Composite Inorganic Fine Powder c | 250000 | 0.28 | 2200 | 2300 | 0.009 | 0.009 | 230 |
| Production Example d | Composite Inorganic Fine Powder d | 185000 | 0.29 | 28000 | 28500 | 0.151 | 0.154 | 65 |
| Production Example e | Composite Inorganic Fine Powder e | 265000 | 0.22 | 2000 | 1900 | 0.008 | 0.007 | 920 |
| Production Example f | Composite Inorganic Fine Powder f | 203500 | 0.21 | 32500 | 31000 | 0.160 | 0.152 | 40 |
| Production Example g | Composite Inorganic Fine Powder g | 271500 | 0.23 | — | — | — | — | 1300 |
| Production Example h | Composite Inorganic Fine Powder h | 145000 | 0.18 | 200 | 150 | 0.001 | 0.001 | 2500 |

Resin Production Example a

Hybrid Resin

| (1) Production of polyester resin | |
|---|---|
| Terephthalic acid: | 6.1 mol |
| Dodecenylsuccinic anhydride: | 3.6 mol |
| Trimellitic anhydride: | 3.4 mol |
| 2.5-mol propylene oxide adduct of bisphenol A: | 7.3 mol |
| 2.5-mol ethylene oxide adduct of bisphenol A: | 3.0 mol |

The above polyester monomers were loaded into an autoclave together with 0.10 part by mass of dibutyltin oxide as an esterification catalyst. A decompression device, a water separation device, a nitrogen gas introducing device, a temperature measuring device, and a stirring device were attached to the autoclave, and the mixture was subjected to a condensation polymerization reaction while being heated to 210° C. under a nitrogen gas atmosphere, whereby a polyester resin was obtained.

(2) Production of Hybrid Resin Component 80 parts by mass of the above polyester resin were dissolved and swollen in 100 parts by mass of xylene. Next, 15 parts by mass of styrene, 4 parts by mass of 2-ethylhexyl acrylate, and 0.13 part by mass of dibutyltin oxide as an esterification catalyst were added to the resultant, and the whole was heated to the reflux temperature of xylene, whereby an ester exchange reaction between a carboxylic acid of the polyester resin and 2-ethylhexyl acrylate was initiated. Further, a xylene solution prepared by dissolving 1 part by mass of t-butylhydroperoxide as a radical polymerization initiator in 30 parts by mass of xylene was dropped to the resultant over about 1 hour. The resultant was held at the temperature for 6 hours, whereby a radical polymerization reaction was completed. The resultant was heated to 200° C. under reduced pressure for desolvation, whereby an ester exchange reaction between a hydroxyl group of the polyester resin and 2-ethylhexyl acrylate as a copolymerizable monomer of a vinyl polymer unit was performed. As a result, a hybrid resin produced by the ester bonding of the polyester resin, a vinyl polymer, a polyester unit, and the vinyl-based polymer unit was obtained.

The hybrid resin obtained here had an acid value of 28.4 mgKOH/g, a Tg of 57° C., a peak molecular weight (Mn) of 7,300, a weight average molecular weight (Mw) of 44,000, and an Mw/Mn of 8.0, and contained 13 mass % of THF insoluble matter.

Resin Production Example b

Polyester Resin

| | |
|---|---|
| Terephthalic acid: | 12 mol % |
| Fumaric acid: | 25 mol % |
| Trimellitic anhydride: | 5 mol % |
| 2.5-mol propylene oxide adduct of bisphenol A: | 35 mol % |
| 2.5-mol ethylene oxide adduct of bisphenol A: | 23 mol % |

The above polyester monomers were loaded into an autoclave together with an esterification catalyst. A decompression device, a water separation device, a nitrogen gas introducing device, a temperature measuring device, and a stirring device were attached to the autoclave, and the mixture was subjected to a condensation polymerization reaction while being heated to 210° C. under a nitrogen gas atmosphere, whereby First Polyester Resin a was obtained.

First Polyester Resin a obtained here had an acid value of 26 mgKOH/g, a hydroxyl value of 40 mgKOH/g, a Tg of 59° C., an Mn of 3,000, and an Mw of 12,000, and contained 0 mass % of THF insoluble matter.

Next, the following materials were subjected to a condensation polymerization reaction in the same manner as that described above:

| | |
|---|---|
| Fumaric acid | 33 mol % |
| Trimellitic anhydride | 10 mol % |
| 2.5-mol propylene oxide adduct of bisphenol A | 34 mol % |
| 2.5-mol ethylene oxide adduct of bisphenol A | 20 mol %. |

3 mol % of trimellitic anhydride were further added in the midst of the polymerization, whereby Second Polyester Resin b was obtained.

Second Polyester Resin b obtained here had an acid value of 23 mgKOH/g, a hydroxyl value of 35 mgKOH/g, a Tg of 61° C., an Mn of 3,000, and an Mw of 155,000, and contained 27 mass % of THF insoluble matter.

50 parts by mass of Polyester Resin a thus obtained and 50 parts by mass of Polyester Resin b thus obtained were mixed with a Henschel mixer, whereby a polyester resin was obtained.

The polyester resin obtained here had an acid value of 25 mgKOH/g, a hydroxyl value of 34 mgKOH/g, a Tg of 58° C., an Mn of 2,700, and an Mw of 84,000, and contained 16 mass % of THF insoluble matter.

Resin Production Example c

Styrene-Acrylic Resin

| | |
|---|---|
| Styrene | 70 parts by mass |
| n-butyl acrylate | 20 parts by mass |
| Monobutyl maleate | 5 parts by mass |
| Di-t-butyl peroxide | 1 part by mass |

200 parts by mass of xylene were loaded into a four-necked flask, and the air inside the container was sufficiently replaced with nitrogen while xylene was stirred. After the temperature of the flask had been increased to 130° C., the above respective components were dropped over 3.5 hours. Further, polymerization was completed under xylene reflux, and the solvent was removed by distillation under reduced pressure, whereby a styrene-acrylic resin was obtained. The resultant styrene-acrylic resin had an acid value of 23 mgKOH/g, a Tg of 59° C., a peak molecular weight of 13,500, a weigh average molecular weight (Mw) of 78,000, and an Mw/Mn of 12.0.

Developer Production Example 1

| | |
|---|---|
| Hybrid resin described above | 100 parts by mass |
| Polyethylene Wax (Polywax 850; manufactured by TOYO-PETROLITE) | 8 parts by mass |
| Charge control agent (Azo-based complex compound) (tradename: T-77 manufactured by Hodogaya Chemical Co., Ltd.) | 1.5 parts by mass |
| Magnetic iron oxide | 85 parts by mass |

(Number average particle diameter 0.18 μm, coercive force 11.4 kA/m, remanent magnetization 10.6 $Am^2/kg$, intensity of magnetization 82.3 $Am^2/kg$))

The above mixture was melted and mixed with a biaxial kneader heated to 130° C., and the cooled mixture was coarsely pulverized with a hammer mill. After that, the resultant was finely pulverized by using a fine pulverizer using a jet stream. The resultant finely pulverized product was classified with an air classifier, whereby toner particles having a weight average particle diameter (D4) of 7.9 μm and containing particles each having a particle diameter of 10.1 μm or more at a content of 6.6 vol % were obtained.

1.0 part by mass of Composite Inorganic Fine Powder a described above and 1.0 part by mass of hydrophobic dry silica (having a BET specific surface area of 300 $m^2/g$) were externally added to 100 parts by mass of the toner particles by rotationally operating a Henschel mixer FM 500 (manufactured by Mitsui Miike Machinery Co., Ltd.) at a stirring blade rotational speed of 1,100 rpm for 4 minutes, whereby Developer a was obtained.

Developer Production Examples b to j

Developers b to j were each obtained in the same manner as in Developer Production Example a except that a composite inorganic fine powder and a binder resin were changed as shown in Table 12.

Example a

A commercially available copying machine iR-4570 (manufactured by Canon Inc.) was reconstructed so that its print speed would be changed from 45 sheets/minute to 55 sheets/minute. 300,000 sheets were copied by using Developer a as a developer, Image bearing Member a as an image bearing member, and a test chart having a printing ratio of 6% under a high-temperature, high-humidity environment (40° C./90% RH). In addition, at this time, the pressure at which a cleaning blade was brought into abutment with the image bearing member was set to 30 gf/cm. After the above copying, evaluation tests for image density, fogging, flaws on the surface of the image bearing member, the fusion of the developer to the surface of the image bearing member, and cleaning performance were performed. Table 12 shows the results of the evaluation.

<Evaluation Test>

1) Image Density

The reflection density of a circle image having a diameter of 5 mm was measured at five points by using a "Macbeth reflection densitometer" (manufactured by GretagMacbeth) and an SPI filter. Evaluation was performed on the basis of the average value for the five measured densities.

Rank 5: 1.45 or more
Rank 4: 1.40 or more and less than 1.45
Rank 3: 1.35 or more and less than 1.40
Rank 2: 1.30 or more and less than 1.35
Rank 1: Less than 1.30

2) Fogging

The reflection density (Dr) of transfer paper before the formation of an image, and the worst value (Ds) of a reflection density after the copying of a solid white image were measured by using a "Reflection Densitometer" (REFLECTOMETER MODEL TC-6DS manufactured by Tokyo Denshoku). Evaluation was performed on the basis of a difference (Ds−Dr) as a fogging value.

Rank 5: Less than 0.1
Rank 4: 0.1 or more and less than 0.5
Rank 3: 0.5 or more and less than 1.5
Rank 2: 1.5 or more and less than 2.0
Rank 1: 2.0 or more 3) Flaws on Surface of Image Bearing Member/Fusion of Developer to Surface of Image Bearing Member The surfaces of: a solid black sample image and a half tone sample image at the time of the 300,000-sheet copying test under the high-temperature, high-humidity environment (40° C./90% RH); and the image bearing member after the completion of the test were visually observed and evaluated.

3-1) Evaluation for Flaws on Surface of Image Bearing Member

Rank 1: Innumerable flaws are generated on the surface of the image bearing member, and a stripe-like white void due to the generation of a flaw is observed on the solid black image.

Rank 2: A flaw is generated on the surface of the image bearing member, and a stripe-like white void due to the generation of the flaw is observed on the half tone image, but no void is observed on the solid black image.

Rank 3: A slight flaw is observed on the surface of the image bearing member, but the generation of a flaw cannot be observed on any image.

Rank 4: No flaws are generated on the surface of the image bearing member.

3-2) Evaluation for Fusion of Developer to Surface of Image Bearing Member

Rank 1: Innumerable developer fused products are generated on the surface of the image bearing member, and a rainy white void due to the generation of a fused product is observed on the solid black image.

Rank 2: A developer fused product is generated on the surface of the image bearing member, a rainy white void due to the generation of the fused product is observed on the half tone image, and a slight white void is observed even on the solid black image.

Rank 3: A developer fused product is generated on the surface of the image bearing member, and a rainy white void due to the generation of the fused product is observed on the half tone image, but no void is observed on the solid black image.

Rank 4: A slight developer fused product is observed on the surface of the image bearing member, but the generation of a fused product cannot be observed on any image.

Rank 5: No developer fused products are generated on the surface of the image bearing member.

4) Cleaning Performance (Visual Evaluation of Cleaning Blade and Charging Roller)

The chattered situation of a cleaning blade at the time of the 300,000-sheet copying test under the high-temperature, high-humidity environment (40° C./90% RH), and the surfaces of the cleaning blade and a charging roller after the completion of the test were visually observed and evaluated.

Rank 1: Cleaning blade chatter often occurs during the copying test.

Rank 2: No cleaning blade chatter occurs during the copying test, but the chipping of the cleaning blade occurs, and a stripe-like stain due to the evasion of a developer through the cleaning blade is observed on the charging roller.

Rank 3: No cleaning blade chatter occurs during the copying test, but the chipping of part of the cleaning blade occurs. No stain is observed on the charging roller.

Rank 4: No cleaning blade chatter occurs during the copying test, and the chipping of the cleaning blade does not occur.

Examples b to h, and Comparative Examples a and b

Evaluation was performed in the same manner as in Example a except that a developer and an image bearing member shown in Table 12 were used. Table 12 shows the results of the evaluation.

TABLE 12

| | Developer | Composite inorganic fine powder | Binder resin | Electrophotographic image bearing member | W/d |
|---|---|---|---|---|---|
| Example a | a | a | Hybrid resin | a | 40.9 |
| Example b | b | b | Hybrid resin | b | 141.3 |

TABLE 12-continued

| | | | | | |
|---|---|---|---|---|---|
| Example c | c | c | Hybrid resin | d | 79.6 |
| Example d | b | b | Hybrid resin | e | 29.3 |
| Example e | b | b | Hybrid resin | c | 42.7 |
| Example f | c | c | Hybrid resin | f | 83.5 |
| Example g | c | c | Hybrid resin | i | 91.3 |
| Example h | c | c | Hybrid resin | g | 88.3 |
| Example i | d | d | Hybrid resin | g | 312.3 |
| Example j | e | e | Hybrid resin | g | 22.1 |
| Example k | f | e | Polyester resin | g | 22.1 |
| Example l | g | e | Styrene-acrylic resin | g | 22.1 |
| Example m | h | f | Styrene-acrylic resin | g | 507.5 |
| Example n | g | e | Styrene-acrylic resin | h | 27.6 |
| Comparative example a | i | g | Styrene-acrylic resin | g | 15.6 |
| Comparative example b | j | h | Styrene-acrylic resin | h | 10.2 |

| | Image density | | Fogging | | Flaws on the surface of an image | | The fusion of a developer to the surface of a |
|---|---|---|---|---|---|---|---|
| | Density value | Rank | Fogging value | Rank | bearing member | Cleaning performance | photosensitive member |
| Example a | 1.47 | 5 | 0.02 | 5 | 4 | 4 | 5 |
| Example b | 1.43 | 4 | 0.20 | 4 | 4 | 3 | 5 |
| Example c | 1.43 | 4 | 0.22 | 4 | 3 | 4 | 4 |
| Example d | 1.42 | 4 | 0.23 | 4 | 4 | 2 | 5 |
| Example e | 1.43 | 4 | 0.24 | 4 | 3 | 3 | 4 |
| Example f | 1.42 | 4 | 0.25 | 4 | 2 | 3 | 4 |
| Example g | 1.41 | 4 | 0.24 | 4 | 2 | 2 | 3 |
| Example h | 1.42 | 4 | 0.23 | 4 | 2 | 3 | 3 |
| Example i | 1.38 | 3 | 0.71 | 3 | 2 | 2 | 3 |
| Example j | 1.38 | 3 | 0.66 | 3 | 2 | 2 | 3 |
| Example k | 1.34 | 2 | 0.72 | 3 | 2 | 2 | 3 |
| Example l | 1.34 | 2 | 0.68 | 3 | 2 | 2 | 3 |
| Example m | 1.30 | 2 | 0.99 | 2 | 2 | 2 | 2 |
| Example n | 1.32 | 2 | 1.23 | 2 | 2 | 2 | 2 |
| Comparative example a | 1.28 | 1 | 1.56 | 2 | 2 | 2 | 3 |
| Comparative example b | 1.28 | 1 | 1.76 | 2 | 1 | 1 | 1 |

The present invention has been described in detail with reference to a preferred embodiment. However, it is apparent to one skilled in the art that the present invention can be variously modified, or various equivalents of the present invention can be used without departing from the scope of the present invention. All the cited documents in the present description are shown for reference as part of the present description.

The present application claims the priority based on a Japanese patent application filed on the sixth day of January, 2006 (Application No.; Japanese Patent Application No. 2006-001783), a Japanese patent application filed on the twenty-sixth day of June, 2006 (Application No.; Japanese Patent Application No. 2006-174738), and a Japanese patent application filed on the twenty-second day of November, 2006 (Application No.; Japanese Patent Application No. 2006-315476).

What is claimed is:

1. A developer, comprising at least:

toner particles each containing at least a binder resin; and a composite inorganic fine powder, wherein:

the composite inorganic fine powder is a composite integrally formed from strontium titanate, strontium carbonate and titanium oxide, and has a peak at a Bragg angle (2θ±0.20 deg) of 32.20 deg originating from strontium titanate, 25.80 deg originating from strontium carbonate, and 27.50 deg originating from titanium oxide in a CuKα characteristic X-ray diffraction pattern; and a half width of the X-ray diffraction peak at a Bragg angle (2θ±0.20 deg) of 32.20 deg is 0.20 to 0.30 deg, wherein an intensity level (Ia) of the peak of 32.20 deg, an intensity level (Ib) of the peak of 25.80 deg and an intensity level (Ic) of the peak of 27.50 deg satisfy the following formulae:

$$0.010<(Ib)/(Ia)<0.150 \text{ and}$$

$$0.010<(Ic)/(Ia)<0.150.$$

2. A developer according to claim 1, wherein the composite inorganic fine powder has a number average particle diameter of 30 nm or more to less than 1,000 nm.

3. An image forming method, comprising at least the steps of:

charging an image bearing member;

forming an electrostatic latent image on the image bearing member by exposure;

developing the electrostatic latent image on the image bearing member with a developer to form a developer image;

transferring the developer image onto a transfer material through or without through an intermediate transfer member; and fixing the transferred developer image to the transfer material, wherein the developer according to claim 1 is used as the developer.

4. An image forming method according to claim 3, wherein:

the image bearing member has a conductive substance, and a photoconductive layer containing at least amorphous silicon and a surface protective layer on the conductive substance; and the electrostatic latent image is developed by using the developer according to a reversal development mode.

5. An image forming method according to claim 3, wherein:

the image bearing member has a photosensitive layer on the base body, and has, in its surface, 20 to 1,000 grooves each having a groove width of 0.5 to 40.0 μm per 1,000 μm in a circumferential direction; and an average width W (μm) of the grooves present in the surface of the image bearing member and a number average particle diameter d (nm) of the composite inorganic fine powder satisfy the following formulae:

$$30 \leqq d < 1{,}000$$

$$20.0 \leqq W/(d \times 10^{-3}) \leqq 500.0.$$

6. An image forming method according to claim 5, wherein the surface of the image bearing member has a universal hardness value HU ($N/mm^2$) of 150 to 240, and an elastic deformation ratio We (%) of 44 to 65.

* * * * *